US011421410B2

(12) United States Patent
Kitaura et al.

(10) Patent No.: US 11,421,410 B2
(45) Date of Patent: Aug. 23, 2022

(54) FLUSH WATER TANK APPARATUS AND FLUSH TOILET APPARATUS PROVIDED WITH THE SAME

(71) Applicant: TOTO LTD., Kitakyushu (JP)

(72) Inventors: Hidekazu Kitaura, Kitakyushu (JP); Nobuhiro Hayashi, Kitakyushu (JP); Akihiro Shimuta, Kitakyushu (JP); Masahiro Kuroishi, Kitakyushu (JP); Hiroshi Hashimoto, Kitakyushu (JP); Koki Shinohara, Kitakyushu (JP); Kenji Hatama, Kitakyushu (JP)

(73) Assignee: TOTO LTD., Fukuoka (JP)

( * ) Notice: Subject to any disclaimer, the term of this patent is extended or adjusted under 35 U.S.C. 154(b) by 0 days.

(21) Appl. No.: 17/343,135

(22) Filed: Jun. 9, 2021

(65) Prior Publication Data

US 2022/0074180 A1 Mar. 10, 2022

(30) Foreign Application Priority Data

Sep. 4, 2020 (JP) ..... JP2020-149155
May 7, 2021 (JP) ..... JP2021-078917

(51) Int. Cl.
*E03D 1/34* (2006.01)
*E03D 1/33* (2006.01)

(52) U.S. Cl.
CPC ..... *E03D 1/34* (2013.01); *E03D 1/33* (2013.01)

(58) Field of Classification Search
CPC .... E03D 1/33; E03D 1/34; E03D 5/01; E03D 5/012; E03D 5/024
USPC ..... 4/379
See application file for complete search history.

(56) References Cited

U.S. PATENT DOCUMENTS

| | | | | |
|---|---|---|---|---|
| 9,447,569 | B2 * | 9/2016 | Shinohara | E03D 5/094 |
| 9,719,238 | B2 * | 8/2017 | Momoe | E03D 5/094 |
| 10,794,050 | B2 * | 10/2020 | Shinohara | E03D 5/10 |
| 2010/0212696 | A1 * | 8/2010 | Shirai | E03D 11/08 134/166 R |
| 2010/0306911 | A1 * | 12/2010 | Bell | E03D 1/36 251/324 |
| 2017/0314248 | A1 * | 11/2017 | Segura Martínez | E03D 9/035 |
| 2020/0313547 | A1 * | 10/2020 | Higashida | E03D 5/01 |
| 2021/0040717 | A1 * | 2/2021 | Kitaura | E03D 1/286 |
| 2021/0040718 | A1 * | 2/2021 | Kitaura | E03D 1/36 |

(Continued)

FOREIGN PATENT DOCUMENTS

JP 2009-257061 A 11/2009

*Primary Examiner* — Benjamin R Shaw
(74) *Attorney, Agent, or Firm* — Studebaker & Brackett PC

(57) ABSTRACT

There are provided a flush water tank apparatus capable of reducing a pressure of flush water in a pressure chamber easily, and a flush toilet apparatus provided with the same. A discharge valve hydraulic drive portion of a flush water tank apparatus includes a cylinder in which supplied the flush water flows, a piston that is slidably disposed in the cylinder, partitions inside of the cylinder into a pressure chamber and a back pressure chamber, and further is moved from a first position to a second position by a pressure of the flush water that has flowed into the pressure chamber, an outflow portion from which the flush water in the cylinder flows out, and a communication mechanism that establishes communication between the pressure chamber and the outflow portion after the clutch mechanism is disengaged.

14 Claims, 46 Drawing Sheets

(56) References Cited

U.S. PATENT DOCUMENTS

| | | | | |
|---|---|---|---|---|
| 2021/0062489 | A1* | 3/2021 | Gilde | E03D 5/024 |
| 2021/0270023 | A1* | 9/2021 | Kitaura | E03D 1/36 |
| 2021/0270024 | A1* | 9/2021 | Kitaura | E03D 1/32 |
| 2021/0270025 | A1* | 9/2021 | Hayashi | E03D 5/105 |
| 2021/0270026 | A1* | 9/2021 | Hayashi | E03D 1/32 |
| 2021/0381214 | A1* | 12/2021 | Hayashi | E03D 5/10 |
| 2022/0074180 | A1* | 3/2022 | Kitaura | E03D 1/34 |
| 2022/0074181 | A1* | 3/2022 | Shimuta | E03D 3/04 |

* cited by examiner

OPEN STATE

CLOSED STATE

FLUSH WATER TANK APPARATUS AND FLUSH TOILET APPARATUS PROVIDED WITH THE SAME

TECHNICAL FIELD

The present invention relates to a flush water tank apparatus, and particularly to a flush water tank apparatus configured to supply flush water to a flush toilet and a flush toilet apparatus provided with the same.

BACKGROUND ART

Japanese Patent Laid-Open No. 2009-257061 discloses a low tank apparatus. The low tank apparatus includes a hydraulic cylinder device, and has a configuration in which the hydraulic cylinder device is operated by a water pressure of supplied water to thereby open a discharge valve in a low tank. In the low tank apparatus, the supply and supply stop of the water to the hydraulic cylinder device are controlled by an electromagnetic valve, and opening and closing of the discharge valve are controlled based on the operation of the electromagnetic valve. That is, when water supplied by operating the electromagnetic valve flows into the hydraulic cylinder device, a piston in the hydraulic cylinder device is pushed up, and this upward movement of the piston causes the discharge valve to be pulled up, whereby the discharge valve is opened. When the supply of the water to the hydraulic cylinder device is stopped by the electromagnetic valve, the water gradually flows out from the hydraulic cylinder device through a drain portion, and the piston gradually moves downward, whereby the discharge valve is closed.

SUMMARY OF THE INVENTION

Technical Problem

However, in the low tank apparatus disclosed in Japanese Patent Laid-Open No. 2009-257061, after the piston in the hydraulic cylinder device is pushed up, the water gradually flows out from the hydraulic cylinder device through the drain portion, whereby the piston gradually moves downward. At this time, since the water slowly flows out from the hydraulic cylinder device through the drain portion, the piston slowly moves downward. In a case where the piston slowly moves downward, the time is required to close the discharge valve and the time required to complete one flush operation is relatively increased. To rapidly drain the water from the hydraulic cylinder device, it is necessary to provide an additional electromagnetic valve to control outflow of the water from the hydraulic cylinder device, which causes increase in size of the apparatus.

Accordingly, an object of the present invention is to provide a flush water tank apparatus capable of reducing a pressure of flush water in a pressure chamber easily with a relatively simple configuration in which an additional electromagnetic valve is not required, and a flush toilet apparatus provided with the same.

Solution to Problem

To solve the above problems, one embodiment of the present invention is a flush water tank apparatus configured to supply flush water to a flush toilet, the flush water tank apparatus comprising a reservoir tank configured to store the flush water to be supplied to the flush toilet and having a water discharge opening formed to discharge the stored flush water to the flush toilet, a discharge valve configured to open and close the water discharge opening to supply the flush water to the flush toilet and to stop a supply of the flush water to the flush toilet, a discharge valve hydraulic drive portion configured to drive the discharge valve using a water supply pressure of supplied tap water, a clutch mechanism configured to connect the discharge valve and the discharge valve hydraulic drive portion to pull up the discharge valve by a drive force of the discharge valve hydraulic drive portion, and to be disengaged at a predetermined timing to cause the discharge valve to fall, and a float mechanism configured to be operated according to a water level in the reservoir tank, and to be engaged with the discharge valve after disengagement of the clutch mechanism, to switch between a holding attitude of restricting the fall of the discharge valve and a non-holding attitude of not restricting the fall of the discharge valve, wherein the discharge valve hydraulic drive portion includes a cylinder in which supplied the flush water flows, a piston that is slidably disposed in the cylinder, the piston partitions inside of the cylinder into a pressure chamber and a back pressure chamber, and further the piston is moved from a first position to a second position by a pressure of the flush water that has flowed into the pressure chamber, an outflow portion from which the flush water in the cylinder flows out, and a communication mechanism that establishes communication between the pressure chamber and the outflow portion after the disengagement of the clutch mechanism.

According to one embodiment of the present invention configured as described above, the communication mechanism establishes the communication between the pressure chamber and the outflow portion after the disengagement of the clutch mechanism. This causes the flush water in the pressure chamber to flow out into the outflow portion with a relatively simple configuration in which an additional electromagnetic valve is not required, which enables the pressure of the flush water in the pressure chamber to be easily reduced and enables the piston to easily return from the second position to the first position side. Additionally, it is possible to restrain the pulling-up of the discharge valve until the disengagement of the clutch mechanism from being obstructed by the communication between the pressure chamber and the outflow portion. Moreover, since the clutch mechanism is disengaged at a predetermined timing in a predefined manner, it is possible to reduce an influence on the operation of the float mechanism that is to be moved according to the water level in the reservoir tank, thereby facilitating a predefined operation. Furthermore, since the piston easily returns from the second position to the first position side, a time period until the discharge valve is closed can be reduced and a time period until one flush operation is completed can be made relatively short.

Advantageous Effect of the Invention

According to the present invention, there can be provided a flush water tank apparatus capable of reducing a pressure of flush water in a pressure chamber easily, and a flush toilet apparatus provided with the same.

DETAILED DESCRIPTION OF EMBODIMENTS

Next, referring to the attached drawings, a flush water tank apparatus according to a first embodiment of the present invention and a flush toilet apparatus provided with the same will be described. From the following description, many modifications and other embodiments will be apparent to those skilled in the art. Accordingly, the following description should be taken as exemplary only, and is provided for the purpose of teaching those skilled in the art the best mode of carrying out the present invention. The structural and/or functional details may be substantially altered and recombined without departing from the spirit of the present invention.

Figure 1:
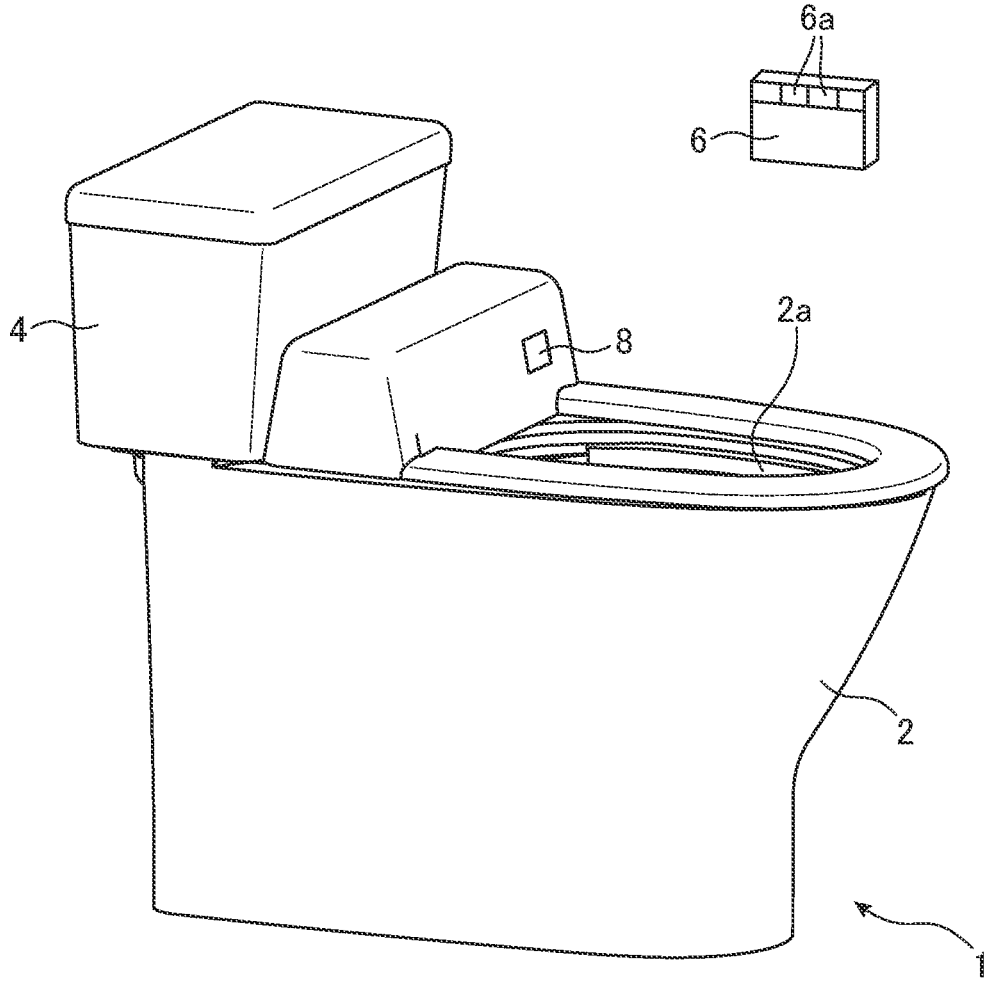
FIG. 1 is a perspective view illustrating the entire flush toilet apparatus provided with a flush water tank apparatus according to a first embodiment of the present invention.
Figure 2:
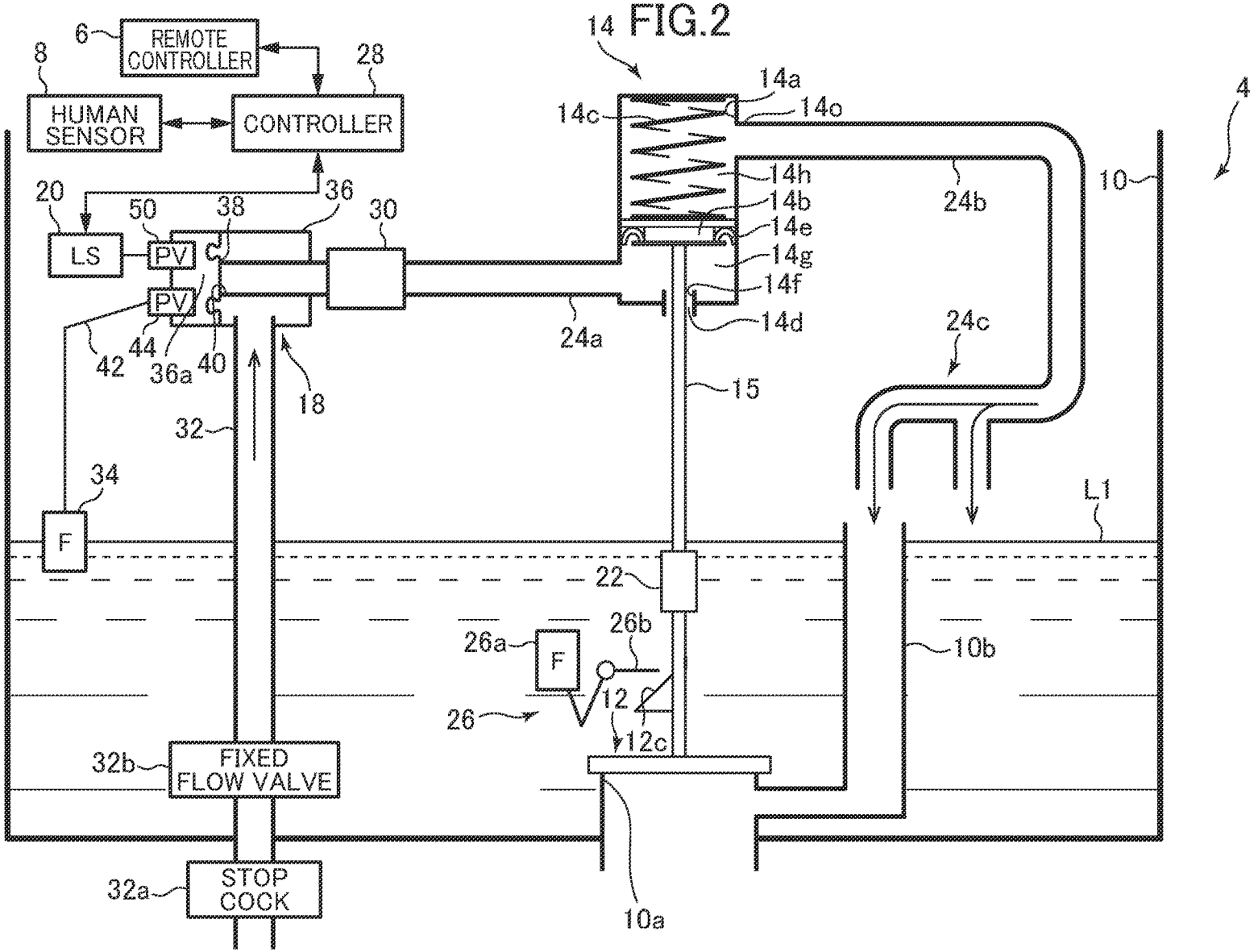
FIG. 2 is a cross sectional view illustrating a schematic configuration of the flush water tank apparatus according to the first embodiment of the present invention.
Figure 3:
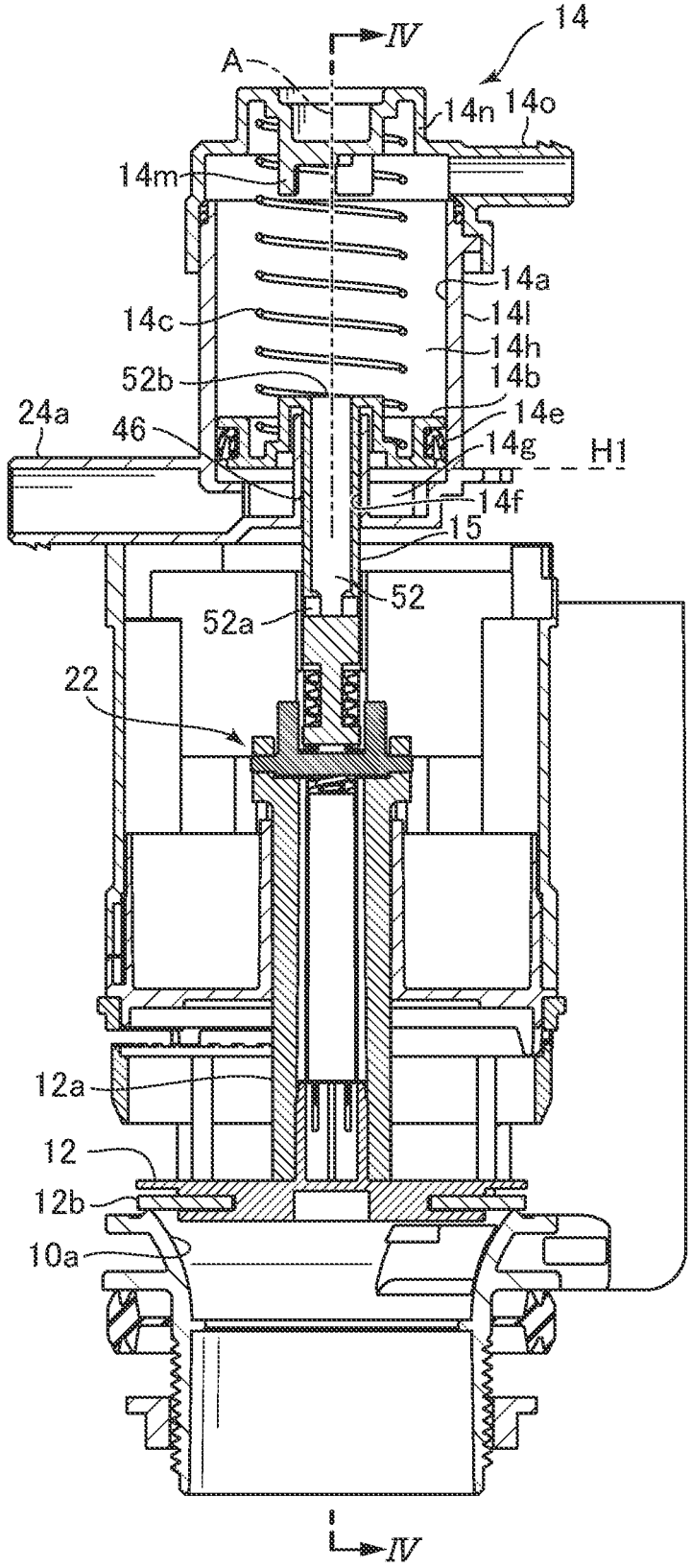
FIG. 3 is a cross sectional view of a hydraulic drive portion and a discharge valve which are provided in the flush water tank apparatus according to the first embodiment of the present invention.
Figure 4:
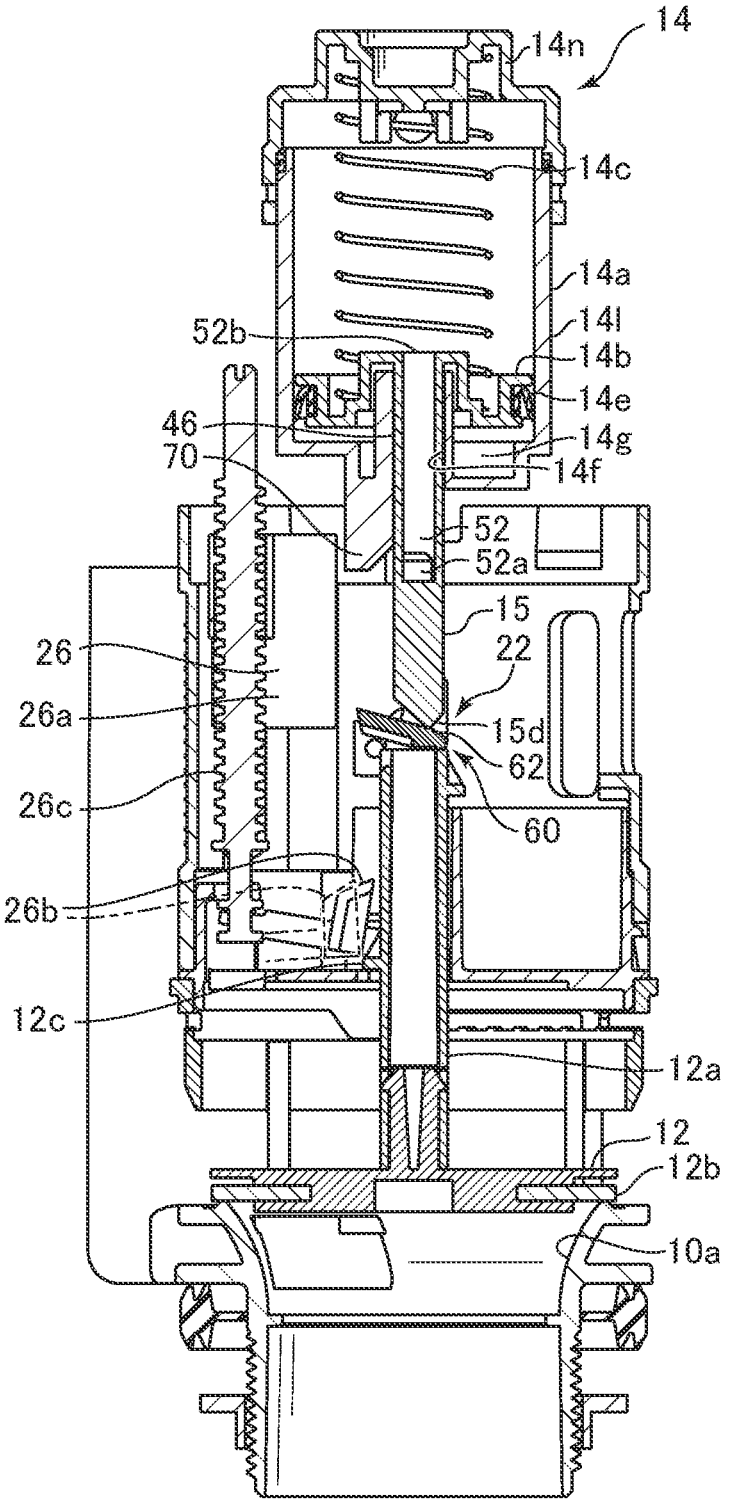
FIG. 4 is a cross sectional view taken along line IV-IV in FIG. 3, in the flush water tank apparatus according to the first embodiment of the present invention.

FIG. 1 is a perspective view illustrating the entire flush toilet apparatus provided with the flush water tank apparatus according to the first embodiment of the present invention. FIG. 2 is a cross sectional view illustrating a schematic configuration of the flush water tank apparatus according to the first embodiment of the present invention. FIG. 3 is a cross sectional view of a hydraulic drive portion and a discharge valve which are provided in the flush water tank apparatus according to the first embodiment of the present invention. FIG. 4 is a cross sectional view taken along line IV-IV in FIG. 3, in the flush water tank apparatus according to the first embodiment of the present invention.

As illustrated in FIG. 1, a flush toilet apparatus 1 according to the first embodiment of the present invention includes a flush toilet main unit 2 which is a flush toilet, and a flush water tank apparatus 4 which is mounted at a rear portion of the flush toilet main unit 2. The flush toilet apparatus 1 of the present embodiment is configured so that washing of a bowl 2*a* of the flush toilet main unit 2 is brought about either by user's operation of a remote controller 6 attached to a wall surface after use, or after an elapse of a predetermined time period after a human sensor 8 which is a human body detecting sensor provided on the toilet seat senses that the user has separated from the toilet seat. The flush water tank apparatus 4 according to the present embodiment is configured to supply flush water to the flush toilet main unit 2 based on a command signal from the remote controller 6 or the human sensor 8, and more specifically, is configured to discharge flush water stored therein to the flush toilet main unit 2, thereby washing the bowl 2*a* with the flush water. In this way, the flush toilet main unit 2 is washed by the flush water supplied from the flush water tank apparatus 4.

Although in the present embodiment, the human sensor 8 is provided in the toilet seat, the present invention is not limited to this form, and the sensor may be provided at any position where a user's sitting on or separation from the seat, approach or departure, or hand swiping action can be sensed. For example, the sensor may be provided in the flush toilet main unit 2 or the flush water tank apparatus 4. The human sensor 8 may be any sensor capable of sensing a user's sitting on or separation from the seat, approach or departure, or hand swiping action. For example, an infrared sensor or a microwave sensor may be used as the human sensor 8.

As illustrated in FIG. 2, the flush water tank apparatus 4 includes a reservoir tank 10 configured to store flush water to be supplied to the flush toilet main unit 2, a discharge valve 12 configured to open and close a water discharge opening 10*a* provided in the reservoir tank 10, and a hydraulic drive portion 14 which is a discharge valve hydraulic drive portion (discharge valve hydraulic drive unit) configured to drive the discharge valve 12 using a water supply pressure of supplied tap water. In addition, the flush water tank apparatus 4 includes, in the reservoir tank 10, a water supply controller 18 configured to control the water supply into the hydraulic drive portion 14 and the reservoir tank 10, and an electromagnetic valve 20 attached to the water supply controller 18.

The reservoir tank 10 is a tank configured to store flush water to be supplied to the flush toilet main unit 2. The water discharge opening 10*a* for discharging the stored flush water to the flush toilet main unit 2 is formed at a bottom portion of the reservoir tank 10. In the reservoir tank 10, an overflow pipe 10*b* is connected on the downstream side of the water discharge opening 10*a*. The overflow pipe 10*b* rises vertically from the vicinity of the water discharge opening 10*a* and extends above a water surface of the flush water stored in the reservoir tank 10. Accordingly, the flush water that has flowed in from an upper end of the overflow pipe 10*b* bypasses the water discharge opening 10*a* and flows out directly to the flush toilet main unit 2.

Next, referring to FIGS. 2 to 4, structures of the hydraulic drive portion and the discharge valve will be described. FIG. 3 is a cross sectional view of the hydraulic drive portion 14 and the discharge valve 12, and FIG. 4 is a cross sectional view that is cut in a direction perpendicular to a cut surface in FIG. 3.

The discharge valve 12 is a direct-acting valve body disposed to open and close the water discharge opening 10*a*, and includes a rod-shaped valve shaft 12*a* and a valve body portion 12*b* attached to a lower end of the rod-shaped valve shaft 12*a*. The discharge valve 12 switches between supply and supply stop of the flush water to the flush toilet main unit 2 by opening and closing the water discharge opening 10*a*. When the discharge valve 12 is pulled up vertically, the water discharge opening 10*a* is opened, and the flush water in the reservoir tank 10 is discharged to the flush toilet main unit 2, whereby the bowl 2*a* is washed.

The hydraulic drive portion 14 is provided above the discharge valve 12, and is configured to drive the discharge valve 12 using a water supply pressure of the flush water supplied from the tap water. Specifically, the hydraulic drive portion 14 includes a cylinder 14*a* into which the flush water supplied from the water supply controller 18 (FIG. 2) via an inflow pipe 24*a* flows, a piston 14*b* that is slidably disposed in the cylinder 14*a*, and a connection portion 14*o* that is provided on a side closer to a distal end portion of the cylinder 14*a* than a second position H2 of the piston 14*b*, extends from the water discharge opening from which the flush water in the cylinder 14*a* flows out and is connected with an outflow pipe 24*b*. A rod 15 which is a drive member is attached to the piston 14*b*. The rod 15 projects from a lower end of the cylinder 14*a* and extends toward the discharge valve 12. Additionally, the rod 15 is disposed to align on the same line as the valve shaft 12*a* rising from a center of the valve body portion 12*b* of the discharge valve 12, and the discharge valve 12 and the rod 15 are disposed coaxially with each other.

The piston 14*b* partitions the inside of the cylinder 14*a* into a pressure chamber 14*g* on the side in front of the piston 14*b* and a back pressure chamber 14*h* on the side behind the piston 14*b*. Additionally, the piston 14*b* is moved from a first position H1 (see FIG. 3) to the second position H2 (see FIG. 15) by the pressure of the flush water that has flowed into the pressure chamber 14*g*.

Additionally, a spring 14*c* is disposed in the interior of the cylinder 14*a*, and biases the piston 14*b* downward. An annular packing 14*e* which is an elastic member is attached to an outer periphery of the piston 14*b*. The packing 14*e* is formed to have an inverted U-shaped cross section so that a lower side is open. Furthermore, the packing 14*e* contacts an inner wall surface of the cylinder 14*a* in an elastically deformed state, so that the watertightness is ensured between the inner wall surface of the cylinder 14*a* and the piston 14*b*. A clutch mechanism 22 is provided in a connection portion between a lower end of the rod 15 and the discharge valve 12. The clutch mechanism 22 enables connection between the rod 15 and the discharge valve 12. The connection between the rod 15 and the discharge valve 12 is released at a predetermined timing.

The cylinder 14*a* is a substantially cylindrical member. A central axis A of the cylinder 14*a* is disposed vertically, and the piston 14*b* is slidably received in the interior of the cylinder 14*a*. The cylinder 14*a* is formed into a tapered shape so that an inner diameter continuously and slightly increases upward from the lower end. The cylinder 14*a* includes a cylindrical first member 14*l* that is open toward an end portion side of the cylinder 14*a*, and a cylindrical second member 14*n* that is connected to the first member 14*l* and forms a lid portion covering an opening of the first member 14*l*. The first member 14*l* is formed into a cylindrical shape and has a substantially circular bottom portion. The second member 14*n* includes a substantially circular ceiling portion. The first member 14*l* and the second member 14*n* are water-tightly connected with each other. As illustrated in FIG. 3, the inflow pipe 24*a* which is a water supply passage to a drive portion is connected to a lower end portion of the first member 14*l* of the cylinder 14*a* so that water that has flowed out from the water supply controller 18 (FIG. 2) flows into the cylinder 14*a*. Therefore, the piston 14*b* in the cylinder 14*a* is pushed up against the biasing force of the spring 14*c* by the water that has flowed into the cylinder 14*a*.

An outflow port is provided in the second member 14*n* at an upper portion of the cylinder 14*a*. The connection portion 14*o* extends from the outflow port of the second member 14*n*. The connection portion 14*o* is provided in a side wall of the second member 14*n*. The outflow pipe 24*b* (see FIG. 2) which is an outflow portion is attached to the connection portion 14*o*, and communicates with the interior of the cylinder 14*a* via the outflow port in a base unit of the connection portion 14*o*. The outflow pipe 24*b* is adapted so that the flush water is made to flow out from the cylinder 14*a*. Accordingly, when the water flows into the cylinder

14*a* from the inflow pipe 24*a* connected to the lower portion of the cylinder 14*a*, the piston 14*b* is pushed up from the lower portion of the cylinder 14*a* which is at the first position H1 (see FIG. 3) to the second position H2 (see FIG. 15) above the first position H1 by the pressure of the water that has flowed into the cylinder 14*a*. Then, the water that has flowed into the cylinder 14*a* flows out from an outflow hole through the outflow pipe 24*b*. That is, the piston 14*b* is moved from the first position H1 to the second position H2 of the cylinder 14*a* by the pressure of the tap water. The outflow pipe 24*b* is provided at a position further closer to a back surface side of the piston 14*b* than the second position H2 of the piston 14*b*, in the cylinder 14*a*.

An attaching structure for attaching the second member 14*n* to the first member 14*l* is formed so that the connection portion 14*o* is directed in a direction selected from a plurality of kinds of directions, for example, in one direction selected from four directions preset for the first member 14*l*. Such an attaching structure enables the second member 14*n* to be locked at a plurality of positions rotated with respect to the first member 14*l*. Accordingly, the second member 14*n* can be attached so that the connection portion 14*o* is directed in a desired direction. Although the first member 14*l* and the second member 14*n* are fitted with each other and connected to each other to achieve such a structure, the first member 14*l* and the second member 14*n* may be connected to each other by welding, bonding, or the like in the case where the second member 14*n* is configured not to rotate with respect to the first member 14*l*.

As illustrated in FIG. 2, an outflow pipe branching portion 24*c* is provided at a distal end portion of the outflow pipe 24*b* extending from the cylinder 14*a*. The outflow pipe 24*b* branching at the outflow pipe branching portion 24*c* is configured so that water flows out from one branch into the reservoir tank 10 and the water flows out from the other branch into the overflow pipe 10*b*. Accordingly, a part of water that has flowed out from the cylinder 14*a* is discharged into the flush toilet main unit 2 through the overflow pipe 10*b*, and the remaining water is stored in the reservoir tank 10. The distal ends (outflow opening portions) of the outflow pipe 24*b* are located above a predetermined water level L1 and above an overflow water level specified by a height of a top portion of the overflow pipe 10*b*. Therefore, the outflow pipe 24*b* is disposed so that air can be always drawn therefrom. Accordingly, as described later, the air is drawn from the outflow pipe 24*b* when the piston 14*b* returns toward the first position H1 from the second position H2 in the cylinder 14*a*, which enables the piston 14*b* to be moved more smoothly.

As illustrated in FIGS. 3 and 4, the rod 15 is a rod-shaped member connected to the piston 14*b*, and extends to project downward from the inside of the cylinder 14*a* through a through hole 14*f* formed in a bottom surface of the cylinder 14*a*. The lower end of the rod 15 is connected to the discharge valve 12 via the clutch mechanism 22. Therefore, when water flows into the cylinder 14*a*, and the piston 14*b* is pushed up by the water, the rod 15 connected to the piston 14*b* lifts the discharge valve 12 upward, whereby the discharge valve 12 is opened.

A gap is provided between the rod 15 projecting from a lower portion of the cylinder 14*a* and an inner wall of the through hole 14*f* in the cylinder 14*a*, and a part of the water that has flowed into the cylinder 14*a* flows out from the gap. The water that has flowed out from the gap flows into the reservoir tank 10. The gap has a flow path with a relatively narrow cross section and a high resistance. Therefore, even in a state where the water flows out from the gap, the pressure inside the cylinder 14*a* is increased by strong flow of the water flowing into the cylinder 14*a* from the inflow pipe 24*a*, which causes the piston 14*b* to be pushed up against the biasing force of the spring 14*c*.

Additionally, the clutch mechanism 22 is provided between the rod 15 and the valve shaft 12*a* of the discharge valve 12. The clutch mechanism 22 connects the discharge valve 12 and the rod 15 of the hydraulic drive portion 14 to pull up the discharge valve 12 by a drive force of the hydraulic drive portion 14. The clutch mechanism 22 is configured to disconnect the valve shaft 12*a* of the discharge valve 12 from the rod 15 when the discharge valve 12 is lifted up to a predetermined position. In a state where the clutch mechanism 22 is disengaged, the discharge valve 12 ceases to move in association with the movement of the piston 14*b* and the rod 15, and falls by gravity while resisting buoyancy.

As illustrated in FIG. 4, a discharge valve float mechanism 26 which is a float mechanism is provided in the vicinity of the valve shaft 12*a* of the discharge valve 12. The discharge valve float mechanism 26 is configured to delay closing of the water discharge opening 10*a* when the discharge valve 12 is falling after the rod 15 is lifted up by a predetermined distance and the discharge valve 12 is disconnected from the rod 15 by the clutch mechanism 22. Specifically, the discharge valve float mechanism 26 includes a float portion 26*a*, an engaging portion 26*b* that moves in association with the float portion 26*a*, and a float shaft 26*c* that connects the float portion 26*a* and the engaging portion 26*b*. The discharge valve float mechanism 26 is operated according to the water level in the reservoir tank 10. The discharge valve float mechanism 26 is configured to be engaged with the discharge valve 12 after the clutch mechanism 22 is disengaged, to switch between a holding attitude of restricting the fall of the discharge valve 12 and a non-holding attitude of not restricting the fall of the discharge valve 12.

On the other hand, an engaging projection 12*c* is provided on the valve shaft 12*a* of the discharge valve 12. The engaging projection 12*c* is located above the engaging portion 26*b* of the discharge valve float mechanism 26 in a state where the discharge valve 12 is lifted up (note that FIG. 4 illustrates a state where the discharge valve 12 has fallen). When the lifted discharge valve 12 is disconnected by the clutch mechanism 22, the discharge valve 12 falls and the engaging projection 12*c* is engaged with the engaging portion 26*b*, thereby stopping the fall of the discharge valve 12. Next, when the float portion 26*a* drops with the lowering of the water level in the reservoir tank 10, and the water level in the reservoir tank 10 is lowered to a predetermined water level, the float portion 26*a* turns the engaging portion 26*b* to a disengagement position indicated by an imaginary line in FIG. 4. When the engaging portion 26*b* is turned to the disengagement position, the engagement between the engaging portion 26*b* and the engaging projection 12*c* is released. When the engagement is released, the discharge valve 12 falls, and is seated on the water discharge opening 10*a* (a state illustrated in FIG. 4). This enables the delay of closing of the discharge valve 12, so that an appropriate amount of flush water can be discharged from the water discharge opening 10*a*.

On the other hand, as illustrated in FIG. 2, a discharge/vacuum break valve 30 is provided in the inflow pipe 24*a* between the water supply controller 18 and the hydraulic drive portion 14.

When the pressure on the water supply controller 18 side in the inflow pipe 24*a* is negative, external air is drawn into the inflow pipe 24*a* by the discharge/vacuum break valve 30, thereby restraining a reverse flow of the water from the hydraulic drive portion 14 side.

Additionally, as illustrated in FIG. 2, the water supply controller 18 is configured to control the water supply to the hydraulic drive portion 14 based on the operation of the electromagnetic valve 20 and control the supply and supply stop of the water to the reservoir tank 10. That is, the water supply controller 18 is connected between a water supply pipe 32 connected to the tap water and the inflow pipe 24*a* connected to the hydraulic drive portion 14, and controls the supply and supply stop of the water supplied from the water supply pipe 32 to the hydraulic drive portion 14 based on a command signal from a controller 28. In the present embodiment, the entire amount of the water that has flowed out from the water supply controller 18 is supplied to the hydraulic drive portion 14 through the inflow pipe 24*a*. Apart of the water supplied to the hydraulic drive portion 14 flows out to the reservoir tank 10 through the gap between the inner wall of the through hole 14*f* in the cylinder 14*a* and the rod 15. Most of the water supplied to the hydraulic drive portion 14 flows out from the cylinder 14*a* through the outflow pipe 24*b*, and branches at the outflow pipe branching portion 24*c* into a part flowing into the reservoir tank 10 and a part flowing into the flush toilet main unit 2 via the overflow pipe 10*b*.

Furthermore, the water supplied from the tap water is supplied to the water supply controller 18 via a stop cock 32*a* disposed outside of the reservoir tank 10 and a fixed flow valve 32*b* disposed on the downstream side of the stop cock 32*a* and in the reservoir tank 10. The stop cock 32*a* is provided to stop the water supply to the flush water tank apparatus 4 at the time of maintenance or the like, and is usually used in a state where the cock is open. The fixed flow valve 32*b* is provided to cause the water supplied from the tap water to flow into the water supply controller 18 at a predetermined flow rate, and is configured to supply the water to the water supply controller 18 at a certain flow rate regardless of the installation environment of the flush toilet apparatus 1.

The electromagnetic valve 20 is attached to the water supply controller 18, and the water supply from the water supply controller 18 to the hydraulic drive portion 14 is controlled based on the operation of the electromagnetic valve 20. Specifically, the controller 28 receives signals from the remote controller 6 and the human sensor 8, and sends the electric signals to the electromagnetic valve 20 to operate the electromagnetic valve 20.

On the other hand, a water supply valve float 34 is also connected to the water supply controller 18, and is configured to set the water level of the water stored in the reservoir tank 10 at the predetermined water level L1. The water supply valve float 34 is disposed in the reservoir tank 10. The water supply valve float 34 is configured to rise with a rise of the water level of the reservoir tank 10, and stop the water supply from the water supply controller 18 to the hydraulic drive portion 14 when the water level rises to the predetermined water level L1.

The water supply controller 18 includes a main body portion 36 to which the water supply pipe 32 and the inflow pipe 24*a* are connected, a main valve body 38 disposed in the main body portion 36, a valve seat 40 on which the main valve body 38 is seated, an arm portion 42 to be turned by the water supply valve float 34, a float-side pilot valve 44 to be moved by the turning of the arm portion 42, and an electromagnetic valve-side pilot valve 50.

The main body portion 36 is a member in which a connection portion of the water supply pipe 32 is provided in the lower portion of the main body portion 36 and a connection portion of the inflow pipe 24*a* is provided in one side of the main body portion 36. The main body portion 36 is configured to have a side surface to which the electromagnetic valve 20 is to be attached, the side surface being opposite to the inflow pipe 24*a*. The valve seat 40 is formed in the interior of the main body portion 36, and is adapted to communicate with the inflow pipe 24*a* connected to the connection portion. Furthermore, the main valve body 38 is disposed in the interior of the main body portion 36 to open and close the valve seat 40. The main valve body 38 is configured so that when the valve is open, the tap water that has flowed in from the water supply pipe 32 flows out to the inflow pipe 24*a* through the valve seat 40.

The main valve body 38 is a diaphragm valve body having a substantially circular disc shape, and is attached to the inside of the main body portion 36 to be able to be seated on and separated from the valve seat 40. Also, in the main body portion 36, a pressure chamber 36*a* is formed on the opposite side of the valve seat 40 with respect to the main valve body 38. That is, the pressure chamber 36*a* is defined by an inner wall surface of the main body portion 36 and the main valve body 38. When the pressure inside the pressure chamber 36*a* is increased, the main valve body 38 is pressed against the valve seat 40 by the pressure and is seated on the valve seat 40.

On the other hand, the electromagnetic valve 20 is attached to the main body portion 36, and is configured to be capable of advancing and retracting the electromagnetic valve-side pilot valve 50. That is, the electromagnetic valve-side pilot valve 50 is configured to open and close a pilot valve port (not illustrated) provided in the pressure chamber 36*a*. Also, the float-side pilot valve 44 is configured to open and close a float-side pilot valve port (not illustrated) provided in the pressure chamber 36*a*.

The water supply valve float 34 is supported by the arm portion 42. The float-side pilot valve 44 is connected to the arm portion 42. The water supply valve float 34 is pushed up upward in a state where the water level in the reservoir tank 10 has risen to the predetermined water level L1, and therefore the float-side pilot valve 44 closes the float-side pilot valve port (not illustrated) of the pressure chamber 36*a*. On the other hand, when the flush water in the reservoir tank 10 is discharged, and the water level in the reservoir tank 10 is lowered, the water supply valve float 34 is lowered downward, and the float-side pilot valve 44 is moved, whereby the float-side pilot valve port is opened.

With this configuration, in a toilet flush standby state in which the water level in the reservoir tank 10 is the predetermined water level L1 and the electromagnetic valve 20 is not energized, both of the pilot valve port (not illustrated) of the main valve body 38 and the float-side pilot valve port (not illustrated) of the main body portion 36 are in a closed state.

The tap water supplied from the water supply pipe 32 flows into the pressure chamber 36*a*. Here, in a state where the electromagnetic valve-side pilot valve 50 closes the pilot valve port (not illustrated) and the float-side pilot valve 44 closes the float-side pilot valve port (not illustrated), the pressure inside the pressure chamber 36*a* is increased by the tap water that has flowed into the pressure chamber 36*a*. When the pressure inside the pressure chamber 36*a* is thus increased, the main valve body 38 is pressed toward the valve seat 40 by the pressure, whereby the valve seat 40 is closed by the main valve body 38.

On the other hand, when the electromagnetic valve 20 is energized and the electromagnetic valve-side pilot valve 50 opens the pilot valve port (not illustrated), the pressure inside the pressure chamber 36*a* is lowered, whereby the main valve body 38 is separated from the valve seat 40 and the valve seat 40 is opened. In a state where the water level in the reservoir tank 10 is lower than the predetermined water level L1, the water supply valve float 34 is lowered, and the float-side pilot valve 44 opens the float-side pilot valve port (not illustrated). Accordingly, the pressure inside the pressure chamber 36*a* is lowered, and the valve seat 40 is opened. In this way, in a state where either the pilot valve port of the main valve body 38 or the float-side pilot valve port is open, the pressure inside the pressure chamber 36*a* is lowered, and the valve seat 40 is opened.

Next, referring now to FIGS. 5 to 9, the clutch mechanism 22 that connects the discharge valve 12 and the rod 15 will be described.

Figure 5:
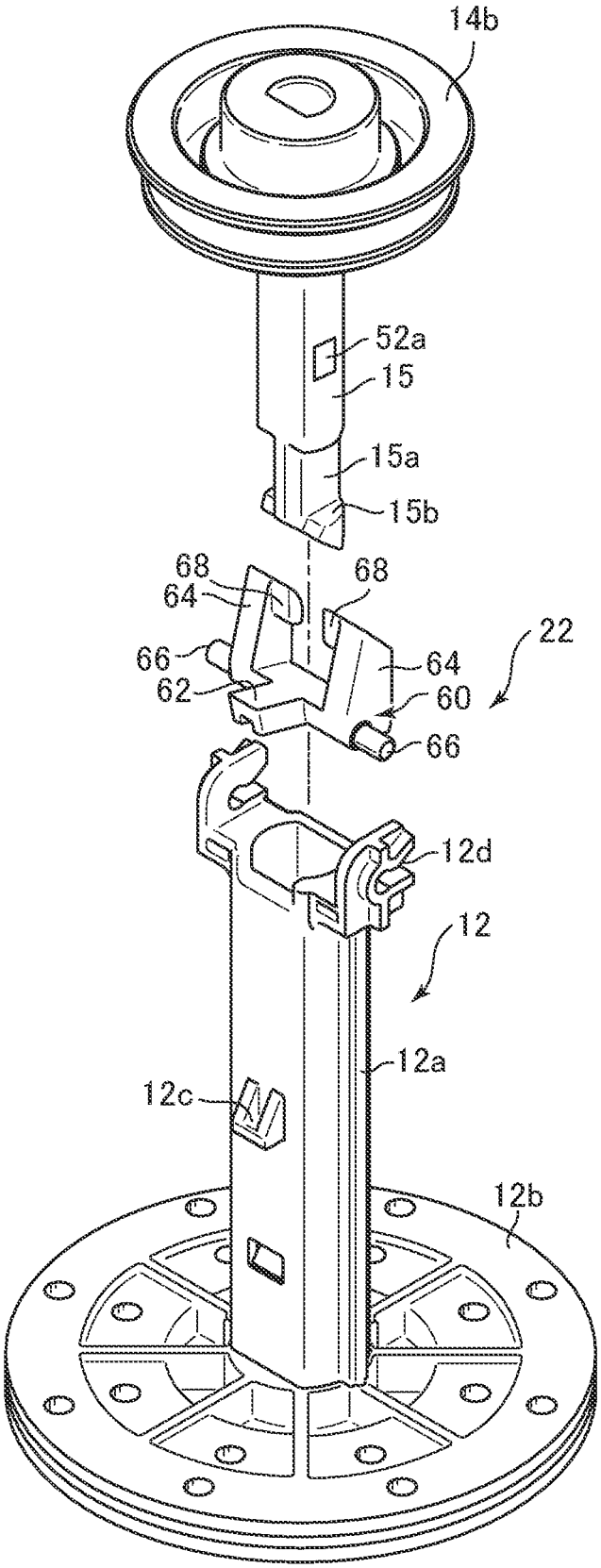
FIG. 5 is an exploded perspective view illustrating components forming a clutch mechanism in an exploded state, the clutch mechanism being provided in the flush water tank apparatus according to the first embodiment of the present invention.
Figure 6:
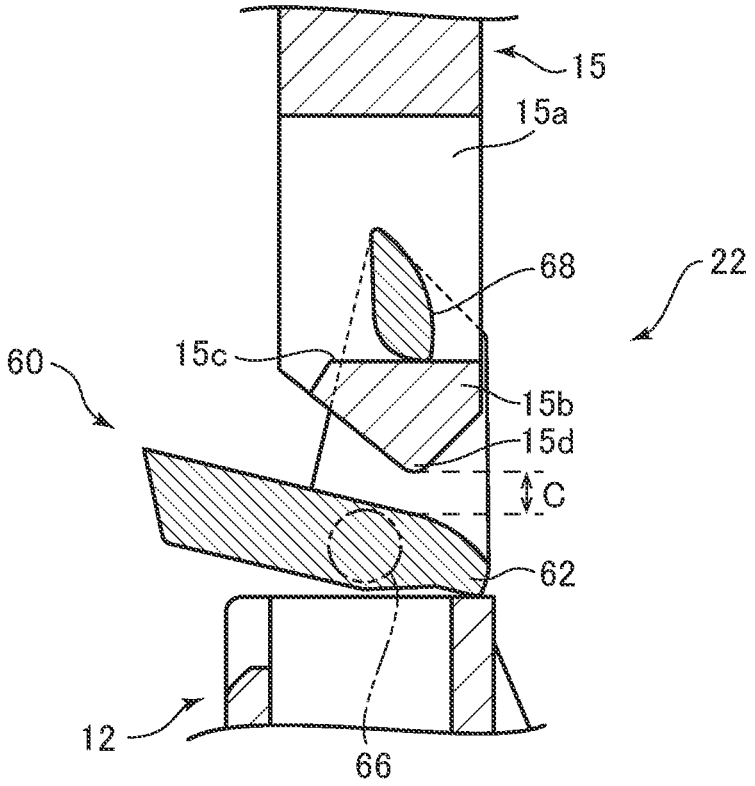
FIG. 6 is a partially enlarged cross sectional view illustrating a state of the clutch mechanism when a discharge valve is in a closed state, in the flush water tank apparatus according to the first embodiment of the present invention.
Figure 7:
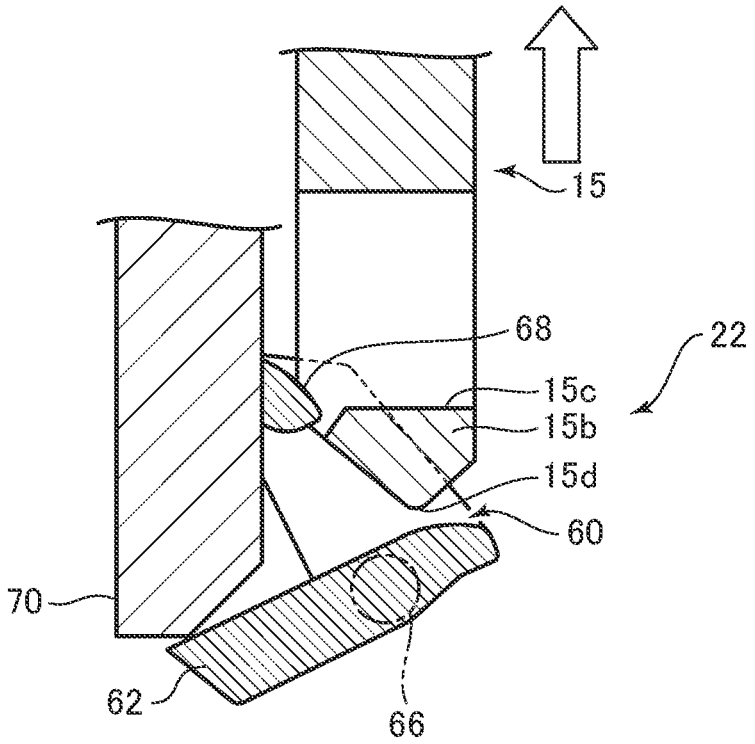
FIG. 7 is a partially enlarged cross sectional view illustrating the state of the clutch mechanism when the engagement is released, in the flush water tank apparatus according to the first embodiment of the present invention.
Figure 8:
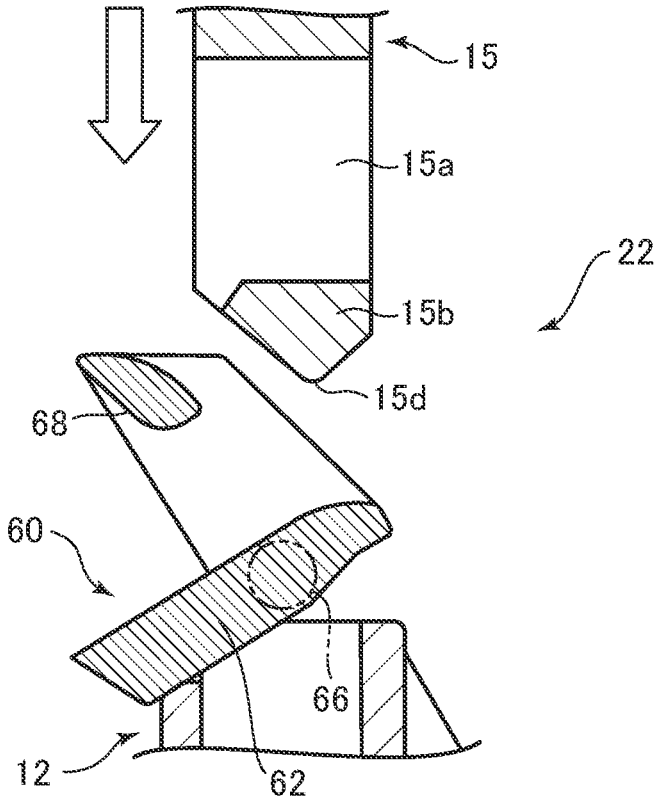
FIG. 8 is a partially enlarged cross sectional view illustrating the state of the clutch mechanism immediately before the engagement, in the flush water tank apparatus according to the first embodiment of the present invention.
Figure 9:
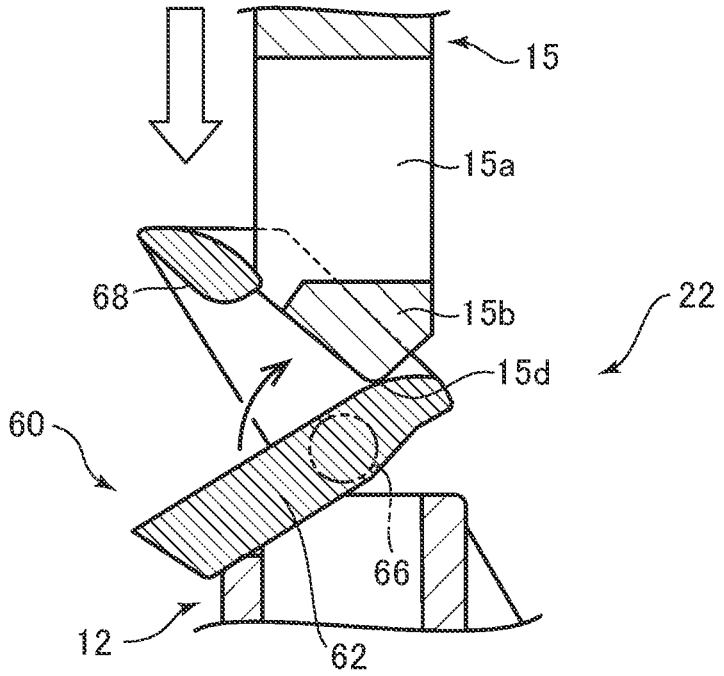
FIG. 9 is a partially enlarged cross sectional view illustrating a state when the clutch mechanism is engaged, in the flush water tank apparatus according to the first embodiment of the present invention.

FIG. 5 is an exploded perspective view illustrating components forming the clutch mechanism 22 in an exploded state. FIG. 6 is a partially enlarged cross sectional view illustrating a state of the clutch mechanism 22 when the discharge valve 12 is in a closed state. FIG. 7 is a partially enlarged cross sectional view illustrating the state of the clutch mechanism 22 when the engagement is released. FIG. 8 is a partially enlarged cross sectional view illustrating the state of the clutch mechanism 22 immediately before the engagement. FIG. 9 is a partially enlarged cross sectional view illustrating a state when the clutch mechanism 22 is engaged.

First, as illustrated in FIG. 5, the clutch mechanism 22 includes a lower end portion of the rod 15, an upper end portion of the valve shaft 12*a* of the discharge valve 12, and a movable member 60 attached to the upper end portion. That is, the rod 15 extends downward from a lower surface of the piston 14*b* of the hydraulic drive portion 14, and the lower end portion of the rod 15 forms a part of the clutch mechanism 22. The movable member 60 is turnably attached to the upper end portion of the valve shaft 12*a*. When the movable member 60 is engaged with or disengaged from the lower end portion of the rod 15, the rod 15 and the discharge valve 12 are connected to each other or disconnected from each other.

A thin thickness portion 15*a* and a pull-up portion 15*b* are formed at the lower end portion of the rod 15, and function as a part of the clutch mechanism 22. On the other hand, a support portion 12*d* is provided at the upper end portion of the valve shaft 12*a* of the discharge valve 12. The support portion 12*d* includes a pair of bearings formed to be laterally open. Both ends of the movable member 60 are turnably attached to the support portion 12*d*.

The thin thickness portion 15*a* at the lower end of the rod 15 is a portion formed to be thinner than the upper portion of the rod 15. The pull-up portion 15*b* of the rod 15 is a portion formed to project horizontally toward both ends from the lower end of the thin thickness portion 15*a*. The pull-up portion 15*b* of the rod 15 and the movable member 60 are engaged with each other to pull up the discharge valve 12.

The movable member 60 includes a base plate 62 extending laterally, a pair of rotary shafts 66 extending outward from both ends of the base plate 62, a pair of arms 64 rising vertically from both side portions of the base plate 62, and an abutting portion 68 extending inward from an upper end of each arm 64. Each rotary shaft 66 of the movable member 60 is received on each support portion 12*d* provided at the upper end portion of the valve shaft 12*a* so that the movable member 60 can be turnably supported.

The base plate 62 is a plate-like portion extending laterally, and is formed to have a T-shape in top plan view. The arms 64 are formed to rise upward from both ends of the T-shaped base plate 62, respectively. The thin thickness portion 15*a* and the pull-up portion 15*b* at the lower end of the rod 15 are located between the pair of arms 64 in a state where the clutch mechanism 22 is engaged. The rotary shafts 66 are formed to project horizontally from both left and right ends of the base plate 62, respectively, and from proximal ends of the arms 64, respectively. The rotary shafts 66 are received on the respective support portions 12*d* of the valve shaft 12*a*.

The abutting portion 68 is formed to project inward from the upper end of each arm 64. The abutting portion 68 is formed to have a teardrop shaped cross section as viewed from a direction parallel to the rotary shaft 66, and is formed to have an arc-shaped curved surface at the lower side thereof. The thin thickness portion 15*a* at the lower end of the rod 15 is located between the abutting portions 68 and both ends of the pull-up portion 15*b* are located below the respective abutting portions 68 in a state where the clutch mechanism 22 is engaged.

Next, referring to FIGS. 6 to 9, the operation of the clutch mechanism 22 will be described.

First, the movable member 60 is in an "engagement position" illustrated in FIG. 6 in a state where the discharge valve 12 is seated on the water discharge opening 10*a* and the clutch mechanism 22 is engaged. In the state where the movable member 60 is disposed at the engagement position, the pull-up portion 15*b* at the lower end of the rod 15 is located directly below the abutting portion 68 of the movable member 60. When the flush water is supplied to the hydraulic drive portion 14 (FIG. 2) and the rod 15 is pulled up upward from the state illustrated in FIG. 6, the discharge valve 12 is pulled up vertically upward by the rod 15. That is, when the rod 15 is pulled up, an upper surface 15*c* of the pull-up portion 15*b* of the rod 15 and a lower end of the abutting portion 68 of the movable member 60 are engaged with each other while the movable member 60 is maintained at the engagement position, whereby the discharge valve 12 is pulled up.

In the state where the discharge valve 12 is seated on the water discharge opening 10*a* as illustrated in FIG. 6, a clearance C is present between an abutted portion 15*d* at a lower end of the pull-up portion 15*b* of the rod 15 and an upper surface of the base plate 62 of the movable member 60. When the rod 15 is pulled up upward from the state illustrated in FIG. 6, the upper surface 15*c* of the pull-up portion 15*b* and the abutting portion 68 are engaged with each other, whereby the discharge valve 12 is pulled up.

When the discharge valve 12 is pulled up together with the rod 15 in the state where the clutch mechanism 22 is engaged, the movable member 60 approaches the bottom surface of the cylinder 14*a* of the hydraulic drive portion 14. When the discharge valve 12 is pulled up to a predetermined position, a distal end of a restricting portion 70 projecting downward from the bottom surface of the cylinder 14*a* contacts the base plate 62 of the movable member 60 as illustrated in FIG. 7. When the base plate 62 contacts the distal end of the restricting portion 70, the movable member 60 is turned around the rotary shaft 66 from the "engagement position" illustrated in FIG. 6 to the "disengagement position" illustrated in FIG. 7. When the movable member 60 is turned to the "disengagement position," the engagement between the pull-up portion 15*b* of the rod 15 and the abutting portion 68 of the movable member 60 is released, and the engagement of the clutch mechanism 22 is released. That is, when the movable member 60 is turned around the rotary shaft 66, the abutting portion 68 provided at the distal end of the arm 64 moves and is released from the pull-up portion 15*b* at the lower end of the rod 15, whereby the engagement of the abutting portion 68 and the pull-up portion 15*b* is released.

When the engagement of the clutch mechanism 22 is released, the discharge valve 12 is disconnected from the rod 15, and the discharge valve 12 falls and is seated on the water discharge opening 10*a*. This makes it possible to stop the flush water from being discharged from the reservoir tank 10 into the flush toilet main unit 2.

Next, when the supply of the flush water to the hydraulic drive portion 14 is stopped, the piston 14*b* and the rod 15 are lowered by the biasing force of the spring 14*c* disposed in the interior of the cylinder 14*a*. When the rod 15 is lowered as illustrated in FIG. 8, the lower end of the rod 15 approaches the movable member 60 attached to the discharge valve 12 that is seated on the water discharge opening 10*a*. In FIG. 8, the center of gravity of the movable member 60 is located on the left side with respect to the center of the rotary shaft 66, and therefore, the movable member 60 is maintained at the "disengagement position" even after the engagement of the clutch mechanism 22 is released in FIG. 7.

When the rod 15 is further lowered, the abutted portion 15*d* of the rod 15 contacts the base plate 62 of the movable member 60 as illustrated in FIG. 9, and the movable member 60 is turned in a clockwise direction in FIG. 9. Hereby, the movable member 60 at the "disengagement position" is turned to the "engagement position" illustrated in FIG. 6 to return to the state illustrated in FIG. 6, whereby the clutch mechanism 22 is engaged.

Next, referring now to FIGS. 10 and 11, the discharge/vacuum break valve 30 connected between the water supply controller 18 and the hydraulic drive portion 14 will be described.

Figure 10:
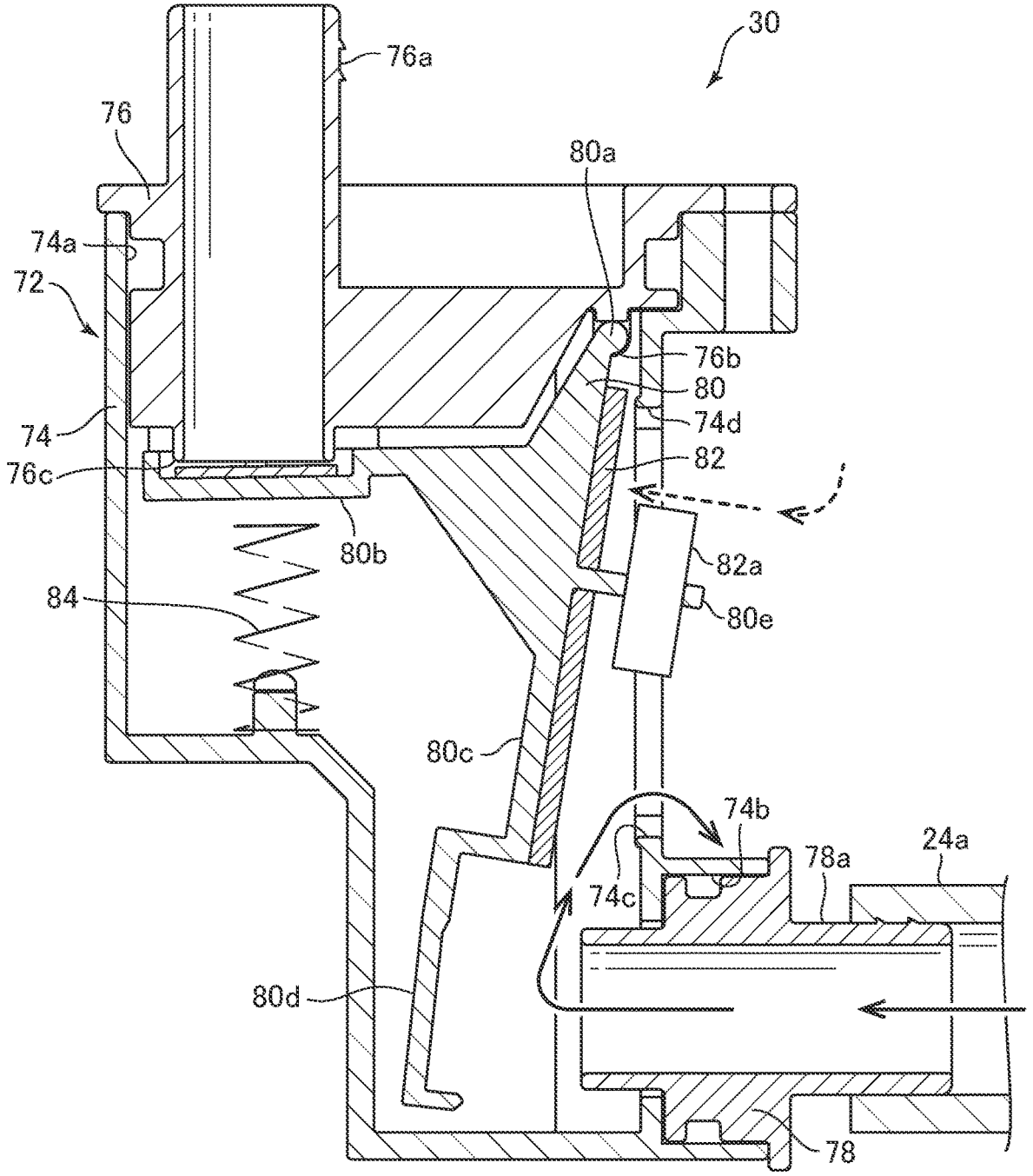
FIG. 10 is a cross-sectional view of a discharge/vacuum break valve in a state where the water is not supplied from a water supply controller, the discharge/vacuum break valve being provided in the flush water tank apparatus according to the first embodiment of the present invention.

FIG. 10 is a cross-sectional view of the discharge/vacuum break valve 30 in a state where the water is not supplied from the water supply controller 18. FIG. 11 is a cross-sectional view of the discharge/vacuum break valve 30 in a state where the water is supplied from the water supply controller 18.

Figure 11:
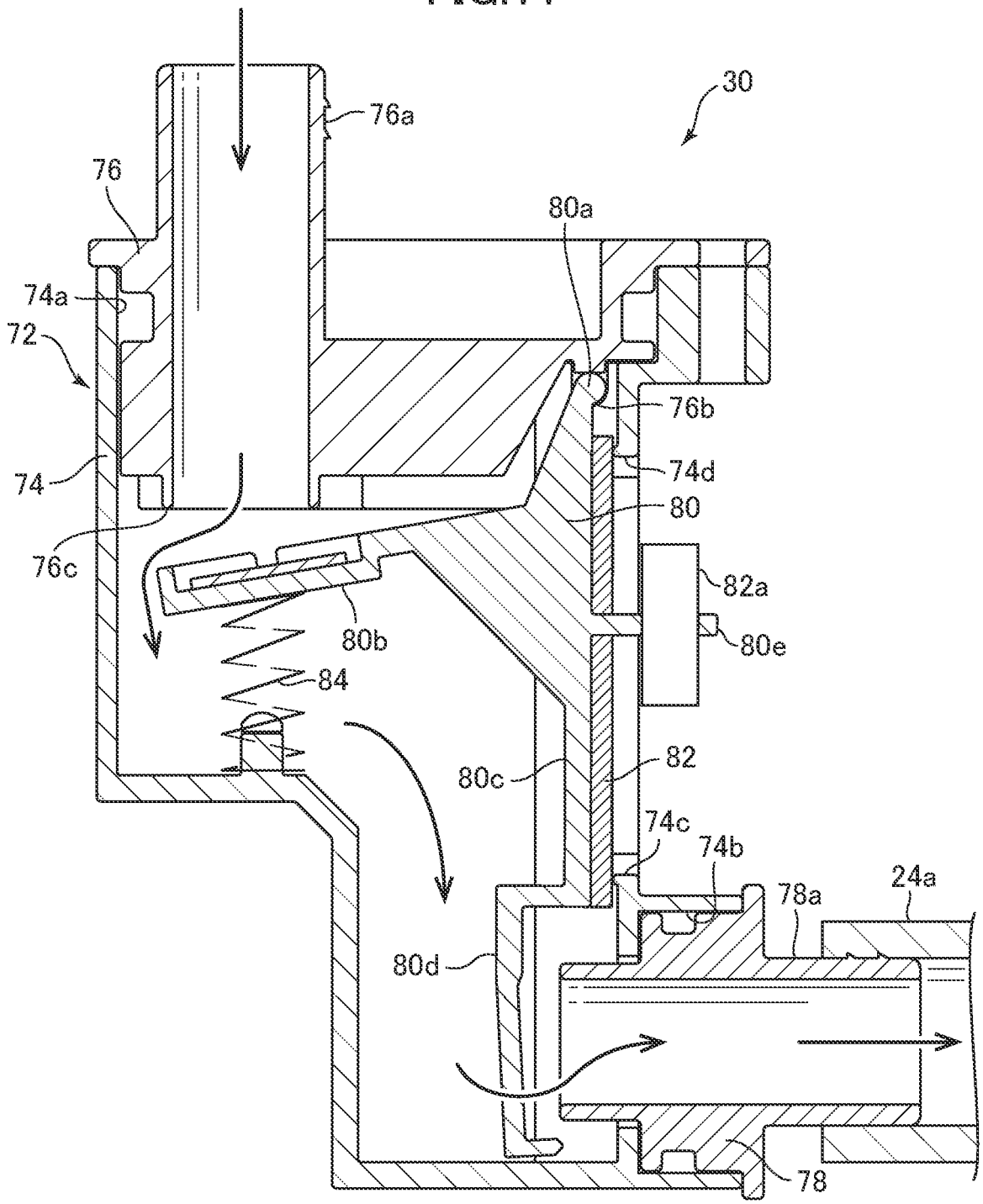
FIG. 11 is a cross-sectional view of the discharge/vacuum break valve in a state where the water is supplied from the water supply controller, the discharge/vacuum break valve being provided in the flush water tank apparatus according to the first embodiment of the present invention.

As illustrated in FIGS. 10 and 11, the discharge/vacuum break valve 30 includes a valve body case 72, a flap valve body 80, and a packing 82. The valve body case 72 includes a box-shaped main body portion 74, an inflow pipe connection member 76 attached to an upper surface of the main body portion 74, and an outflow pipe connection member 78 attached to a lower side surface of the main body portion 74.

The main body portion 74 of the valve body case 72 is formed into a substantially rectangular parallelepiped box shape in which one of lower side corners is cut out. The main body portion 74 has an opening portion in the upper surface thereof, and the inflow pipe connection member 76 is attached thereto to close the opening portion 74*a*. An attaching portion 74*b* for the outflow pipe connection member 78 is provided on the side on which the corner is not cut out, in the lower side surface of the main body portion 74, and the outflow pipe connection member 78 is attached to the attaching portion 74*b*. Additionally, an air intake/water discharge opening 74*c* is provided in a side surface of the main body portion 74 and on an upper side of the attaching portion 74*b*. The air intake/water discharge opening 74*c* is an opening having a longitudinal rectangular shape and directed toward a substantially vertical direction. In a state where the flap valve body 80 is open, exterior air is drawn via the air intake/water discharge opening 74*c*, and the water that has flowed back from the inflow pipe 24*a* flows out from the air intake/water discharge opening 74*c*, and is discharged into the reservoir tank 10.

In the inflow pipe connection member 76, a water flow pipe attaching portion 76*a* is provided to project upward. A water flow pipe extending from the water supply controller 18 (FIG. 2) is connected to the water flow pipe attaching portion 76*a*. Therefore, the water that has flowed out from the water supply controller 18 flows vertically downward into the valve body case 72 from the water flow pipe attaching portion 76*a* provided above the discharge/vacuum break valve 30.

In the outflow pipe connection member 78, a water flow pipe attaching portion 78*a* is provided to project horizontally. The inflow pipe 24*a* is connected to the water flow pipe attaching portion 78*a*. Therefore, the water that has been supplied from the water supply controller 18 and has flowed into the valve body case 72 flows out from the discharge/vacuum break valve 30 through the water flow pipe attaching portion 78*a*, and is supplied to the hydraulic drive portion 14 via the inflow pipe 24*a*.

The flap valve body 80 is a substantially L-shaped member that is turnably attached in the valve body case 72, and is turned between the state illustrated in FIG. 10 and the state illustrated in FIG. 11. A support shaft 80*a* extending horizontally is formed in the vicinity of an intersection of the L-shape of the flap valve body 80, and the support shaft 80*a* is turnably supported on a bearing portion 76*b* provided in the inflow pipe connection member 76. Additionally, the flap valve body 80 is provided with an arm portion extending laterally, and a supply water receiving portion 80*b* is provided at a distal end of the arm portion. The supply water receiving portion 80*b* is disposed below the water flow pipe attaching portion 76*a* to cover the water flow pipe attaching portion 76*a*. Therefore, when the water flows in via the water flow pipe attaching portion 76*a*, the supply water receiving portion 80*b* of the flap valve body 80 is pushed downward, and the flap valve body 80 is turned from the state illustrated in FIG. 10 to the state illustrated in FIG. 11.

Furthermore, the flap valve body 80 includes a valve plate portion 80*c* extending downward from the support shaft 80*a*, and a discharge water receiving portion 80*d* provided below the valve plate portion 80*c*. The valve plate portion 80*c* is disposed to face the air intake/water discharge opening 74*c* provided in the side surface of the main body portion 74, and is configured to cover the air intake/water discharge opening 74*c* when the flap valve body 80 is turned to the state illustrated in FIG. 11. A thin plate-shaped packing 82 is attached to a surface of the valve plate portion 80*c*, the surface being on the side facing the air intake/water discharge opening 74*c*. When the flap valve body 80 is turned to the state illustrated in FIG. 11, a gap between the valve plate portion 80*c* and the air intake/water discharge opening 74*c* is sealed.

The discharge water receiving portion 80*d* is formed below the valve plate portion 80*c*, and is disposed to face the water flow pipe attaching portion 78*a* of the outflow pipe connection member 78. Therefore, when the water flows back from the inflow pipe 24*a* to the water flow pipe attaching portion 78*a*, the discharge water receiving portion 80*d* is pushed, and is turned from the state illustrated in FIG. 11 to the state illustrated in FIG. 10. The water that has flowed back from the water flow pipe attaching portion 78*a* flows out through the air intake/water discharge opening 74*c*, and is discharged into the reservoir tank 10.

Additionally, in the valve plate portion 80*c*, an attaching shaft 80*e* is provided to project from the air intake/water discharge opening 74*c*, and a weight 82*a* is attached to a distal end portion of the attaching shaft 80*e*. When the weight 82*a* is attached, the center of gravity of the entire flap valve body 80 is located on a side (the right side in FIGS. 10 and 11) closer to the air intake/water discharge opening 74*c* than the support shaft 80*a*. As a result, the flap valve body 80 is turned to a position illustrated in FIG. 10 in a state where a moment of force for turning the flap valve body 80 in the clockwise direction in FIG. 11 around the support shaft 80*a* is applied and no static pressure and dynamic pressure of the water are applied.

A coil spring 84 is attached to a bottom surface of a cutout portion of the main body portion 74 to be directed vertically upward. An upper end of the coil spring 84 is located below the supply water receiving portion 80*b* of the flap valve body 80. As illustrated in FIG. 11, the upper end of the coil spring 84 contacts the supply water receiving portion 80*b* in a state where the air intake/water discharge opening 74*c* is closed by the valve plate portion 80*c*, and the flap valve body 80 is biased in a direction of turning in the clockwise direction. On the other hand, in a state where the flap valve body 80 is turned to a position illustrated in FIG. 10, the upper end of the coil spring 84 does not contact the supply water receiving portion 80*b* and the biasing force by the coil spring 84 is not applied.

Next, referring to FIG. 3, FIG. 15, and the like, a communication mechanism will be described.

The hydraulic drive portion 14 further includes a communication mechanism 46 for establishing fluid communication between the pressure chamber 14*g* and the outflow pipe 24*b* after the clutch mechanism 22 is disengaged.

The communication mechanism 46 forms a piston inner flow path 52 for establishing communication between the pressure chamber 14*g* and a back pressure chamber 14*h* according to a position of the piston 14*b* to thereby establish the communication between the pressure chamber 14*g* and the outflow pipe 24*b* via the piston inner flow path 52 and the back pressure chamber 14*h*.

The piston inner flow path 52 is formed into a pipe shape on the inner side of an annular structure of the rod 15, and forms a cylindrical space. The piston inner flow path 52 extends from an inlet portion 52*a* formed on the clutch mechanism 22 side of the rod 15 to an exit portion 52*b* formed to open on the back pressure chamber 14*h* side of the piston 14*b*. The inlet portion 52*a* is formed in a side wall of the rod 15 and forms an opening penetrating from outside of the rod 15 to the piston inner flow path 52 in the interior of the rod 15. The exit portion 52*b* forms an opening that opens in an axial direction of the rod 15, at an end portion on a distal side of the piston inner flow path 52. The exit portion 52*b* is formed in the vicinity of the back pressure chamber side of the piston 14*b*.

The inlet portion 52*a* is formed on the pressure chamber 14*g* side of the piston 14*b* and at a position away from the piston 14*b* by a predetermined distance. For example, a length from the inlet portion 52*a* to the exit portion 52*b* is shorter than a full length of the interior of the cylinder 14*a*, and for example, corresponds to 50 to 90 percent of the full length. Accordingly, when the piston 14*b* is located at the first position H1, the inlet portion 52*a* away from the piston 14*b* (the exit portion 52*b*) by the predetermined distance is located outside of the cylinder 14*a* and the inlet portion 52*a* is positioned to open into the reservoir tank 10. Therefore, the piston inner flow path 52 for establishing the communication between the pressure chamber 14*g* and the back pressure chamber 14*h* is in a closed state and in a state of not being formed.

Figure 13:
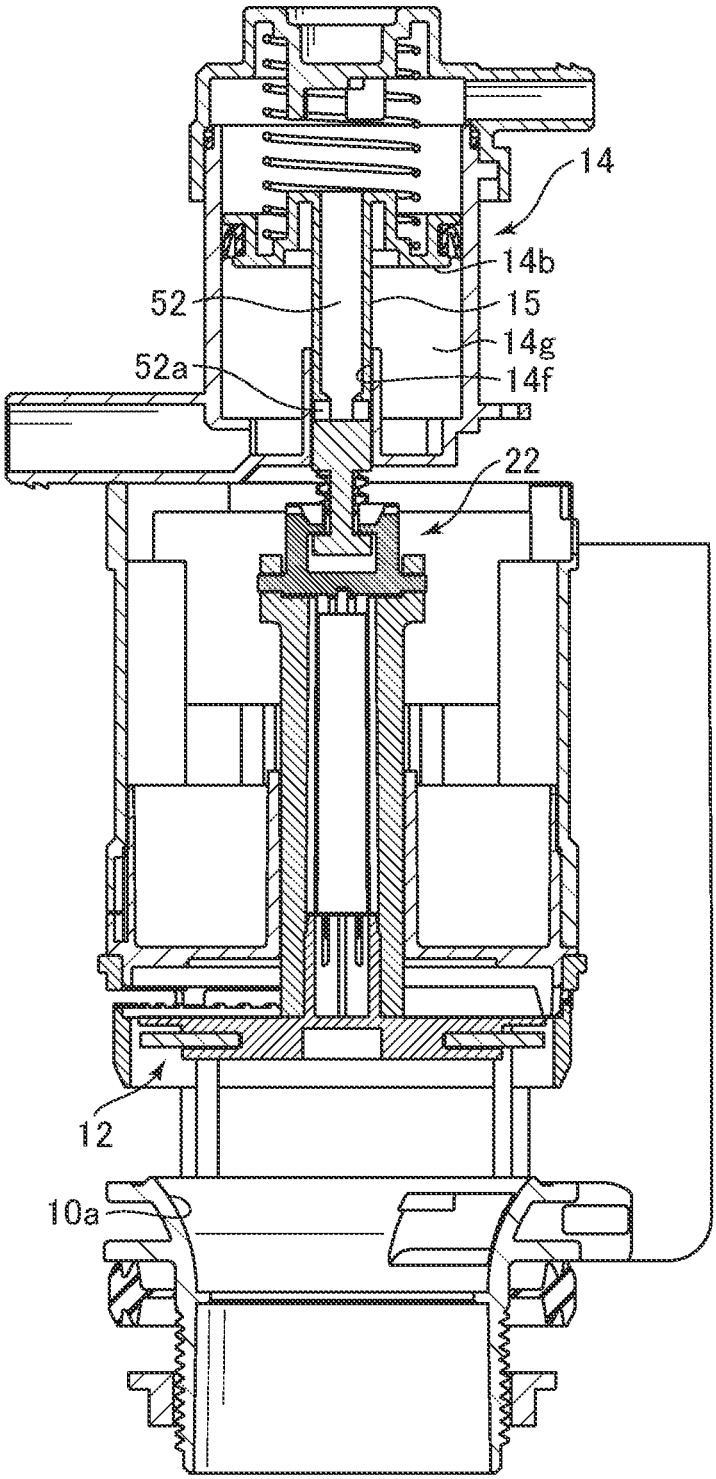
FIG. 13 is a partially enlarged cross sectional view illustrating a state where the piston is rising in the hydraulic drive portion, in the flush water tank apparatus according to the first embodiment of the present invention.
Figure 14:
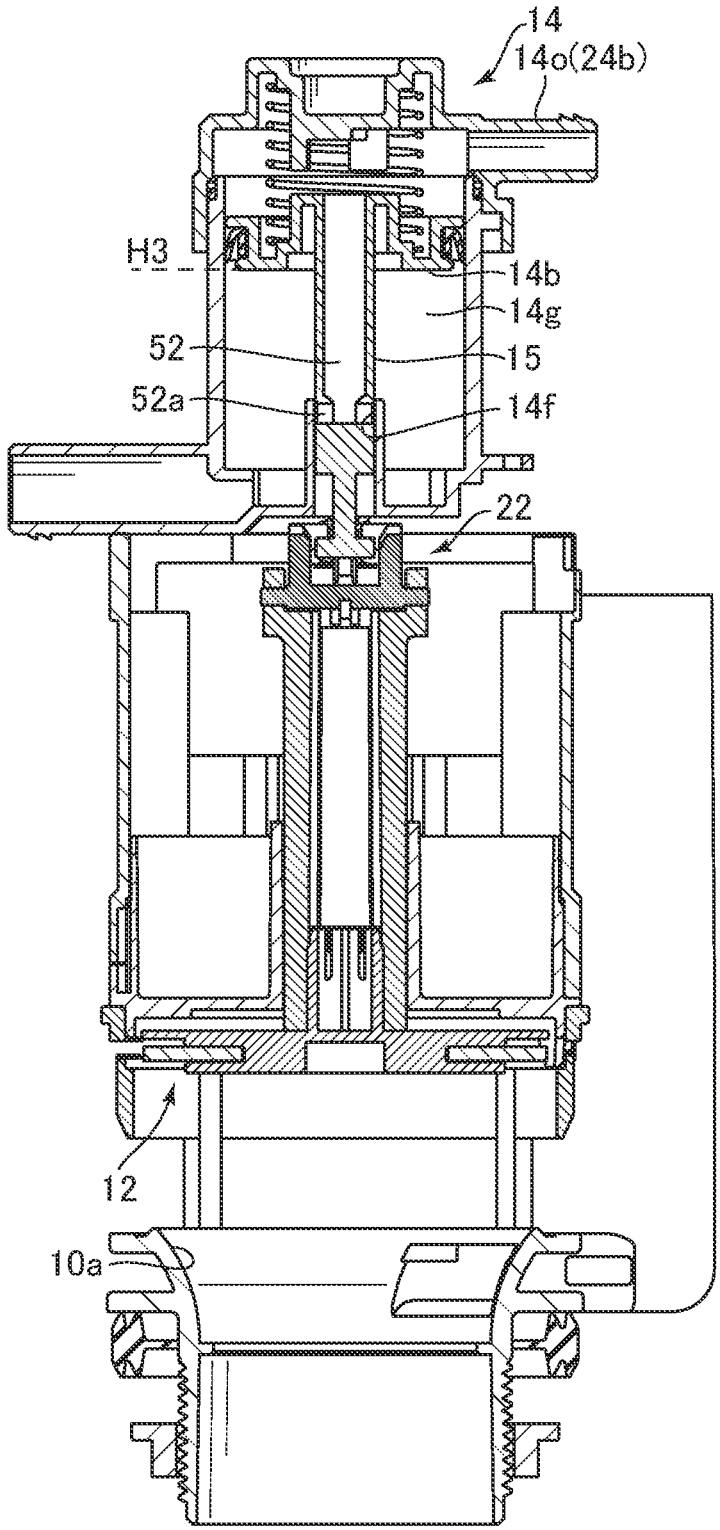
FIG. 14 is a partially enlarged cross sectional view illustrating a state immediately before the clutch mechanism is disengaged, in the flush water tank apparatus according to the first embodiment of the present invention.

As illustrated in FIGS. 3, 13, and 14, since the inlet portion 52*a* is located at a position facing an inner wall of the through hole 14*f* in the cylinder 14*a* when the piston 14*b* is moving from the first position H1 to the second position H2, the inlet portion 52*a* is in a nearly closed state even when a small gap is present between the inlet portion 52*a* and the inner wall of the through hole 14*f*, so that the piston inner flow path 52 for establishing the communication between the pressure chamber 14*g* and the back pressure chamber 14*h* is in the state of not being formed (in the closed state). As illustrated in FIG. 15, when the piston 14*b* is located at the second position H2, the inlet portion 52*a* away from the piston 14*b* (the exit portion 52*b*) by the predetermined distance is positioned to open to the pressure chamber 14*g* in the cylinder 14*a*. Therefore, when the piston 14*b* is located at the second position H2, the communication mechanism 46 forms the piston inner flow path 52 for establishing the communication between the pressure chamber 14*g* and the back pressure chamber 14*h* to thereby establish the communication between the pressure chamber 14*g* and the outflow pipe 24*b* via the piston inner flow path 52 and the back pressure chamber 14*h*. On the other hand, when the piston 14*b* is located at the first position H1, the communication mechanism 46 creates the state where the piston inner flow path 52 for establishing the communication between the pressure chamber 14*g* and the back pressure chamber 14*h* is not formed (is closed), and the piston inner flow path 52 establishes the communication between the back pressure chamber 14*h* and the interior of the reservoir tank 10 outside of the cylinder 14*a*. Additionally, when the piston 14*b* is located at a position between the first position H1 and the second position H2, the communication mechanism 46 creates the state where the piston inner flow path 52 for establishing the communication between the pressure chamber 14*g* and the back pressure chamber 14*h* is not formed (is closed), and the piston inner flow path 52 does not sufficiently establish the communication between the back pressure chamber 14*h* and the interior of the reservoir tank 10 outside of the cylinder 14*a*. The communication mechanism 46 has a switching function for switching between the communicated state and the uncommunicated state.

Figure 12:
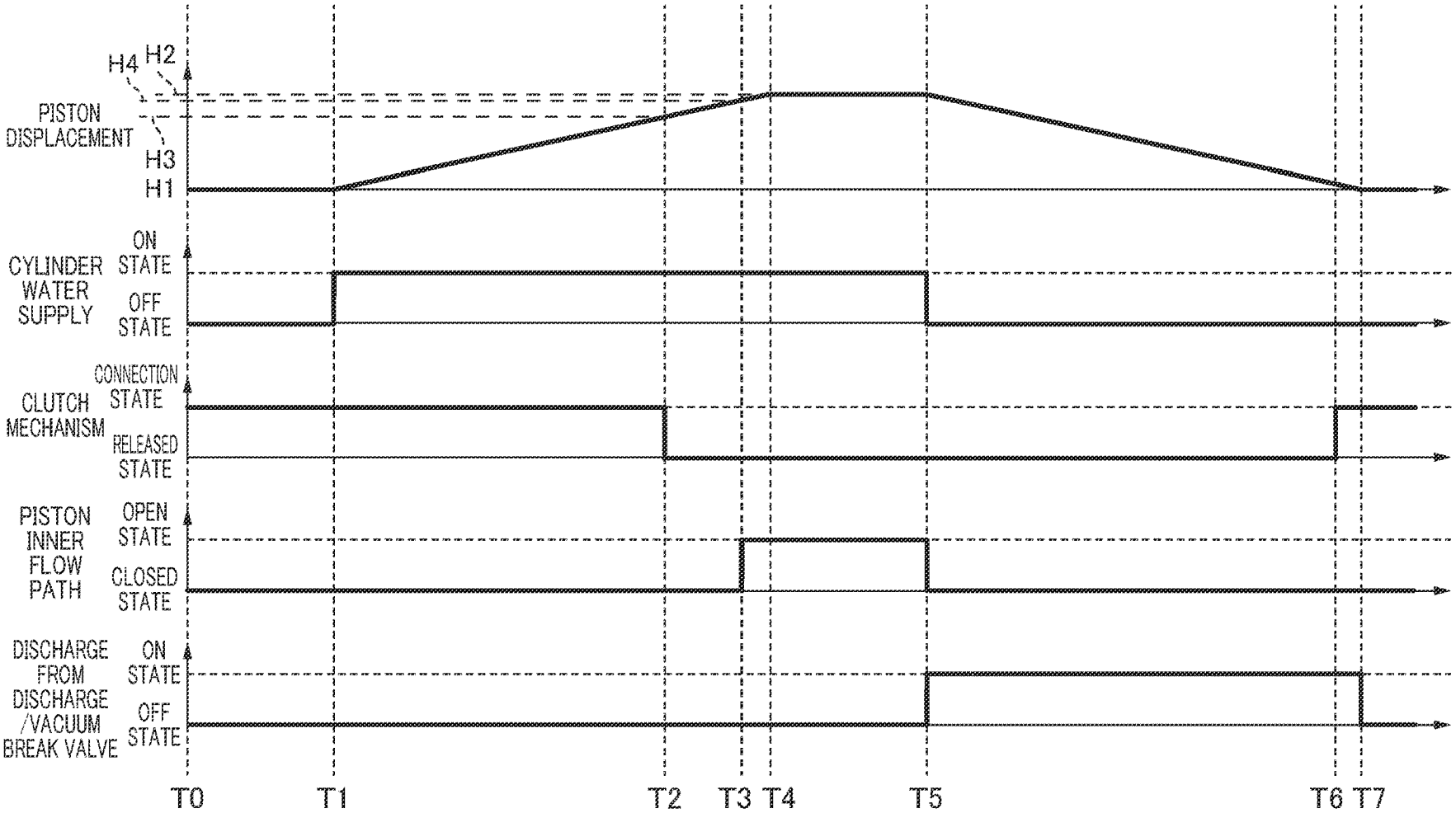
FIG. 12 is a timing chart showing temporal changes in displacement and height position of a piston, a state of cylinder water supply, a state of the clutch mechanism, a state of a piston inner flow path, and a state of discharge from the discharge/vacuum break valve, in the flush water tank apparatus according to the first embodiment of the present invention.

Next, referring to FIG. 2, FIG. 12, and the like, a sequence of flush operation of the flush water tank apparatus 4 according to the first embodiment of the present invention and the flush toilet apparatus 1 provided with the same will be described.

First, in the toilet flush standby state (time T0) illustrated in FIG. 2, the water level in the reservoir tank 10 is the predetermined water level L1 (full water level). In this state, both of the electromagnetic valve-side pilot valve 50 and the float-side pilot valve 44 of the water supply controller 18 (FIG. 2) are in the closed state, and the valve seat 40 is closed by the main valve body 38. Accordingly, the water supply from the water supply controller 18 to the hydraulic drive portion 14 is stopped (OFF state). As illustrated in FIG. 3, in the standby state, the piston 14*b* of the hydraulic drive portion 14 is located at the first position H1 in the cylinder 14*a*. The first position H1 is a lower limit position in the movable range of the piston 14*b*. The piston 14*b* is stopped in the cylinder 14*a*. At this time, the piston 14*b* is located above the predetermined water level L1 which is the full water level of the reservoir tank 10. The rod 15 and the discharge valve 12 are stopped at the lowest position, and the clutch mechanism 22 is in an engaged state. The engaged state includes a state where the clutch mechanism 22 nearly connects the rod 15 and the discharge valve 12, that is, a state where immediately after the pulling-up of the rod 15 is started, the rod 15 and the discharge valve 12 are engaged with each other even when a small gap is present between the rod 15 and the discharge valve 12, to thereby pull the discharge valve 12. Since the piston 14*b* is located at the first position H1 and the inlet portion 52*a* is located outside of the cylinder 14*a* and inside of the reservoir tank 10, the piston inner flow path 52 formed by the communication mechanism 46 is in the closed state (the state where the communication between the pressure chamber 14*g* and the back pressure chamber 14*h* is not established). The piston inner flow path 52 establishes the communication between the back pressure chamber 14*h* and the interior of the reservoir tank 10 outside of the cylinder 14*a*, but in the standby state, the flush water is not present in the back pressure chamber 14*h* side, and therefore, no water is discharged via the piston inner flow path 52. Additionally, the water that has flowed back from the inflow pipe 24*a* is not discharged from the discharge/vacuum break valve 30 into the reservoir tank 10 (OFF state).

Next, at a time T1, when the user presses a flush button in the remote controller 6, the remote controller 6 transmits a command signal for flushing the toilet to the controller 28. In the flush toilet apparatus 1 of the present embodiment, after an elapse of a predetermined time period after a user's separation from the seat is detected by the human sensor 8, the command signal for flushing the toilet can be transmitted to the controller 28 even without the flush button in the remote controller 6 being pressed.

When receiving the command signal for flushing the toilet, the controller 28 operates the electromagnetic valve 20 (FIG. 2), and separates the electromagnetic valve-side pilot valve 50 from the pilot valve port. This reduces the pressure inside the pressure chamber 36*a*, the main valve body 38 is separated from the valve seat 40, and the main valve body 38 is opened. When the water supply controller 18 opens the valve, the flush water that has flowed in from the water supply pipe 32 is supplied to the hydraulic drive portion 14 via the water supply controller 18. Hereby, as illustrated in FIG. 13, the piston 14*b* of the hydraulic drive portion 14 is pushed up, the discharge valve 12 is pulled up via the rod 15, and the flush water in the reservoir tank 10 is discharged from the water discharge opening 10*a* to the flush toilet main unit 2. That is, the discharge valve 12 is driven by a drive force of the hydraulic drive portion 14 based on the water supply pressure of tap water supplied via the water supply pipe 32, and is opened. When the discharge valve 12 is opened, the flush water (tap water) stored in the reservoir tank 10 is discharged to the bowl 2*a* of the flush toilet main unit 2 through the water discharge opening 10*a*, whereby the bowl 2*a* is washed.

When the flush water in the reservoir tank 10 is discharged, the water level in the reservoir tank 10 becomes lower than the predetermined water level L1, and therefore the water supply valve float 34 is lowered. Hereby, the arm portion 42 (see FIG. 2) is turned, and the float-side pilot valve 44 is opened. In a state where the float-side pilot valve port (not illustrated) is open, the pressure inside the pressure chamber 36*a* is not increased even when the electromagnetic valve-side pilot valve 50 is closed, and therefore the open state of the main valve body 38 can be maintained. Therefore, when the water level in the reservoir tank 10 is lowered after an elapse of the predetermined time period after the controller 28 energizes the electromagnetic valve 20 to open the main valve body 38, the energization of the electromagnetic valve 20 is stopped. Hereby, the electromagnetic valve-side pilot valve 50 is closed. However, since the float-side pilot valve port is open, the main valve body 38 remains separated from the valve seat 40. That is, the controller 28 can open the main valve body 38 for a long time only by energizing the electromagnetic valve 20 for a short time.

At the time T1, the water supply from the water supply controller 18 to the hydraulic drive portion 14 is started (ON state), and then the flow of the flush water into the pressure chamber 14*g* of the cylinder 14*a* is started. As illustrated in FIG. 13, the flush water that has flowed into the pressure chamber 14*g* of the cylinder 14*a* causes the piston 14*b* to start to rise from the first position H1 against the biasing force of the spring 14*c*. When the rise of the piston 14*b* is started, the rod 15 rises together with the piston 14*b*. Since the clutch mechanism 22 is in the engaged state, the rod 15 and the discharge valve 12 are engaged with each other immediately after the pulling-up of the rod 15 is started, and the discharge valve 12 is pulled up. Since the inlet portion 52*a* is still located inside of the through hole 14*f*, the piston inner flow path 52 is in the closed state. Additionally, the water that has flowed back from the inflow pipe 24*a* is not discharged from the discharge/vacuum break valve 30 into the reservoir tank 10 (OFF state).

At a time T2, when the piston 14*b* is pushed up, and accordingly, the rod 15 and the discharge valve 12 are pulled up to a predetermined position (see FIGS. 7 and 14), the clutch mechanism 22 disconnects the discharge valve 12 from the rod 15. A predetermined height position of the piston 14*b* when the clutch mechanism 22 is disengaged is referred to as a third position H3. The third position H3 is a height position lower than the second position H2. The restricting portion 70 projecting downward from the cylinder 14*a* turns the movable member 60 to the "disengagement position," and the engagement between the pull-up portion 15*b* of the rod 15 and the abutting portions 68 of the movable member 60 is released. Hereby, the rod 15 remains pushed up upward together with the piston 14*b*, while the discharge valve 12 falls by its own weight. However, the engaging projection 12*c* (see FIG. 5) of the disconnected discharge valve 12 is engaged with the engaging portion 26*b* (see FIG. 2) of the discharge valve float mechanism 26, thereby stopping the fall of the discharge valve 12. Hereby, the water discharge opening 10*a* of the reservoir tank 10 remains open, and the water discharge from the reservoir tank 10 is continued.

Here, when the water level in the reservoir tank 10 is lowered to a second predetermined water level that is lower than the predetermined water level L1, the float portion 26*a* (see FIG. 4) of the discharge valve float mechanism 26 is lowered, which causes the engaging portion 26*b* to move to the disengagement position indicated by an imaginary line in FIG. 4. Hereby, the engagement between the engaging projection 12*c* of the discharge valve 12 and the engaging portion 26*b* is released, and the discharge valve 12 starts to be lowered again. Then, the discharge valve 12 closes the water discharge opening 10*a* of the reservoir tank 10 to stop the discharge of the flush water to the flush toilet main unit 2. Since the valve seat 40 in the water supply controller 18 is in the open state even after the water discharge opening 10*a* is closed, the water supplied from the water supply pipe 32 flows into the hydraulic drive portion 14, and the water that has flowed out from the hydraulic drive portion 14 flows into the reservoir tank 10 through the outflow pipe 24*b*, whereby the water level in the reservoir tank 10 rises.

The water supply of the flush water into the pressure chamber 14*g* is continued, and the piston 14*b* and the rod 15 continuously rise even after the clutch mechanism 22 is disengaged. Since the inlet portion 52*a* is located at the position facing the inner wall of the through hole 14*f* in the cylinder 14*a* when the piston 14*b* is located at the third position H3, the inlet portion 52*a* is in a nearly closed state even when a small gap is present between the inlet portion 52*a* and the inner wall of the through hole 14*f*, so that the piston inner flow path 52 for establishing the communication between the pressure chamber 14*g* and the back pressure chamber 14*h* is in the closed state, and the piston inner flow path 52 is in a state of not being formed. Additionally, the water that has flowed back from the inflow pipe 24*a* is not discharged from the discharge/vacuum break valve 30 into the reservoir tank 10 (OFF state).

At a time T3, the piston 14*b* is further pushed up and the rod 15 also rises. When the piston 14*b* reaches a fourth position H4, the inlet portion 52*a* reaches an opening position in the pressure chamber 14*g*. Therefore, the piston inner flow path 52 for establishing the communication between the pressure chamber 14*g* and the back pressure chamber 14*h* is formed, and is turned to the open state. Accordingly, the flush water flows into the piston inner flow path 52 from the pressure chamber 14*g* via the inlet portion 52*a*, flows out from the piston inner flow path 52 to the back pressure chamber 14*h* through the exit portion 52*b*, and then flows out from the back pressure chamber 14*h* to the outflow pipe 24*b*.

The fourth position H4 is located at a position higher than the third position H3 and slightly lower than the second position H2. That is, the disengagement of the clutch mechanism 22 and the communication between the pressure chamber 14*g* and the outflow pipe 24*b* established by the communication mechanism 46 are performed according to the displacement of the piston 14*b*, and the fourth position H4 is a communication position where the communication between the pressure chamber 14*g* and the outflow pipe 24*b* is established by the communication mechanism 46, the communication position being located on a side closer to the second position 112 than the disengagement position (the third position H3) where the clutch mechanism 22 is disengaged. When the piston 14*b* is located between the fourth position H4 and the second position H2, the inlet portion 52*a* opens to the pressure chamber 14*g*, and the piston inner flow path 52 forms a flow path for establishing the communication between the pressure chamber 14*g* and the back pressure chamber 14*h*.

At the time T3, the water supply of the flush water into the pressure chamber 14*g* is continued, and the piston 14*b* and the rod 15 continuously rise even after the piston inner flow path 52 establishes the communication. The clutch mechanism 22 is in the disengaged state. Additionally, the water that has flowed back from the inflow pipe 24*a* is not discharged from the discharge/vacuum break valve 30 into the reservoir tank 10 (OFF state).

Figure 15:
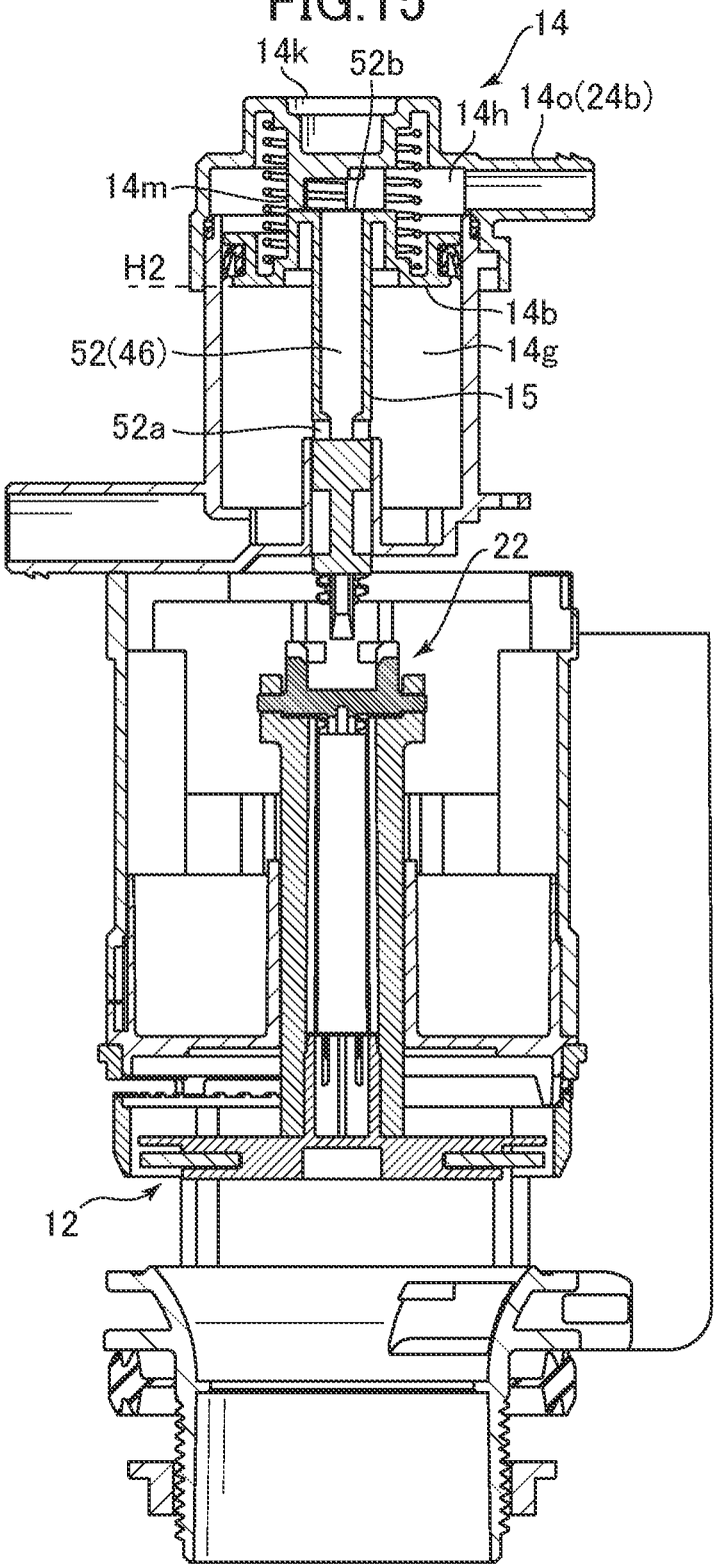
FIG. 15 is a partially enlarged cross sectional view illustrating a state where the piston has reached a second position in the hydraulic drive portion, in the flush water tank apparatus according to the first embodiment of the present invention.

At a time T4, as illustrated in FIG. 15, when the piston 14*b* is further pushed up to reach the second position H2, the piston 14*b* contacts a projecting portion 14*m* which is a protrusion projecting from an end portion 14*k* on the distal side of the cylinder 14*a*, and is stopped. The second position H2 is a position on the most distal side from the first position H1 in the cylinder 14*a*, e.g., a highest position. At this time, the water supply of the flush water into the pressure chamber 14*g* is continued, and the piston 14*b* continuously receives a pushing pressure. However, since the piston 14*b* contacts the projecting portion 14*m*, the piston 14*b* is not further pushed up and is stopped. Even in a state where the piston 14*b* contacts the projecting portion 14*m* and is stopped, a space is still formed in the back pressure chamber 14*h*. The projecting portion 14*m* contacts the piston 14*b* to restrict the sliding of the piston 14*b* to the second position H2. The projecting portion 14*m* is formed in a region on a side opposite to the water discharge opening with respect to a central axis A of the cylinder 14*a*. The projecting portion 14*m* forms a vertical wall facing the water discharge opening. The projecting portion 14*m* forms a vertical wall surface so that the flush water flowing from the exit portion 52*b* into the back pressure chamber 14*h* flows easily to the water discharge opening side.

In a state where the supply of the flush water into the cylinder 14*a* is maintained even after the piston 14*b* has reached the second position H2, the state where the communication mechanism 46 establishes the communication between the pressure chamber 14*g* and the outflow pipe 24*b* is maintained. Since the piston inner flow path 52 is in the open state, the flush water flows into the piston inner flow path 52 from the pressure chamber 14*g* via the inlet portion 52*a*, flows out from the piston inner flow path 52 into the back pressure chamber 14*h* through the exit portion 52*b*, and flows out from the back pressure chamber 14*h* into the outflow pipe 24*b*. Accordingly, the water pressure on the pressure chamber 14*g* side is substantially equal to the water pressure on the back pressure chamber 14*h* side. Since a part of the flush water that has flowed out into the outflow pipe 24*b* flows into the reservoir tank 10, the water level in the reservoir tank 10 rises. The clutch mechanism 22 is in the disengaged state. Additionally, the water that has flowed back from the inflow pipe 24*a* is not discharged from the discharge/vacuum break valve 30 into the reservoir tank 10 (OFF state).

At a time T5, when the water level of the flush water in the reservoir tank 10 rises to the predetermined water level L1, the water supply valve float 34 (see FIG. 2) rises, and the float-side pilot valve 44 is moved via the arm portion 42, whereby the float-side pilot valve 44 is closed. Hereby, the float-side pilot valve port (not illustrated) and the pilot valve port (not illustrated) of the main valve body 38 are closed, and therefore, the pressure inside the pressure chamber 36*a* is increased, and the main valve body 38 is seated on the valve seat 40. As a result, the water supply from the water supply controller 18 to the cylinder 14*a* of the hydraulic drive portion 14 is stopped, whereby the OFF state is created. Since the supply of the flush water into the pressure chamber 14*g* is stopped and a pushing-up force of the piston 14*b* is reduced, the piston 14*b* of the hydraulic drive portion 14 is gradually pushed down by the biasing force of the spring 14*c*.

Figure 16:
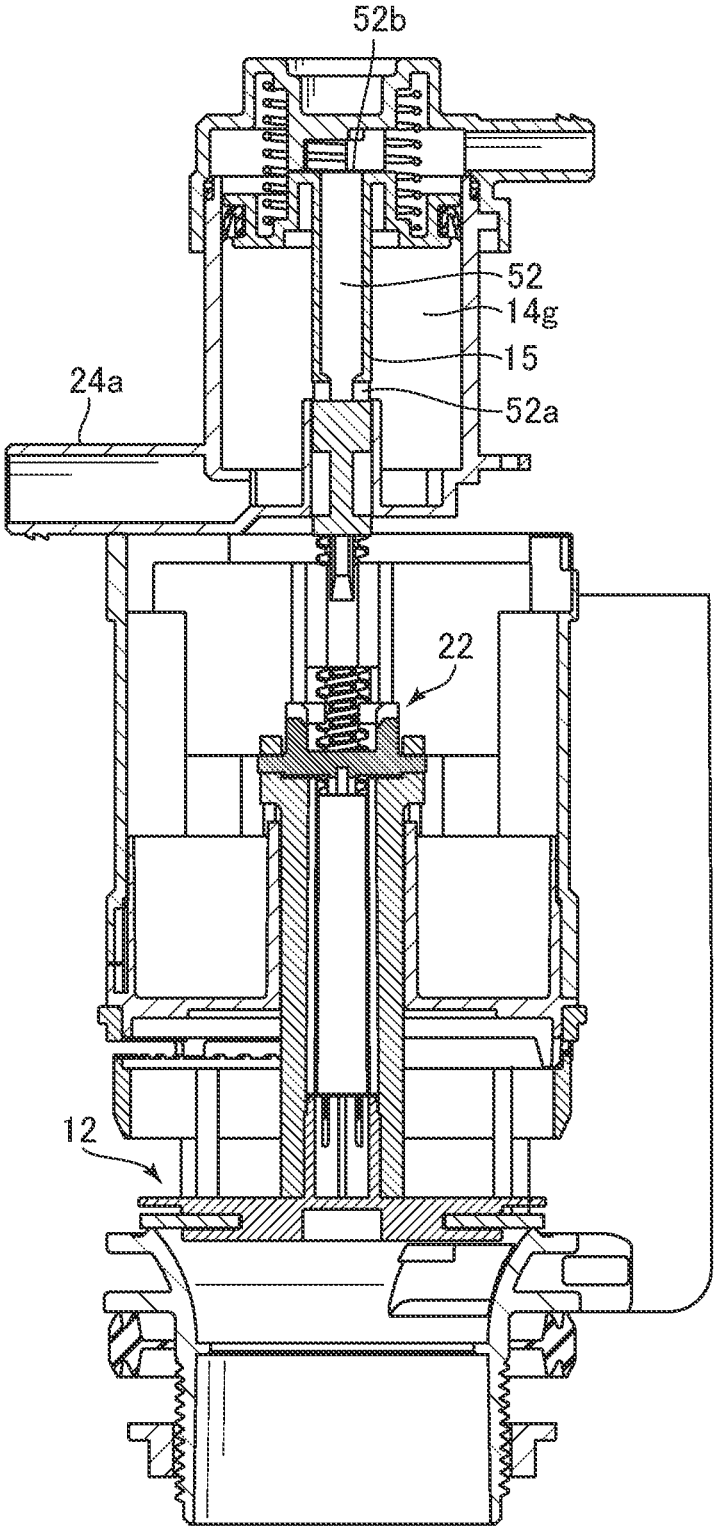
FIG. 16 is a partially enlarged cross sectional view illustrating a state where a discharge valve has fallen to a valve seat, in the flush water tank apparatus according to the first embodiment of the present invention.

At the time T5, as illustrated in FIG. 16, the piston inner flow path 52 forms a flow path for establishing the communication between the pressure chamber 14*g* and the back pressure chamber 14*h*. However, since the inlet portion 52*a* is lowered to a position facing the inner wall of the through hole 14*f* from the interior of the pressure chamber 14*g* immediately after the piston 14*b* starts to be lowered, the piston inner flow path 52 is closed. Thereafter, the piston 14*b* and the rod 15 are continuously lowered. The clutch mechanism 22 is in the disengaged state. At the time T5, when the water supply from the water supply controller 18 to the cylinder 14*a* is stopped, the water that has flowed back from the inflow pipe 24*a* starts to be discharged from the discharge/vacuum break valve 30 into the reservoir tank 10, and the discharge state (ON state) is created in which the flush water in the pressure chamber 14*g* is discharged from the discharge/vacuum break valve 30 into the reservoir tank 10 via the inflow pipe 24*a*. Accordingly, the water pressure on the pressure chamber 14*g* side can be reduced relatively quickly.

Figure 17:
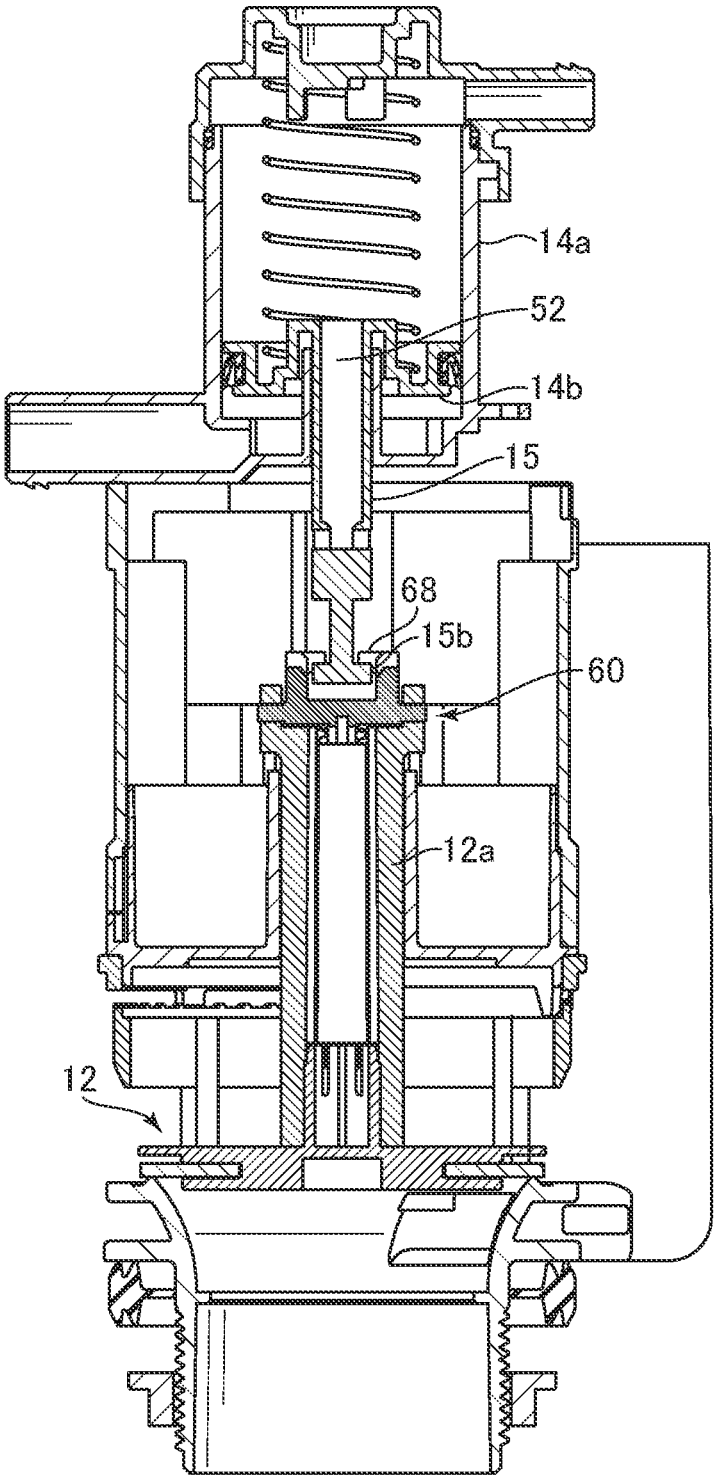
FIG. 17 is a partially enlarged cross sectional view illustrating a state where the clutch mechanism is engaged again, in the flush water tank apparatus according to the first embodiment of the present invention.

At a time T6, as illustrated in FIG. 17, when the lower end of the rod 15 is lowered to the vicinity of the upper end of the valve shaft 12*a*, and the abutted portion 15*d* at the lower end of the pull-up portion 15*b* contacts the upper surface of the base plate 62, the movable member 60 is turned to the "engagement position," and the engaged state of the clutch mechanism 22 is created in which the pull-up portion 15*b* of the rod 15 and the abutting portion 68 of the movable member 60 are engaged with each other.

At a time T7, the rod 15 is further lowered, and is stopped in a state where the abutted portion 15*d* contacts the upper surface of the base plate 62 (see FIG. 4). Therefore, the attitude of the movable member 60 returns to the standby state. At this time, the lowering operation of the piston 14*b* is terminated, and the piston 14*b* returns to the first position H1 in the cylinder 14*a*. During the times T5 to T7, the water supply from the water supply controller 18 to the cylinder 14*a* is stopped. Additionally, the piston inner flow path 52 is in the closed state. During the times T5 to T7, the flush water in the pressure chamber 14*g* is discharged from the discharge/vacuum break valve 30 into the reservoir tank 10 via the inflow pipe 24*a*, flows out from a gap 14*d* between the inner wall of the through hole 14*f* in the cylinder 14*a* and the rod 15, and then flows into the reservoir tank 10. Thus, one toilet flush operation is completed, and the flush toilet apparatus 1 returns to the standby state of the toilet flush operation.

According to the above-described flush water tank apparatus 4 according to the first embodiment of the present invention, the communication mechanism 46 establishes the communication between the pressure chamber 14*g* and the outflow pipe 24*b* after the disengagement of the clutch mechanism 22. This causes the flush water in the pressure chamber 14*g* to flow out into the outflow pipe 24*b* with a relatively simple configuration in which an additional electromagnetic valve is not required, which enables the pressure of the flush water in the pressure chamber 14*g* to be easily reduced and enables the piston 14*b* to easily return from the second position H2 to the first position H1 side. Additionally, it is possible to restrain the pulling-up of the discharge valve 12 until the disengagement of the clutch mechanism 22 from being obstructed by the communication between the pressure chamber 14*g* and the outflow pipe 24*b*. Moreover, since the clutch mechanism 22 is disengaged at a predetermined timing in a predefined manner, it is possible to reduce an influence on the operation of the float mechanism that is to be moved according to the water level in the reservoir tank 10, thereby facilitating a predefined operation. Furthermore, since the piston 14*b* easily returns from the second position H2 to the first position H1 side, a time period until the discharge valve 12 is closed can be reduced and a time period until one flush operation is completed can be made relatively short.

Additionally, according to the flush water tank apparatus 4 according to the first embodiment of the present invention, it is possible to more reliably restrain the pulling-up of the discharge valve 12 until the disengagement of the clutch mechanism 22 from being obstructed by the communication between the pressure chamber 14*g* and the outflow pipe 24*b*. Additionally, since the clutch mechanism 22 is disengaged at a predetermined timing in a predefined manner, it is possible to reduce an influence on the operation of the discharge valve float mechanism 26 that is to be moved according to the water level in the reservoir tank 10, thereby more reliably facilitating a predefined operation.

Additionally, according to the flush water tank apparatus 4 according to the first embodiment of the present invention, in the state where the supply of the flush water into the cylinder 14*a* is maintained even after the piston 14*b* has reached the second position H2, the communication mechanism 46 maintains the communication between the pressure chamber 14*g* and the outflow pipe 24*b*. This can suppress increase in the pressure of the flush water on the pressure chamber 14*g* side after the piston 14*b* reaches the second position H2 and the operation is stopped, and can reduce the pressure of the flush water in the pressure chamber 14*g* more easily when the piston 14*b* starts to return to the first position H1 side after water supply stop, so that the piston 14*b* can return from the second position H2 to the first position H1 side more easily.

Additionally, according to the flush water tank apparatus 4 according to the first embodiment of the present invention, the communication mechanism 46 forms the piston inner flow path 52 for establishing the communication between the pressure chamber 14*g* and the back pressure chamber 14*h* to thereby establish the communication between the pressure chamber 14*g* and the outflow pipe 24*b* via the piston inner flow path 52 and the back pressure chamber 14*h*. This causes the flush water in the pressure chamber 14*g* to flow out into the outflow pipe 24*b* via the piston inner flow path 52 and the back pressure chamber 14*h* with a relatively simple configuration, which enables the pressure of the flush water in the pressure chamber 14*g* to be easily reduced and enables the piston 14*b* to more easily return from the second position H2 to the first position H1 side. Additionally, it is possible to further restrain the pulling-up of the discharge valve 12 until the disengagement of the clutch mechanism 22 from being obstructed by the communication between the pressure chamber 14*g* and the outflow pipe 24*b*. Moreover, the pulling-up of the discharge valve 12 until the disengagement of the clutch mechanism 22 enables the water to be discharged from the water discharge opening of the reservoir tank 10 in a predefined manner. Furthermore, since the clutch mechanism 22 is disengaged at a predetermined timing in a predefined manner, it is possible to reduce an influence on the operation of the float mechanism 26 that is to be moved according to the water level in the reservoir tank 10, thereby further facilitating a predefined operation.

Additionally, according to the flush water tank apparatus 4 according to the first embodiment of the present invention, the outflow pipe 24*b* is provided at a position further closer to the end portion side of the cylinder 14*a* than the second position H2 of the piston 14*b* in the cylinder 14*a*. This causes the flush water in the pressure chamber 14*g* in the state where the piston 14*b* is located at the second position H2 to flow out into the outflow pipe 24*b* via the back pressure chamber 14*h* on a side further closer to a distal end portion of the cylinder 14*a* than the piston 14*b* with a relatively simple configuration, which enables the pressure of the flush water in the pressure chamber 14*g* to be easily reduced and enables the piston 14*b* to more easily return from the second position H2 to the first position H1 side. Additionally, it is possible to further restrain the pulling-up of the discharge valve until the disengagement of the clutch mechanism 22 from being obstructed by the communication between the pressure chamber 14*g* and the outflow pipe 24*b*. Moreover, the pulling-up of the discharge valve 12 until the disengagement of the clutch mechanism 22 enables the water to be discharged from the water discharge opening of the reservoir tank 10 in a predefined manner. Furthermore, since the clutch mechanism 22 is disengaged at a predetermined timing in a predefined manner, it is possible to reduce an influence on the operation of the float mechanism 26 that is to be moved according to the water level in the reservoir tank 10, thereby further facilitating a predefined operation.

Furthermore, the first embodiment of the present invention provides the flush toilet apparatus 1 that includes a flush toilet main unit 2 and a flush water tank apparatus 4 capable of reducing a pressure of flush water in a pressure chamber 14*g* easily.

Next, referring to FIGS. 18 to 36, a flush toilet apparatus 101 according to a second embodiment of the present invention will be described. The second embodiment is an example of the flush toilet apparatus 101 according to the present invention in which a hydraulic drive portion and a clutch mechanism have different structures from those of the first embodiment.

The flush toilet apparatus 101 according to the second embodiment has substantially the same structure as that of the above-described flush toilet apparatus 1 according to the first embodiment. The following describes only the points that are different between the first embodiment and the second embodiment of the present invention. Similar portions are denoted by the same reference symbols in the drawings and are not described.

Figure 18:
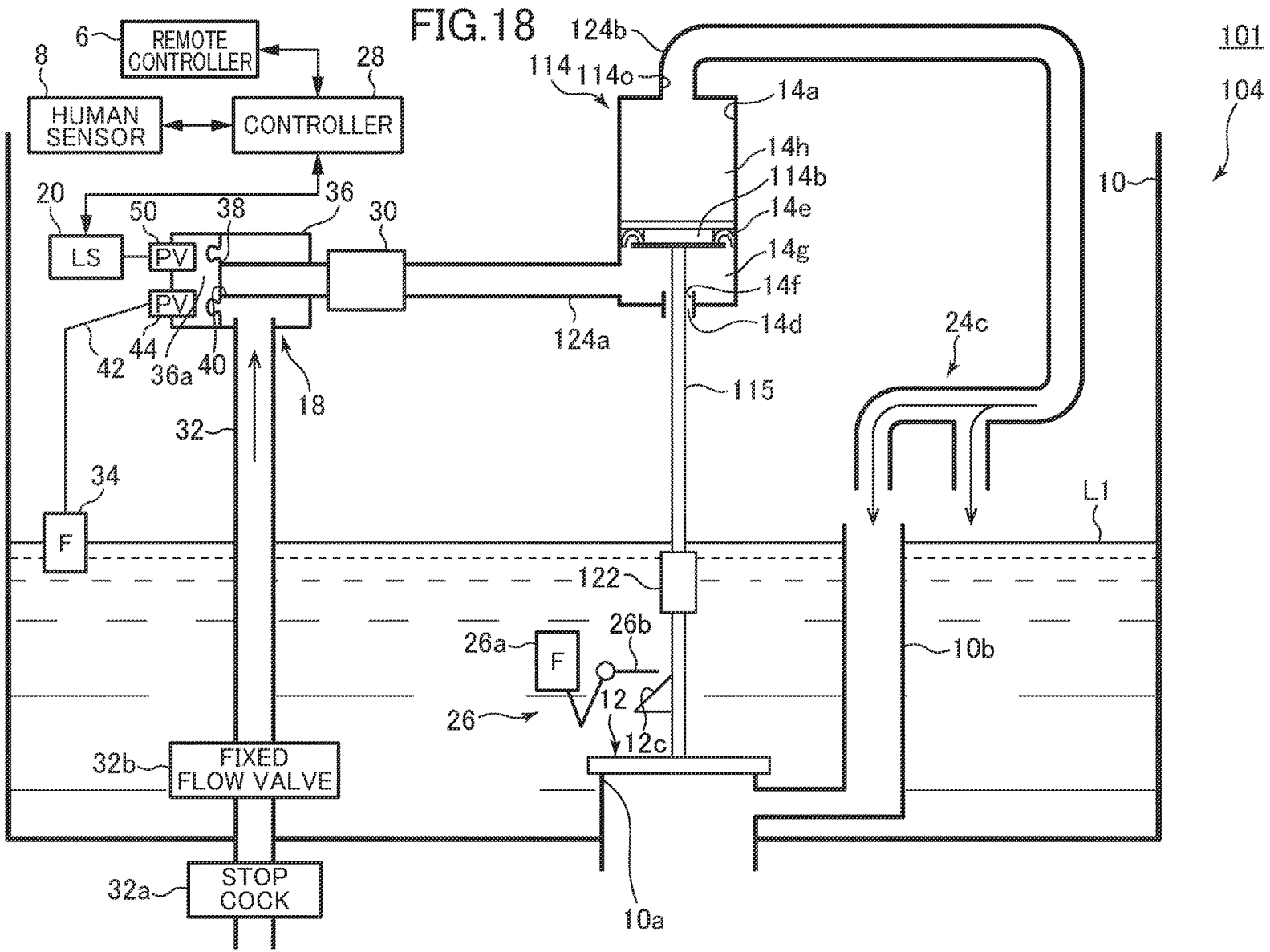
FIG. 18 is a cross sectional view illustrating a schematic configuration of a flush water tank apparatus according to a second embodiment of the present invention.

As illustrated in FIG. 18, the flush toilet apparatus 101 according to the second embodiment of the present invention includes a flush toilet main unit 2 which is a flush toilet, and a flush water tank apparatus 104 which is mounted at a rear portion of the flush toilet main unit 2.

The flush water tank apparatus 104 includes a hydraulic drive portion 114 which is a discharge valve hydraulic drive portion configured to drive a discharge valve 12 using a water supply pressure of supplied tap water.

Next, referring to FIGS. 18 to 20, structures of the hydraulic drive portion and the discharge valve will be described.

The hydraulic drive portion 114 includes a piston 114*b* that is slidably disposed in a cylinder 14*a*, a rod 115 that extends from the interior to the exterior of the cylinder 14*a* and is connectable with the discharge valve 12, and a connection portion 114*o* that is provided on a side closer to an end portion of the cylinder 14*a* than a second position H2 of the piston 114*b*, extends from a water discharge opening from which the flush water in the cylinder 14*a* flows out and is connected with an outflow pipe 124*b*. The rod 115 projects from a lower end of the cylinder 14*a* and extends toward the discharge valve 12. Additionally, the rod 115 is disposed to align on the same line as a valve shaft 12*a* rising from a center of a valve body portion 12*b* of the discharge valve 12, and the discharge valve 12 and the rod 115 are disposed coaxially with each other.

The piston 114*b* partitions the inside of the cylinder 14*a* into a pressure chamber 14*g* on the side in front of the piston 114*b* and a back pressure chamber 14*h* on the side behind the piston 114*b*. Additionally, the piston 114*b* is moved from a first position H1 to the second position H2 (see FIG. 20) by the pressure of the flush water that has flowed into the pressure chamber 14*g*.

A clutch mechanism 122 is provided in a connection portion between a lower end of the rod 115 and the discharge valve 12. The clutch mechanism 122 enables connection between the rod 115 and the discharge valve 12. The connection between the rod 115 and the discharge valve 12 is released at a predetermined timing.

On the other hand, an outflow port is provided in an upper portion of the cylinder 14*a*. The connection portion 114*o* extends from the outflow port of a second member 14*n*. The connection portion 114*o* has a surface to be screwed formed on an inner surface thereof. The connection portion 114*o* is provided in a ceiling wall of the second member 14*n*. The outflow pipe 124*b* which is an outflow portion is attached to the connection portion 114*o*, and communicates with the interior of the cylinder 14*a* via the outflow port in a base unit of the connection portion 114*o*. The outflow pipe 124*b* is adapted so that the flush water is made to flow out from the cylinder 14*a*. Accordingly, when the water flows into the cylinder 14*a* from an inflow pipe 124*a* connected to a lower portion of the cylinder 14*a*, the piston 114*b* is pushed up from the lower portion of the cylinder 14*a* which is at the first position H1 (see FIG. 19) to the second position H2 (see FIG. 20) above the first position H1 by the pressure of the water that has flowed into the cylinder 14*a*. Then, the water that has flowed into the cylinder 14*a* flows out from an outflow hole through the outflow pipe 124*b*. That is, the piston 114*b* is moved from the first position H1 to the second position H2 of the cylinder 14*a* by the pressure of the tap water. The outflow pipe 124*b* is provided at a position further closer to a back surface side (a distal side) of the piston 114*b* than the second position H2 of the piston 114*b*, in the cylinder 14*a*. As illustrated in FIG. 18, an outflow pipe branching portion 24*c* is provided at a distal end portion of the outflow pipe 124*b* extending from the cylinder 14*a*.

As described above, it is only required that the outflow pipe 124*b* is connected to the cylinder 14*a* via the connection portion 114*o* at the position further closer to the back surface side (the distal side) of the piston 114*b* than the second position H2 of the piston 114*b*. Accordingly, the position of the connection portion 114*o* is not limited to a substantially center position of the second member 14*n* as illustrated in FIG. 19 and the like, and the connection portion 114*o* may be provided in the end portion side of the ceiling wall, a side wall, or the like of the second member 14*n*. Additionally, the connection portion 114*o* may be formed to extend in a specific direction from the second member 14*n* to be connected with the outflow pipe 124*b*. In the case where the position and direction of the connection of the outflow pipe 124*b* are thus specified to provide the connection portion 114*o* in the end portion side, the side wall, or the like, an attaching structure for attaching the second member 14*n* to a first member 14*l* is formed so that the connection portion 114*o* is directed in a direction selected from a plurality of kinds of directions, for example, in one direction selected from four directions preset for the first member 14*l*. Such an attaching structure enables the second member 14*n* to be locked at a plurality of positions rotated with respect to the first member 14*l*. Accordingly, the second member 14*n* can be attached so that the connection portion 114*o* is directed in a desired direction. Even in the case where the second member 14*n* is locked at the plurality of positions rotated with respect to the first member 14*l*, as described later, a plurality of cylinder-side mountain portions 192*a* are formed in a second engaging portion 192 (see FIG. 33), and a plurality of mountain portions 188*a* are formed in a first engaging portion 188, so that the second engaging portion 192 and the first engaging portion 188 mesh with each other (the mountain portions and the valley portions mesh with each other) at each position where the second member 14*n* is rotated with respect to the first member 14*l*. To achieve such a structure, the first member 14*l* and the second member 14*n* are fitted and connected to each other. However, in the case where the second member 14*n* is configured not to be rotated with respect to the first member 14*l*, the first member 14*l* and the second member 14*n* may be connected to each other by welding, joining, or the like.

Figure 19:
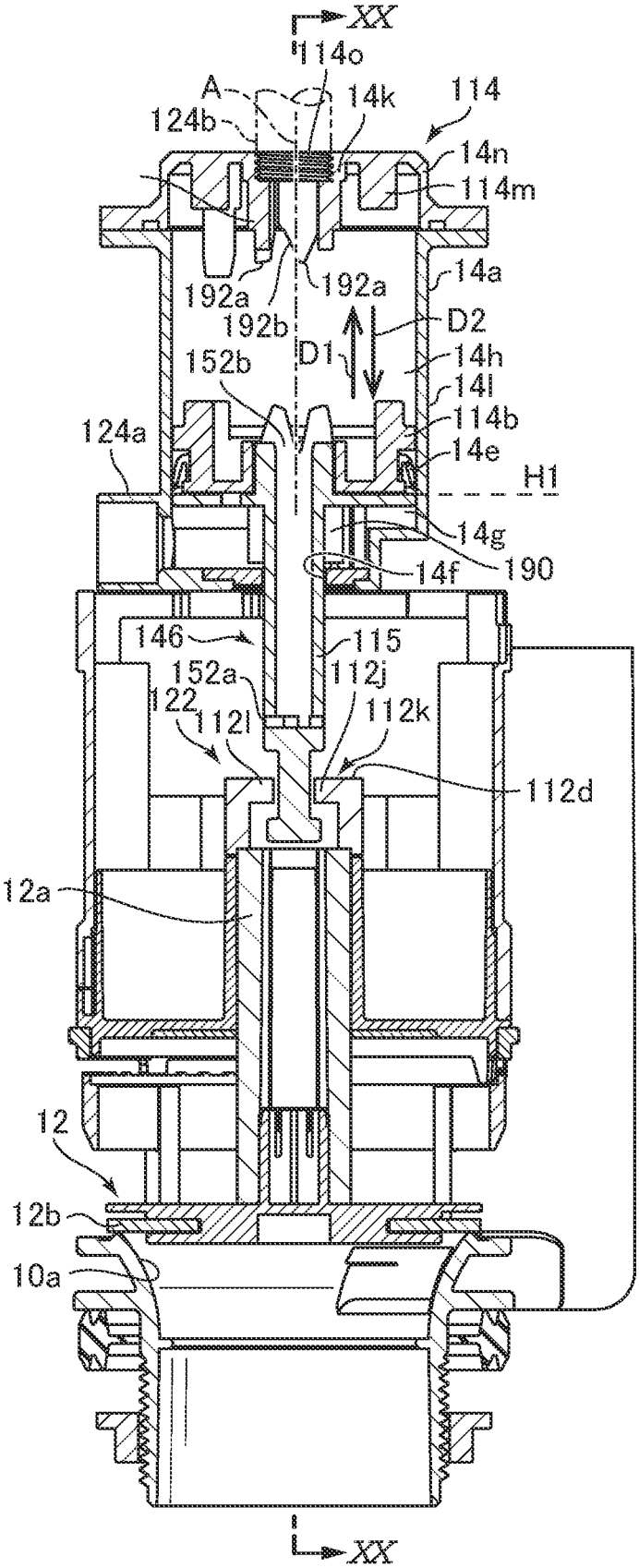
FIG. 19 is a cross sectional view of a hydraulic drive portion and a discharge valve which are provided in the flush water tank apparatus according to the second embodiment of the present invention.
Figure 20:
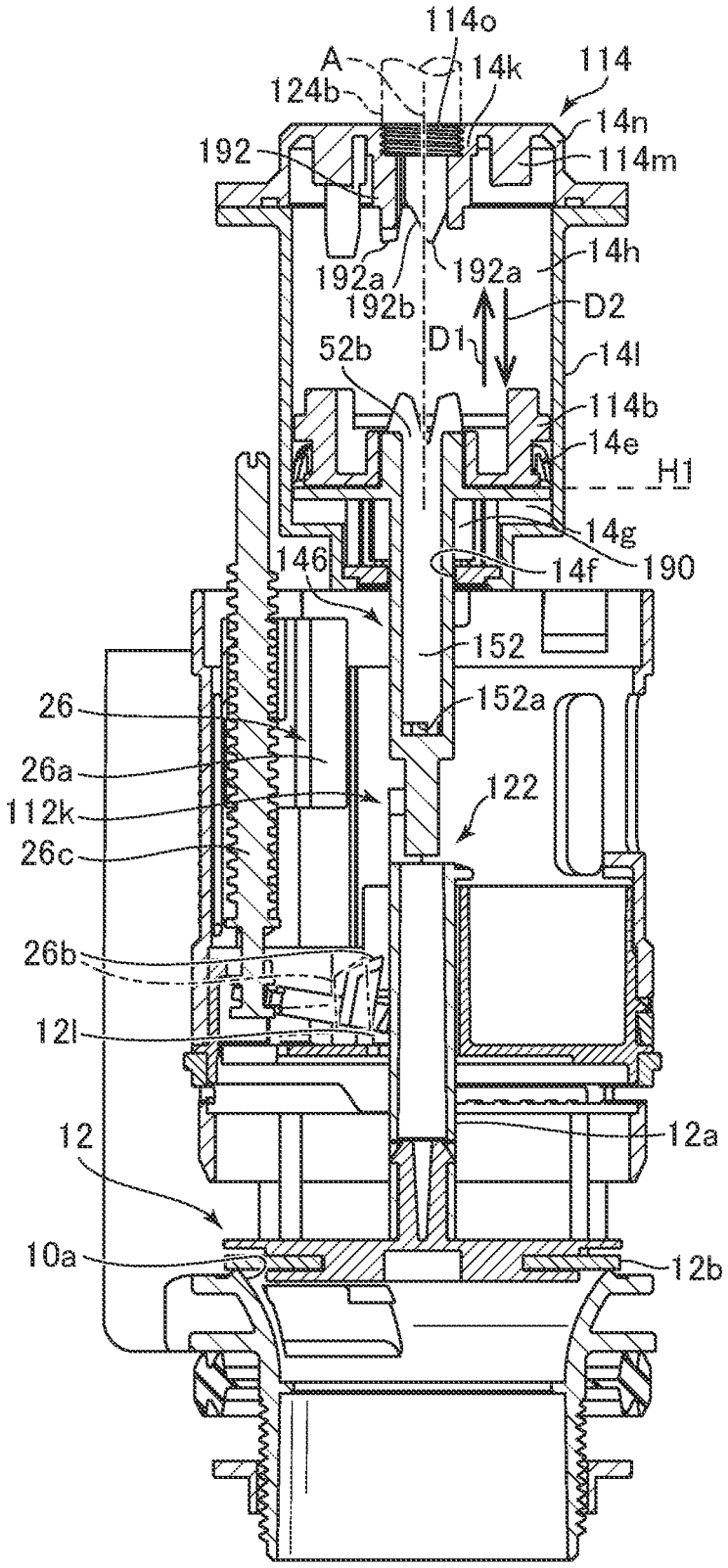
FIG. 20 is a cross sectional view taken along line XX-XX in FIG. 19, in the flush water tank apparatus according to the second embodiment of the present invention.
Figure 21:
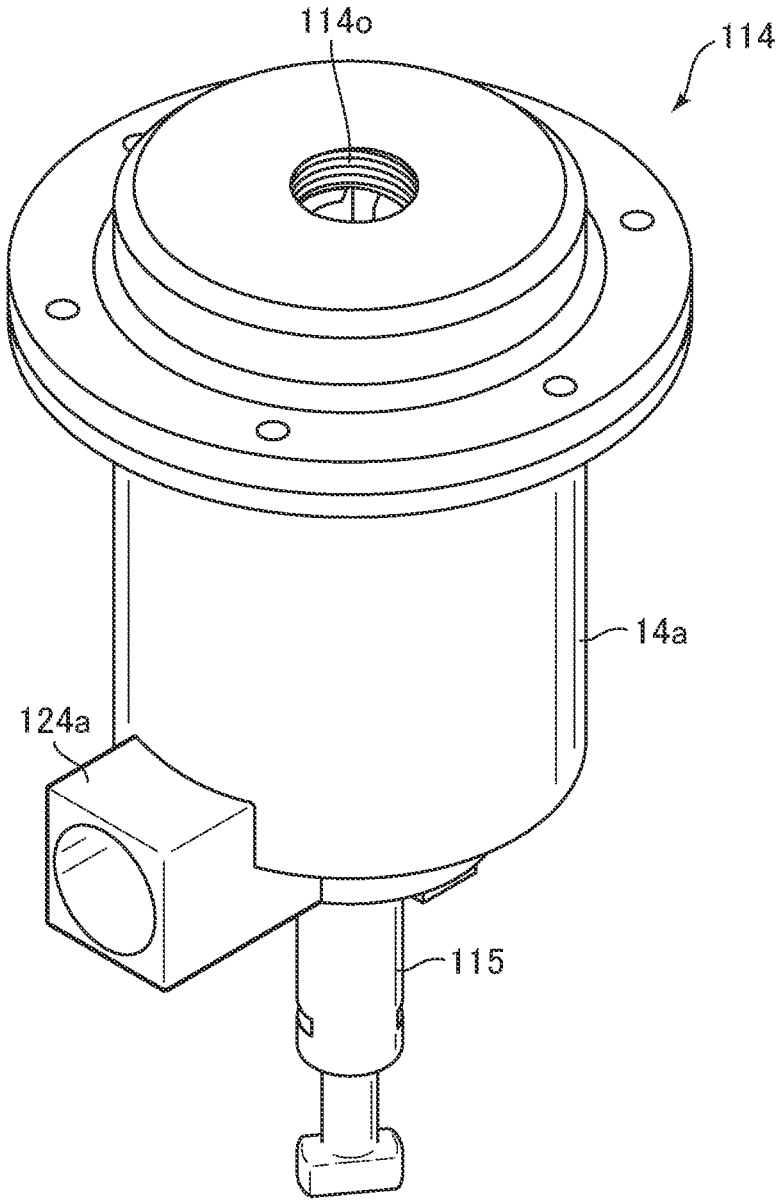
FIG. 21 is a perspective view of the hydraulic drive portion of the flush water tank apparatus according to the second embodiment of the present invention.
Figure 22:
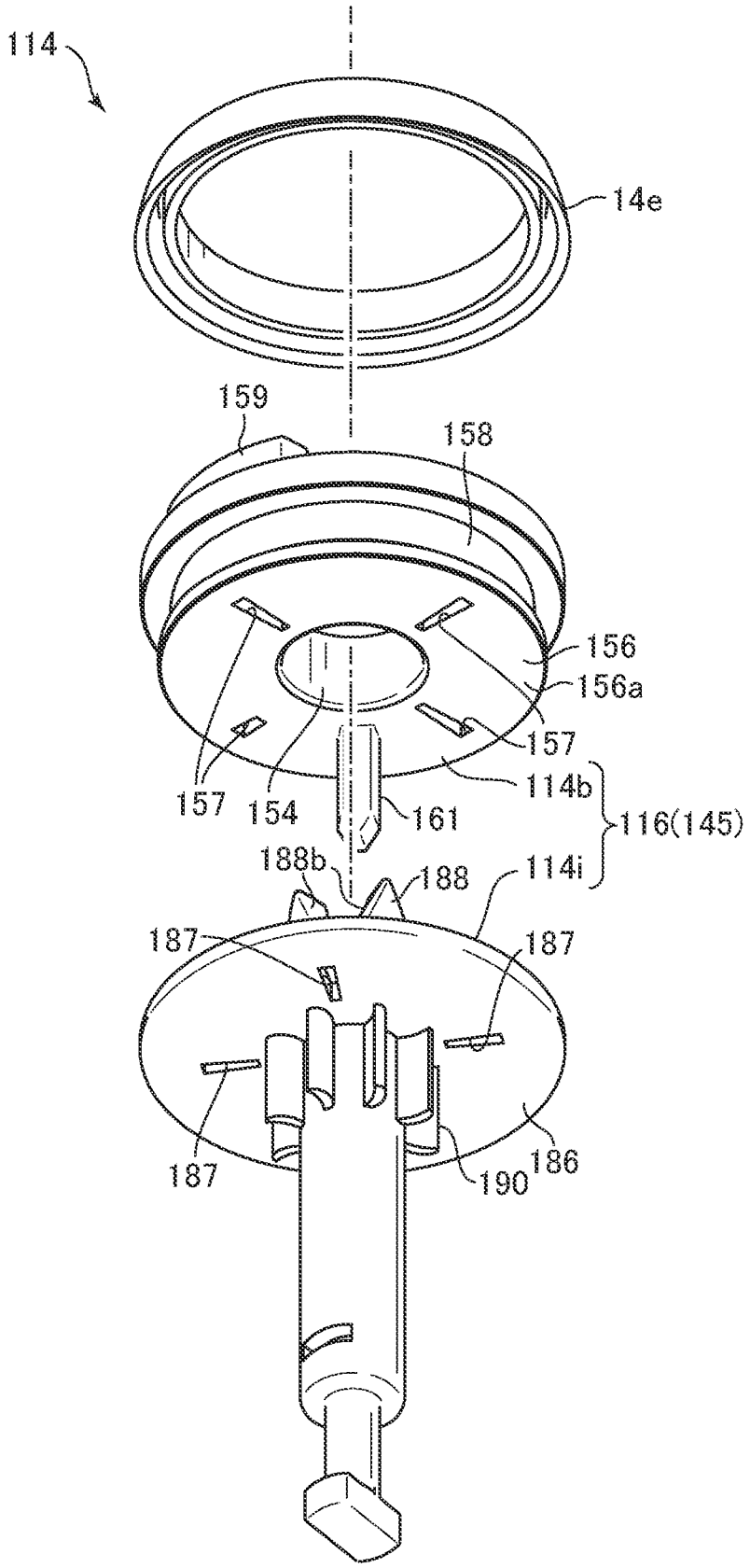
FIG. 22 is an exploded bottom perspective view illustrating packing, a piston and valve components in an exploded state, in the hydraulic drive portion of the flush water tank apparatus according to the second embodiment of the present invention.
Figure 23:
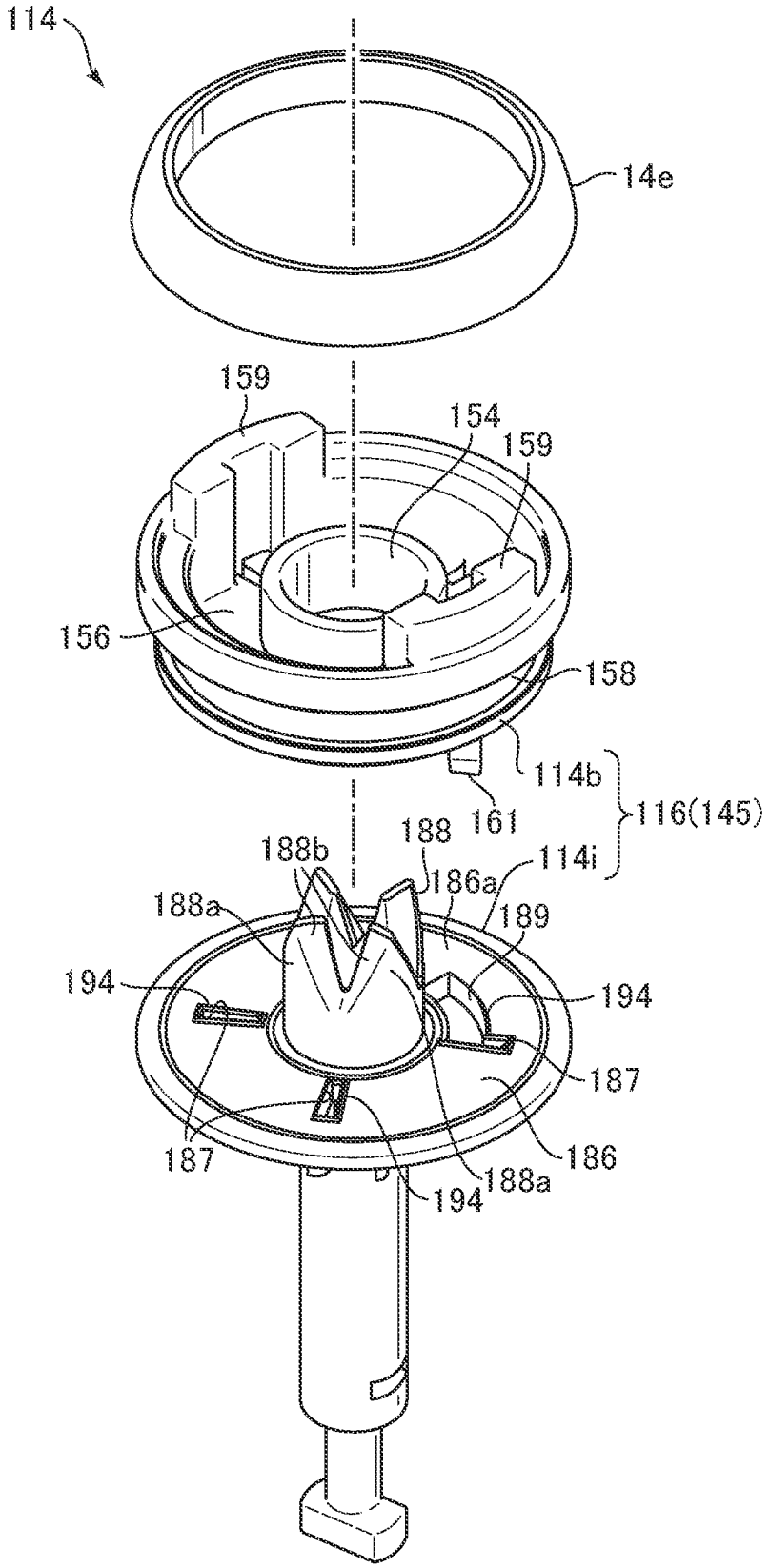
FIG. 23 is an exploded top perspective view illustrating the packing, the piston and the valve components in an exploded state, in the hydraulic drive portion of the flush water tank apparatus according to the second embodiment of the present invention.

As illustrated in FIGS. 19 and 20, the rod 115 is a rod-shaped member, and extends to project downward from the inside of the cylinder 14*a* through a through hole 14*f* formed in a bottom surface of the cylinder 14*a*. The lower end of the rod 115 is connected to the discharge valve 12 via the clutch mechanism 122. Therefore, when water flows into the cylinder 14*a*, and the piston 114*b* is pushed up by the water, the rod 115 connected to the piston 114*b* or a valve component 114*i* described later lifts the discharge valve 12 upward, whereby the discharge valve 12 is opened.

Additionally, the clutch mechanism 122 is provided between the rod 115 and the valve shaft 12*a* of the discharge valve 12. The clutch mechanism 122 connects the discharge valve 12 and the rod 115 of the hydraulic drive portion 114 to pull up the discharge valve 12 by a drive force of the hydraulic drive portion 114. The clutch mechanism 122 is configured to disconnect the valve shaft 12*a* of the discharge valve 12 from the rod 115 by the rotation of the rod 115 when the discharge valve 12 is lifted up to a predetermined position. In a state where the clutch mechanism 122 is disengaged, the discharge valve 12 ceases to move in association with the movement of the piston 114*b* and the rod 115, and falls by gravity while resisting buoyancy.

Next, referring to FIGS. 19 to 27, a more detailed structure of the hydraulic drive portion 114 will be described.

The piston 114*b* of the hydraulic drive portion 114 is formed to move in a first direction D1 (see FIG. 19) from the first position H1 toward the second position H2 upon receipt of the water supply pressure of the flush water that has flowed into the pressure chamber 14*g*. Additionally, when the piston 114*b* moving in the first direction D1 returns due to stop of the flush water flow into the cylinder 14*a* or reduction in amount of flush water flow into the cylinder 14*a*, the piston 114*b* is formed to move, in the cylinder 14*a*, in a second direction D2 from the second position H2 toward the first position H1, the second direction D2 being opposite to the first direction D1.

The piston 114*b* includes an inner cylindrical portion 154 that forms a vertical wall extending in parallel to a central axis A (see FIG. 19) of the cylinder 14*a* in an inner side thereof, a first plate portion 156 that extends outward from the inner cylindrical portion 154 and is formed into an annular disc shape, an outer cylindrical portion 158 that forms a vertical wall extending in parallel to the central axis A (see FIG. 19) of the cylinder 14*a* from an outer portion of the first plate portion 156, a back pressure chamber-side projecting portion 159 that further projects in parallel to the central axis A of the cylinder 14*a* from a top portion of the outer cylindrical portion 158, and a pressure chamber-side projecting portion 161 that extends from the first plate portion 156 toward the pressure chamber 14*g* side.

The inner cylindrical portion 154 is formed to rise from the first plate portion 156 toward the back pressure chamber 14*h* side. The inner cylindrical portion 154 forms the vertical wall having a height lower than that of the outer cylindrical portion 158. The inner cylindrical portion 154 is formed to turnably receive therein the first engaging portion 188 of the valve component 114*i*.

The first plate portion 156 forms a flat seat surface 156*a* (see FIG. 22) on the pressure chamber 14*g* side. The first plate portion 156 is formed into a flat thin plate shape. A piston opening 157 is formed in the first plate portion 156. Four piston openings 157 are formed in the annular first plate portion 156 and are arranged at equal intervals with spacing of 90 degrees. The number of piston openings 157 may be one, or a plurality of piston openings 157 other than four may be formed. Alternatively, the intervals of the piston openings 157 to be arranged in the annular first plate portion 156 are not necessarily equal to one another. The plurality of piston openings 157 are arranged along a peripheral direction of the first plate portion 156. The piston opening 157 is formed into a rectangular shape when the first plate portion 156 is viewed from the pressure chamber 14*g* side, a short side thereof extends in a circumferential direction of the first plate portion 156, and a long side thereof extends in a radial direction of the first plate portion 156. The piston opening 157 forms a through hole passing through the first plate portion 156 along the central axis A from the pressure chamber 14*g* side to the back pressure chamber 14*h* side.

The outer cylindrical portion 158 is formed to rise from the first plate portion 156 toward the back pressure chamber 14*h* side. The outer cylindrical portion 158 is formed so that the packing 14*e* is attached to an outer surface thereof.

The back pressure chamber-side projecting portions 159 are formed at two positions facing each other on the annular outer cylindrical portion 158. That is, the back pressure chamber-side projecting portions 159 are arranged at equal intervals with spacing of 180 degrees in the annular outer cylindrical portion. The back pressure chamber-side projecting portion 159 is formed into a prism shape to have a planarized top portion. The number of back pressure chamber-side projecting portions 159 may be one, or a plurality of back pressure chamber-side projecting portions 159 other than two may be formed.

The pressure chamber-side projecting portion 161 extends from the first plate portion 156 to be formed into a rod shape. The pressure chamber-side projecting portion 161 extends in parallel to the central axis A (see FIG. 19).

The hydraulic drive portion 114 further includes the valve component 114*i* that is formed to be movable from the first position H1 to the second position H2 together with the piston 114*b* and is attached along the first plate portion 156 of the piston 114*b*. A communication valve 116 (see FIGS. 22 and 23) is formed by combining the valve component 114*i* with the piston 114*b*, the communication valve 116 being configured to open and close a plurality of openings in a flow path for establishing the communication between the pressure chamber 14*g* and the back pressure chamber 14*h* in the cylinder 14*a*. At least one communication valve 116 is formed to open and close the plurality of openings. The valve component 114*i* is formed to be relatively movable with respect to the piston 114*b* in addition to the movement from the first position H1 to the second position H2. The valve component 114*i* is formed to be turned around an axis parallel to the rod 115.

The valve component 114*i* includes a second plate portion 186 that is formed into an annular disc shape in the outer side of the rod 115, the first engaging portion 188 that rises from the inner side portion of the second plate portion 186 toward the back pressure chamber 14*h* side, and a force receiving portion 190 that is rotated upon receipt of the flow of the flush water.

The second plate portion 186 has a flat surface 186*a* formed on the back pressure chamber 14*h* side and has a flat surface formed on the pressure chamber 14*g* side. Since the second plate portion 186 has the flat surface 186*a* formed on the back pressure chamber 14*h* side, the second plate portion 186 is disposed in parallel along the first plate portion 156 and can be turned in parallel along the first plate portion 156. The valve component 114*i* is formed to be moved in parallel to the seat surface 156*a* of the piston 114*b*. For example, the flat surface 186*a* of the valve component 114*i* is formed to rotatably move in parallel to the seat surface 156*a*. The second plate portion 186 is formed into a thin plate-like shape. A valve component-side opening 187 is formed in the second plate portion 186. Four valve component-side openings 187 are formed in the annular second plate portion 186 and are arranged at equal intervals with spacing of 90 degrees. The number of valve component-side openings 187 may be one, or a plurality of valve component-side openings 187 other than four may be formed. Alternatively, the intervals of the valve component-side openings 187 to be arranged in the annular second plate portion 186 are not necessarily equal to one another. The plurality of valve component-side openings 187 are arranged along a peripheral direction of the second plate portion 186. The valve component-side opening 187 is formed into a rectangular shape when the second plate portion 186 is viewed from the pressure chamber 14*g* side, a short side thereof extends in a circumferential direction of the second plate portion 186, and a long side thereof extends in a radial direction of the second plate portion 186. The valve component-side opening 187 forms a through hole passing through the second plate portion 186 along the central axis A from the pressure chamber 14*g* side to the back pressure chamber 14*h* side. The valve component-side opening 187 is slightly larger than the piston opening 157.

A rib 194 (see FIG. 23) is formed on the second plate portion 186 to surround the valve component-side openings 187. The rib 194 is formed to project in a part of a surface of the valve component 114*i*, the surface facing the piston 114*b*. The rib 194 forms a projecting portion slightly raised from the surface of the second plate portion 186. The rib 194 is formed to cover the periphery of all of the valve component-side openings 187 and a guide opening 189 and is formed at the same height. Accordingly, the second plate portion 186 and the seat surface 156*a* contact each other via the rib 194. The rib 194 may be formed on the second plate portion 186 other than the periphery of the valve component-side openings 187. Alternatively, the rib 194 may be formed in a part of a surface on the seat surface 156*a* side of the piston 114*b*, the surface facing the valve component 114*i*.

The second plate portion 186 further has the guide opening 189 formed therein, the guide opening 189 being configured to receive the pressure chamber-side projecting portion 161. In the second plate portion 186, the guide opening 189 forms an arc-shaped opening portion extending in a circumferential direction. Therefore, the guide opening 189 restricts a range in which the valve component 114*i* can be turned with respect to the piston 114*b* in a state where the pressure chamber-side projecting portion 161 is received in the guide opening 189, and defines a turning range and a rotational direction of the valve component 114*i*. For example, the guide opening 189 is formed so that the turning range of the valve component 114*i* is set to an angle within a range from about 15 to 45 degrees, more preferably, 30 degrees. The guide opening 189 is connected to one of the valve component-side openings 187, but the guide opening 189 may be formed separately from one of the valve component-side openings 187.

The first engaging portion 188 forms a projecting portion extending toward an end portion 14*k* on a distal side of the cylinder 14*a*. The first engaging portion 188 is formed so that a distal end portion of a cylindrical tubular portion forms a plurality of mountain portions 188*a*. The first engaging portion 188 forms four triangular mountain portions 188*a*. The mountain portion 188*a* has a sloping surface 188*b* which is a sloping portion formed in a side surface thereof. As described later, the sloping surface 188*b* contacts a cylinder-side sloping surface 192*b* of the cylinder-side mountain portion 192*a* corresponding thereto, which causes a rotational force in a circumferential direction to be generated in the first engaging portion 188 and the valve component 114*i* and causes the valve component 114*i* to be turned to a position corresponding to the open state of the communication valve 116. Therefore, the first engaging portion 188 includes the sloping surfaces 188*b* that causes the valve component 114*i* to be relatively moved with respect to the piston 114*b* in a direction different from a moving direction of the piston 114*b* when the piston 114*b* reaches the second position H2 (see FIG. 34) and the first engaging portion 188 and the second engaging portion 192 are engaged with each other. Accordingly, the direction in which the valve component 114*i* is relatively moved with respect to the piston 114*b* to turn the communication valve 116 to the open state is a direction different from the moving direction of the piston 114*b*. The valve component 114*i* is formed to move in a direction perpendicular to the moving direction of the piston 114*b*. Four mountain portions 188*a* are formed in the annular first engaging portion 188 and are arranged at equal intervals with spacing of 90 degrees. The number of mountain portions 188*a* may be one, or a plurality of mountain portions 188*a* other than four may be formed. Alternatively, the intervals of the mountain portions 188*a* to be arranged in the first engaging portion 188 are not necessarily equal to one another if the mountain portions 188*a* contact the cylinder-side mountain portions 192*a* to cause the rotational force to be generated in the first engaging portion 188.

The force receiving portion 190 includes a plurality of blades each having a horizontal section formed into a wing shape of an aircraft. The blades of the force receiving portion 190 are arranged along an outer periphery of the rod 115, and are arranged to rotate around the rod 115 upon receipt of the flow of the flush water flowing from the inflow pipe 124*a* into the pressure chamber 14*g*. The force receiving portion 190 is connected to the second plate portion 186, and the second plate portion 186 is rotated along with the rotation of the force receiving portion 190. The force receiving portion 190 is disposed so that the rotational direction is restricted to rotate only in one direction from the standby state. Accordingly, the force receiving portion 190 is rotated only in a predetermined one direction from the standby state, and the second plate portion 186 is also rotated in the same direction.

Figure 34:
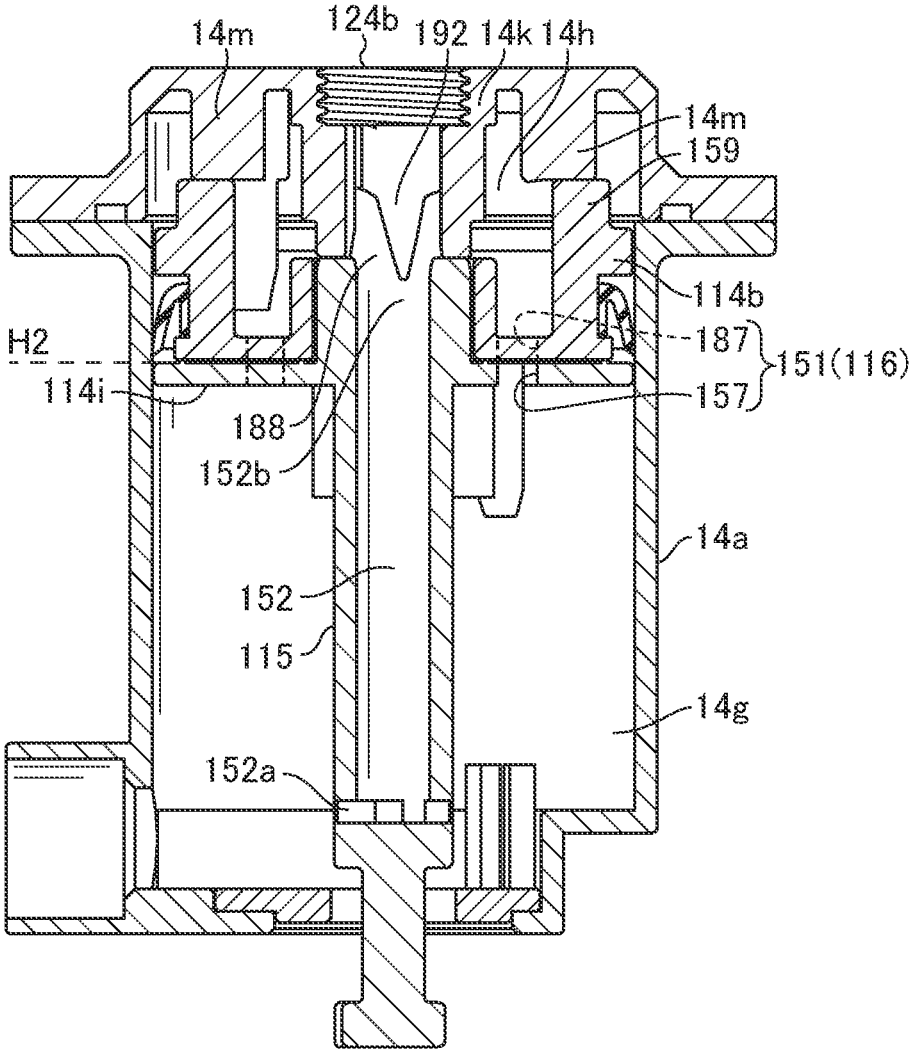
FIG. 34 is a partially enlarged cross sectional view illustrating a state where the piston has reached a second position in the hydraulic drive portion, in the flush water tank apparatus according to the second embodiment of the present invention.
Figure 35:
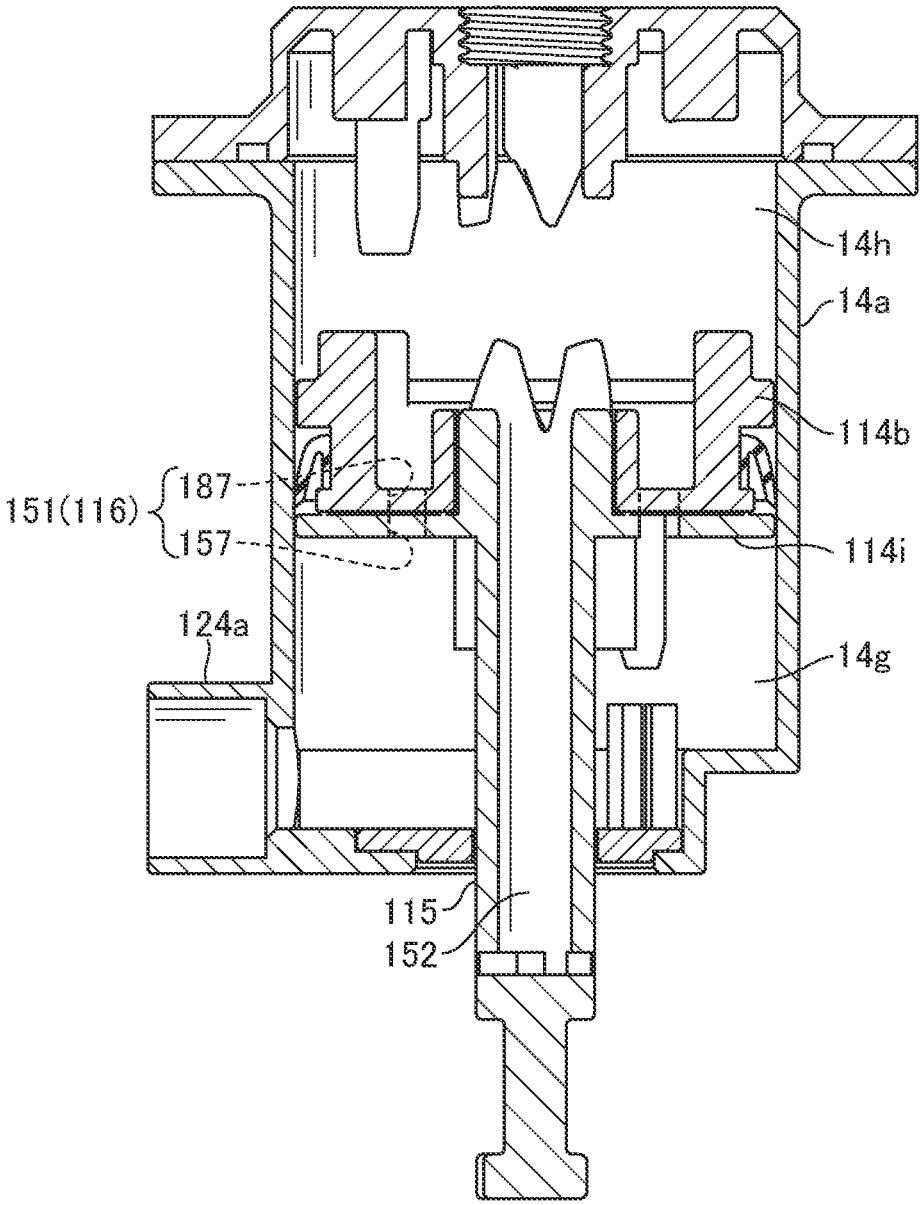
FIG. 35 is a partially enlarged cross sectional view illustrating a state where the piston is being lowered in the hydraulic drive portion, in the flush water tank apparatus according to the second embodiment of the present invention.

As illustrated in FIG. 34, the cylinder 14*a* includes the second engaging portion 192 that rises from the end portion 14*k* closer to the distal side than the second position H2 of the cylinder 14*a* toward the back pressure chamber 14*h* side. The second engaging portion 192 forms a projecting portion extending toward the inside of the cylinder 14*a*. The second engaging portion 192 is formed in the same manner as the first engaging portion 188 to pair with the first engaging portion 188, and a distal end portion of a cylindrical tubular portion forms a plurality of cylinder-side mountain portions 192*a*. The second engaging portion 192 forms four triangular cylinder-side mountain portions 192*a*. The cylinder-side mountain portion 192*a* has a cylinder-side sloping surface 192*b* which is a sloping portion formed in a side surface thereof. Therefore, the second engaging portion 192 includes the cylinder-side sloping surfaces 192*b* that cause the valve component 114*i* to be relatively moved with respect to the piston 114*b* in a direction different from the moving direction of the piston 114*b* when the piston 114*b* reaches the second position H2 and the first engaging portion 188 and the second engaging portion 192 are engaged with each other. Four cylinder-side mountain portions 192*a* are formed in the annular second engaging portion 192 and are arranged at equal intervals with spacing of 90 degrees. The number of cylinder-side mountain portions 192*a* may be one, or a plurality of cylinder-side mountain portions 192*a* other than four may be formed. Alternatively, the intervals of the cylinder-side mountain portions 192*a* to be arranged in the second engaging portion 192 are not necessarily equal to one another if the cylinder-side mountain portions 192*a* contact the mountain portions 188*a* to cause the rotational force to be generated in the first engaging portion 188. At least one of the first engaging portion 188 and the second engaging portion 192 includes the sloping surfaces 188*b* or the cylinder-side sloping surfaces 192*b* which are sloping portions.

The rod 115 is connected to the piston 114*b* or the valve component 114*i*. In the present embodiment, the rod 115 is connected to the valve component 114*i*, but is not connected to the piston 114*b*. In describing the present embodiment again, the rod 115 is connected to the valve component 114*i*, and therefore the rod 115 is turned along with the turning of the valve component 114*i*. In a state where the rod 115 extends from the valve component 114*i*, a second piston inner flow path 152 is formed so that the interior of the rod 115 is continuous with the interior of the first engaging portion 188.

Here, the hydraulic drive portion 114 further includes a first communication mechanism 145 (see FIGS. 22 and 23) for establishing the communication between the pressure chamber 14*g* and the outflow pipe 124*b* after the clutch mechanism 122 is disengaged. The first communication mechanism 145 is formed as the communication valve 116 by the piston 114*b* and the valve component 114*i*. The first communication mechanism 145 forms a first piston inner flow path 151 (see FIGS. 24 and 25) for establishing the communication between the pressure chamber 14*g* and the back pressure chamber 14*h* according to the position of the piston 114*b* to thereby establish the communication between the pressure chamber 14*g* and the outflow pipe 124*b* via the communication valve 116 and the back pressure chamber 14*h*. More specifically, as described later, in a case where the valve component-side openings 187 of the valve component 114*i* are located at the same positions as the piston openings 157 of the piston 114*b*, respectively, the communication valve 116 is in the open state, the first piston inner flow path 151 for establishing the communication between the pressure chamber 14*g* and the back pressure chamber 14*h* is formed. The communication valve 116 forms the first piston inner flow path 151 in the open state, and closes the first piston inner flow path 151 in the closed state. The first piston inner flow path 151 is formed as a flow path in which the communication between the valve component-side openings 187 and the piston openings 157 is established.

Accordingly, when the valve component-side openings 187 are located at the same positions as the piston openings 157, respectively, the first communication mechanism 145 forms the first piston inner flow path 151 for establishing the communication between the pressure chamber 14*g* and the back pressure chamber 14*h*, to thereby turn the communication valve 116 to the open state and establish the communication between the pressure chamber 14*g* and the outflow pipe 124*b* via the first piston inner flow path 151 and the back pressure chamber 14*h*.

On the other hand, when the valve component-side openings 187 are located at different positions from the piston openings 157, respectively, the first communication mechanism 145 causes the first piston inner flow path 151 for establishing the communication between the pressure chamber 14*g* and the back pressure chamber 14*h* to be turned to the state of not being formed (the closed state), whereby the communication valve 116 is closed.

The hydraulic drive portion 114 further includes a second communication mechanism 146 for establishing the communication between the pressure chamber 14*g* and the outflow pipe 124*b* after the clutch mechanism 122 is disengaged. The second communication mechanism 146 forms the second piston inner flow path 152 for establishing the pressure chamber 14*g* and the back pressure chamber 14*h* according to the position of the piston 114*b* to thereby establish the communication between the pressure chamber 14*g* and the outflow pipe 124*b* via the second piston inner flow path 152 and the back pressure chamber 14*h*. The second piston inner flow path 152 is formed into a pipe shape on the inner side of annular structures of the rod 115 and the first engaging portion 188, and forms a cylindrical space. The second piston inner flow path 152 extends from an inlet portion 152*a* formed on the clutch mechanism 122 side of the rod 115 to an exit portion 152*b* formed to open on the back pressure chamber 14*h* side of the piston 114*b*. The inlet portion 152*a* is formed as an opening to the side wall of the rod 115. The exit portion 152*b* forms a central opening that opens in an axial direction of the rod 115, at an end portion of the first engaging portion 188. The exit portion 152*b* is formed in the vicinity of the back pressure chamber side of the piston 114*b*.

In contrast, the inlet portion 152*a* is formed on the pressure chamber 14*g* side of the piston 114*b* and at a position away from the piston 114*b* by a predetermined distance. For example, a length from the inlet portion 152*a* to the exit portion 152*b* is shorter than a full length of the interior of the cylinder 14*a*, and for example, corresponds to 50 to 90 percent of the full length. Accordingly, when the piston 114*b* is located at the first position H1, the inlet portion 152*a* away from the piston 114*b* (the exit portion 152*b*) by the predetermined distance is located outside of the cylinder 14*a* and the inlet portion 152*a* is positioned to open into the reservoir tank 10. Therefore, the second piston inner flow path 152 for establishing the communication between the pressure chamber 14*g* and the back pressure chamber 14*h* is in a state of not being formed (in a closed state), and the second piston inner flow path 152 is connected to the reservoir tank 10 side.

In a state where the piston 114*b* is moving from the first position H1 to the second position H2, when the inlet portion 152*a* is located outside of the cylinder 14*a*, the second piston inner flow path 152 for establishing the communication between the pressure chamber 14*g* and the back pressure chamber 14*h* is in the closed state and in the state of not being formed. When the inlet portion 152*a* is located at a position facing the inner wall of the through hole 14*f* of the cylinder 14*a*, the inlet portion 152*a* is in a nearly closed state even when a small gap is present between the inlet portion 152*a* and the inner wall of the through hole 14*f*, so that the second piston inner flow path 152 for establishing the communication between the pressure chamber 14*g* and the back pressure chamber 14*h* is in the closed state and in the state of not being formed. When the piston 114*b* is located at the second position H2, the inlet portion 152*a* away from the piston 114*b* (the exit portion 152*b*) by the predetermined distance is positioned to open to the pressure chamber 14*g* in the cylinder 14*a*. Therefore, when the piston 114*b* is located at the second position H2, the second communication mechanism 146 forms the second piston inner flow path 152 for establishing the communication between the pressure chamber 14*g* and the back pressure chamber 14*h* to thereby establish the communication between the pressure chamber 14*g* and the outflow pipe 124*b* via the second piston inner flow path 152 and the back pressure chamber 14*h*. On the other hand, when the piston 114*b* is located at the first position H1, the second communication mechanism 146 creates the state where the second piston inner flow path 152 for establishing the communication between the pressure chamber 14*g* and the back pressure chamber 14*h* is not formed (is closed), and the second piston inner flow path 152 establishes the communication between the back pressure chamber 14*h* and the interior of the reservoir tank 10 outside of the cylinder 14*a*. Additionally, the hydraulic drive portion 114 may include only the first communication mechanism 145 and not including the second communication mechanism 146. The first communication mechanism 145 and/or the second communication mechanism 146 has a switching function for switching between the communicated state and the uncommunicated state.

Next, referring now to FIGS. 28 and 29, the clutch mechanism 122 that connects the discharge valve 12 and the rod 115 will be described.

Figure 28:
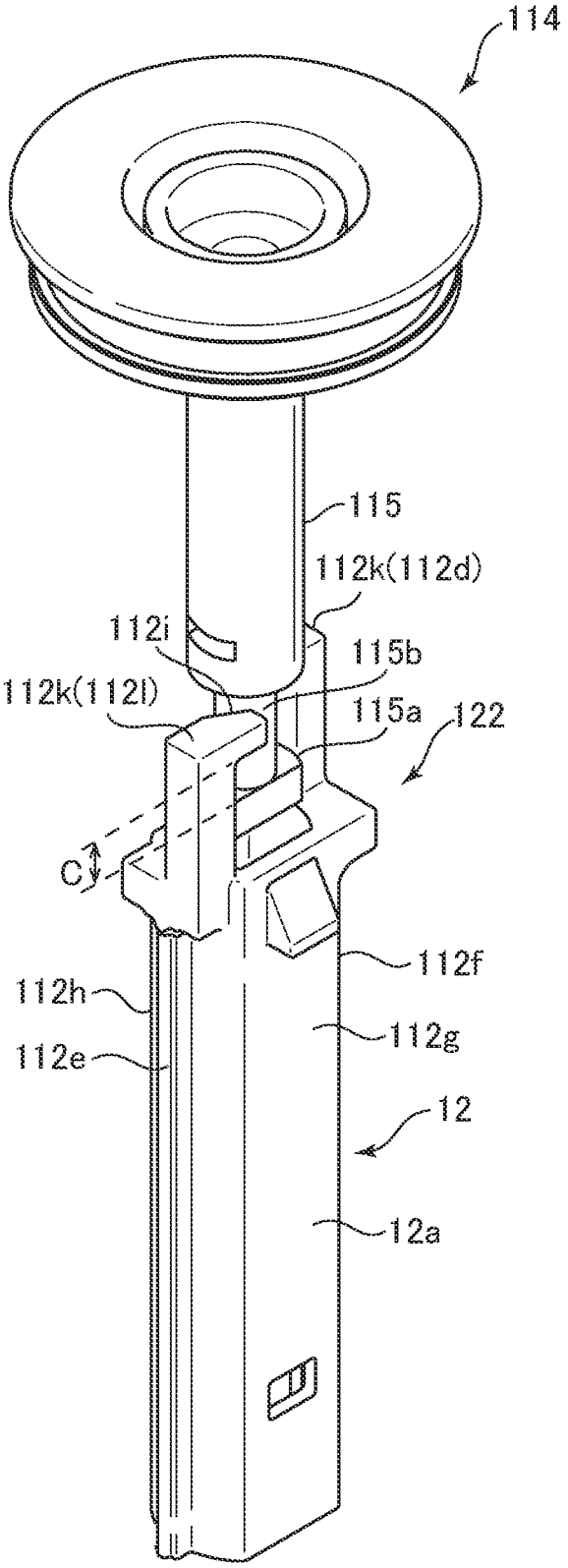
FIG. 28 is a partially enlarged cross sectional view illustrating a clutch mechanism which is in an engaged state, in the flush water tank apparatus according to the second embodiment of the present invention.

FIG. 28 is a partially enlarged cross sectional view illustrating the clutch mechanism which is in an engaged state, in the flush water tank apparatus according to the second embodiment of the present invention. FIG. 29 is a partially enlarged cross sectional view illustrating the clutch mechanism which is in a disengaged state, in the flush water tank apparatus according to the second embodiment of the present invention.

Figure 24:
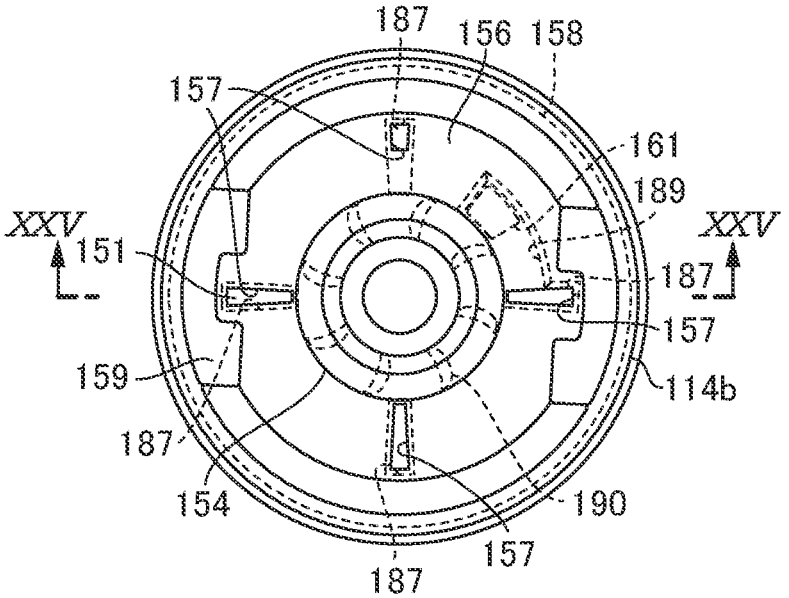
FIG. 24 is a view illustrating positions of a piston opening, a valve component-side opening, and the like in a case where a communication valve is in the open state, when viewed from above, in a state where the packing, the piston, the valve component, and the rod are combined, in the hydraulic drive portion of the flush water tank apparatus according to the second embodiment of the present invention.
Figure 26:
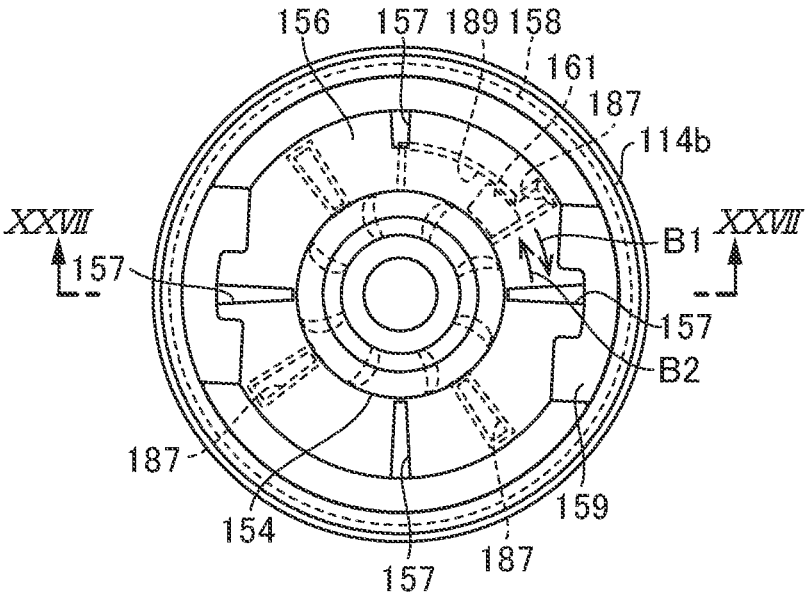
FIG. 26 is a view illustrating the positions of the piston opening, the valve component-side opening, and the like in a case where a communication valve is in the closed state, when viewed from above, in a state where the packing, the piston, the valve component, and the rod are combined, in the hydraulic drive portion of the flush water tank apparatus according to the second embodiment of the present invention.
Figure 27:
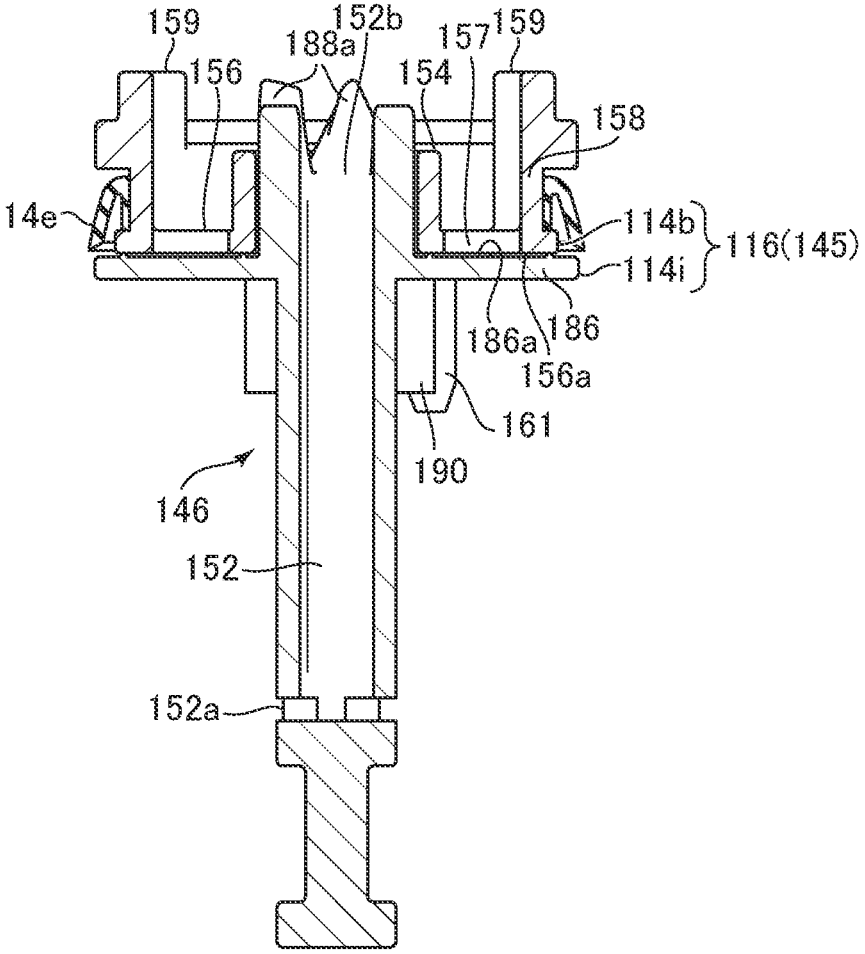
FIG. 27 is a cross sectional view when viewed along line XXVII-XXVII in FIG. 26.

The clutch mechanism 122 is formed to connect the discharge valve 12 and the rod 115 when the valve component 114*i* is turned in a second rotational direction B2 (see FIG. 26) opposite to a first rotational direction B1 and the rod 115 is turned in the second rotational direction B2, for example when the state of the communication valve 116 is changed from the open state as illustrated in FIG. 24 to the closed state as illustrated in FIG. 26.

Figure 29:
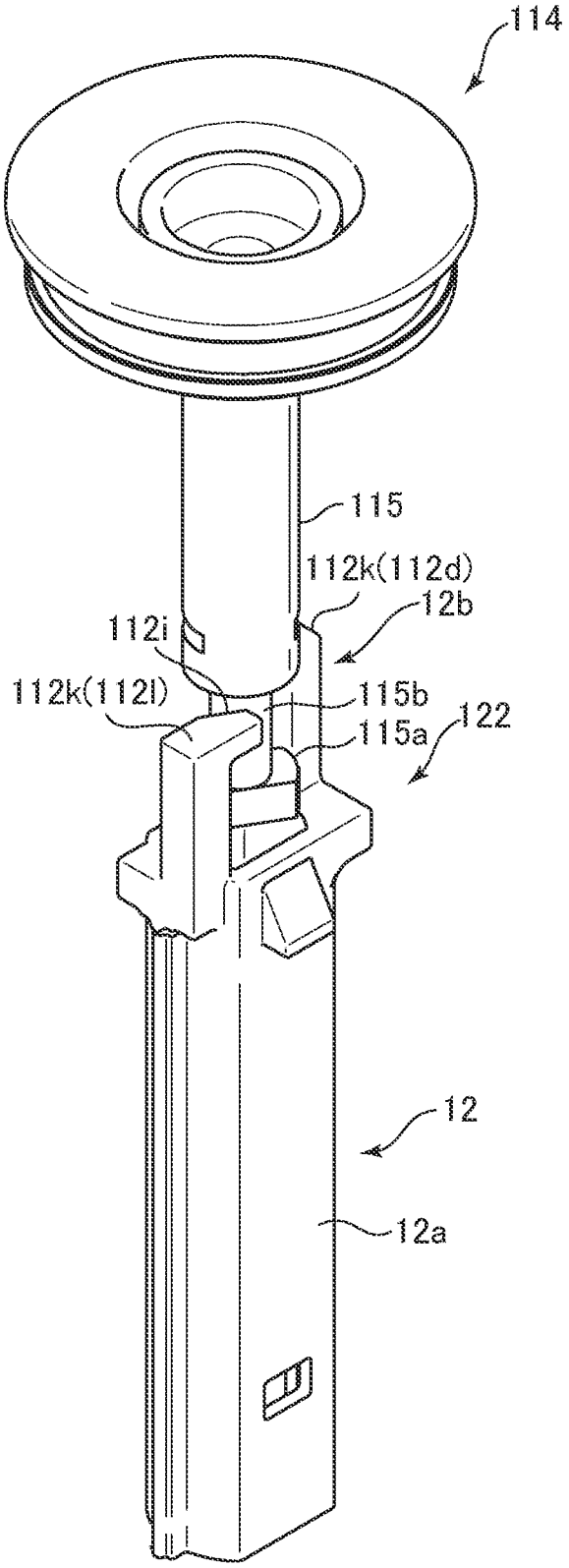
FIG. 29 is a partially enlarged cross sectional view illustrating the clutch mechanism which is in a disengaged state, in the flush water tank apparatus according to the second embodiment of the present invention.

As illustrated in FIGS. 26 and 29, the clutch mechanism 122 is formed to disconnect the discharge valve 12 from the rod 115 when the valve component 114*i* is turned in the first rotational direction B1 with respect to the piston 114*b* and the rod 115 is turned in the first rotational direction B1.

More specifically, the clutch mechanism 122 includes a rod engaging portion 115*a* at a lower end portion of the rod 115 and a valve shaft engaging portion 112*k* at an upper end portion of the valve shaft 12*a* of the discharge valve 12. That is, the rod 115 extends downward from a lower surface of the piston 114*b* of the hydraulic drive portion 114, and the rod engaging portion 115*a* at the lower end portion of the rod 115 forms a part of the clutch mechanism 122. Additionally, the valve shaft engaging portion 112*k* at the upper end portion of the valve shaft 12*a* forms a part of the clutch mechanism 122. When the valve shaft engaging portion 112*k* is engaged with or disengaged from the rod engaging portion 115*a*, the rod 115 and the discharge valve 12 are connected to each other or disconnected from each other.

As illustrated in FIG. 28, the rod engaging portion 115*a* is formed below a rod shaft portion 115*b* in the lower end portion of the rod 115. The rod engaging portion 115*a* is formed into a rectangular parallelepiped shape, and an outer edge thereof is formed to extend outward than the cylindrical rod shaft portion 115*b*.

The valve shaft engaging portion 112*k* includes a first engaging hook portion 112*l* extending upward from a first side portion 112*e* at the upper end portion of the valve shaft 12*a* and thereafter being bent inward in an L shape, and a second engaging hook portion 112*d* extending upward from a second side portion 112*f* facing the first side portion 112*e* and thereafter being bend inward in an L shape. The first engaging hook portion 112*l* is located at a position on a third side portion 112*g* side of the valve shaft 12*a* in the first side portion 112*e* side, and the second engaging hook portion 112*d* is located at a position on a fourth side portion 112*h* side of the valve shaft 12*a* in the second side portion 112*f* side. The third side portion 112*g* and the fourth side portion 112*h* are located on the respective sides of the first side portion 112*e*, and the fourth side portion 112*h* faces the third side portion 112*g*. The valve shaft engaging portion 112*k* forms an engaging portion for engaging with the rod engaging portion 115*a* by the first engaging hook portion 112*l* and the second engaging hook portion 112*d* facing the first engaging hook portion 112*l*.

The first engaging hook portion 112*l* has a first inclined portion 112*i* formed by obliquely notching a lateral portion in the engaging portion extending inward.

The second engaging hook portion 112*d* has a second inclined portion 112*j* (see FIG. 19) formed by obliquely notching a lateral portion in the engaging portion extending inward. The first inclined portion 112*i* and the second inclined portion 112*j* are arranged to face each other, and the first inclined portion 112*i* and the second inclined portion 112*j* extend in parallel to each other. A distance between the first inclined portion 112*i* and the second inclined portion 112*j* is slightly longer than a length of a short side of the rod engaging portion 115*a* and shorter than a length of a long side thereof. Accordingly, as illustrated in FIG. 28, when the rod engaging portion 115*a* rises in the case where the rod engaging portion 115*a* is oriented parallel to the first engaging hook portion 112*l* and the second engaging hook portion 112*d*, the rod engaging portion 115*a* engages with the first engaging hook portion 112*l* and the second engaging hook portion 112*d*, and is connected to the valve shaft engaging portion 112*k* so that the rod engaging portion 115*a* pulls up the valve shaft 12*a*.

On the other hand, as illustrated in FIG. 29, when the rod engaging portion 115*a* is turned to be parallel to the first inclined portion 112*i* of the first engaging hook portion 112*l* and the second inclined portion 112*j* of the second engaging hook portion 112*d*, the rod engaging portion 115*a* passes between the first inclined portion 112*i* and the second inclined portion 112*j*, and the rod engaging portion 115*a* no longer engages with the first engaging hook portion 112*l* and the second engaging hook portion 112*d*, or the engagement is released even when the engagement has been established, whereby the rod engaging portion 115*a* and the valve shaft engaging portion 112*k* are disconnected from each other.

Next, referring to FIGS. 28 and 29, the operation of the clutch mechanism 122 will be described.

First, in the standby state, the discharge valve 12 is seated on a water discharge opening 10*a*, and the clutch mechanism 122 is in the disengaged state (disconnected state) as illustrated in FIG. 29. In the state where the clutch mechanism 122 is in the disengaged state (disconnected state), when being pulled up upward, the rod engaging portion 115*a* is oriented not to engage with the first engaging hook portion 112*l* and the second engaging hook portion 112*d* (or to be restrained from engaging with the first engaging hook portion 112*l* and the second engaging hook portion 112*d* sufficiently enough to pull up the first engaging hook portion 112*l* and the second engaging hook portion 112*d*), for example is oriented to be substantially parallel to the first inclined portion 112*i* and the second inclined portion 112*j* in top plan view.

When the supply of the flush water to the hydraulic drive portion 114 (FIG. 31) is started, the force receiving portion 190 receives the flow of the flush water, whereby the rod 115 is rotated. Accordingly, when being pulled up upward, the rod engaging portion 115*a* is rotated to engage with the first engaging hook portion 112*l* and the second engaging hook portion 112*d* as illustrated in FIG. 28, for example is rotated to be substantially parallel to the first engaging hook portion 112*l* and the second engaging hook portion 112*d* in top plan view. At this time, at an upper side, a clearance C is still present between the rod engaging portion 115*a* and the valve shaft engaging portion 112*k*. When the rod 115 is pulled upward from the state illustrated in FIG. 28, the rod engaging portion 115*a* and the valve shaft engaging portion 112*k* are engaged with each other, whereby the discharge valve 12 is pulled up. When the flush water is supplied to the hydraulic drive portion 114, and the rod 115 is pulled up from the state illustrated in FIG. 28, the valve shaft engaging portion 112*k* is pulled up vertically upward by the rod engaging portion 115*a*. That, is, when the rod 115 is pulled up, the discharge valve 12 is pulled up while maintaining the connection state between the rod engaging portion 115*a* and the valve shaft engaging portion 112*k* (the state where the clutch mechanism 122 is engaged).

When the rod 115 is pulled up by the predetermined distance together with the discharge valve 12 in the state where the clutch mechanism 122 is engaged, the piston 114*b* reaches the second position H2. When the piston 114*b* reaches the second position H2, the valve component 114*i* is turned in the first rotational direction B1, the rod 115 is turned in the first rotational direction B1, and the rod engaging portion 115*a* is turned so that the connection between the rod engaging portion 115*a* and the valve shaft engaging portion 112*k* is released, as illustrated in FIGS. 28 and 29. Accordingly, the engagement between the rod engaging portion 115*a* and the valve shaft engaging portion 112*k* is released, and the engagement of the clutch mechanism 122 is released.

When the engagement of the clutch mechanism 122 is released, the discharge valve 12 is disconnected from the rod 115, and the discharge valve 12 falls and is seated on the water discharge opening 10*a*. In this way, the discharge of the flush water from the reservoir tank 10 into a flush toilet main unit 2 is stopped.

Next, when the supply of the flush water to the hydraulic drive portion 114 is stopped, the piston 114*b* and the rod 115 are lowered. As illustrated in FIG. 29, the rod engaging portion 115*a* is lowered in a rotated state to be lower than the engaging portion at the distal end of the valve shaft engaging portion 112*k*.

When the rod 115 is further lowered, the rod engaging portion 115*a* of the rod 115 contacts a top portion of the valve shaft 12*a*, and is stopped, as illustrated in FIG. 29. At this time, the engagement of the clutch mechanism 122 remains in the released state, and thereafter, the flush water tank apparatus returns to the standby state.

Next, referring to FIGS. 18, 30 to 35 and the like, a sequence of flush operation of the flush water tank apparatus 104 according to the second embodiment of the present invention and the flush toilet apparatus 101 provided with the same will be described.

Figure 30:
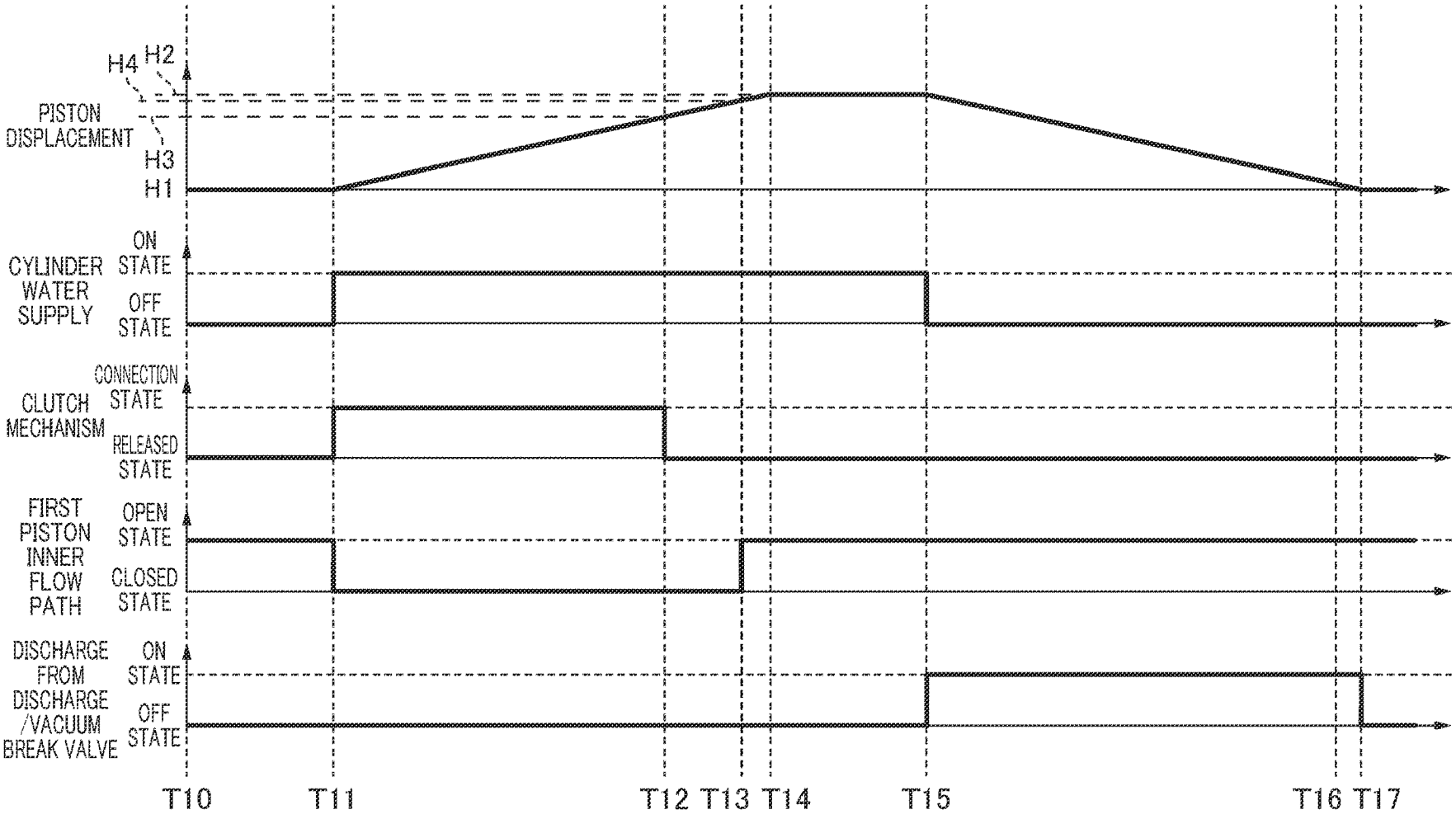
FIG. 30 is a timing chart showing temporal changes in displacement and height position of the piston, a state of cylinder water supply, a state of the clutch mechanism, a state of a first piston inner flow path, and a state of discharge from a discharge/vacuum break valve, in the flush water tank apparatus according to the second embodiment of the present invention.
Figure 31:
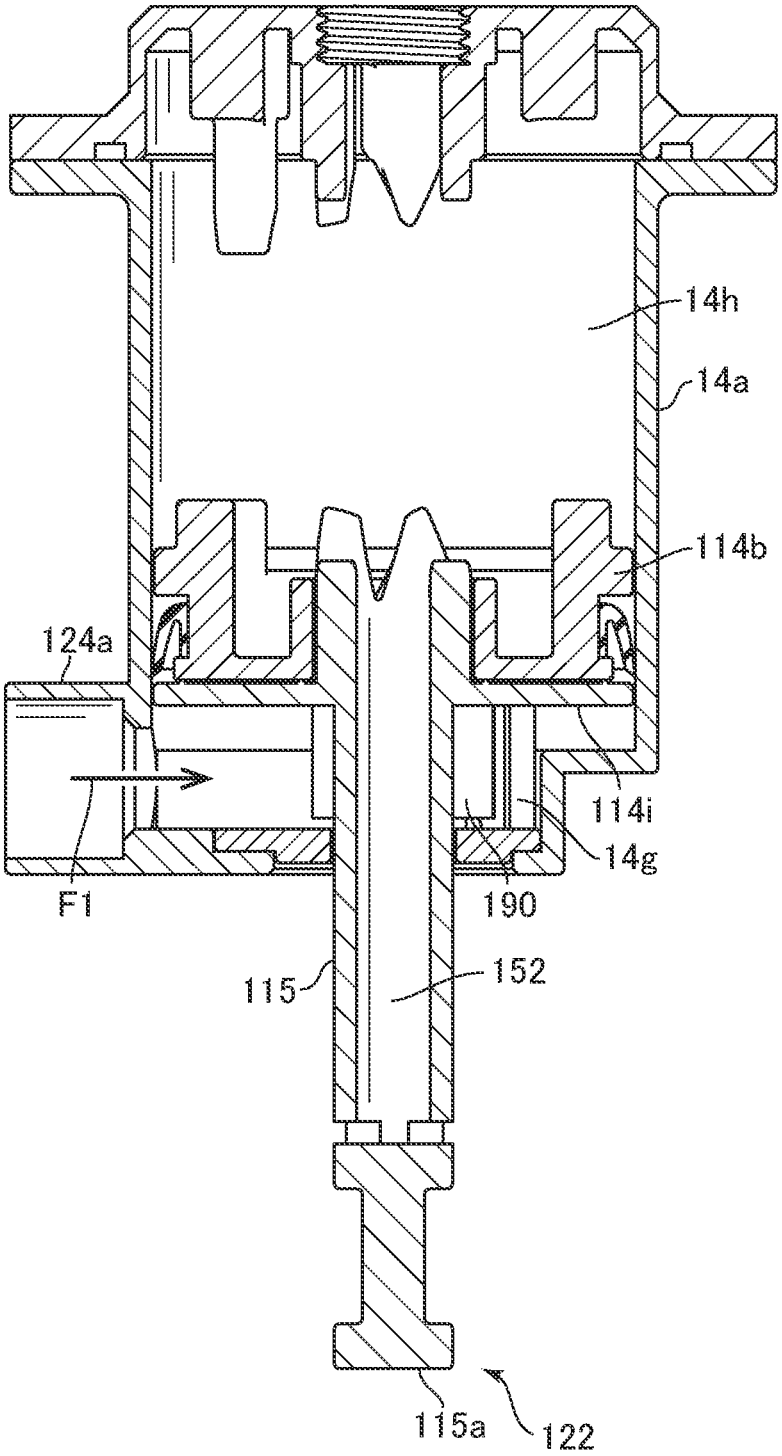
FIG. 31 is a partially enlarged cross sectional view illustrating a state of the hydraulic drive portion at the time of start of the cylinder water supply, in the flush water tank apparatus according to the second embodiment of the present invention.
Figure 32:
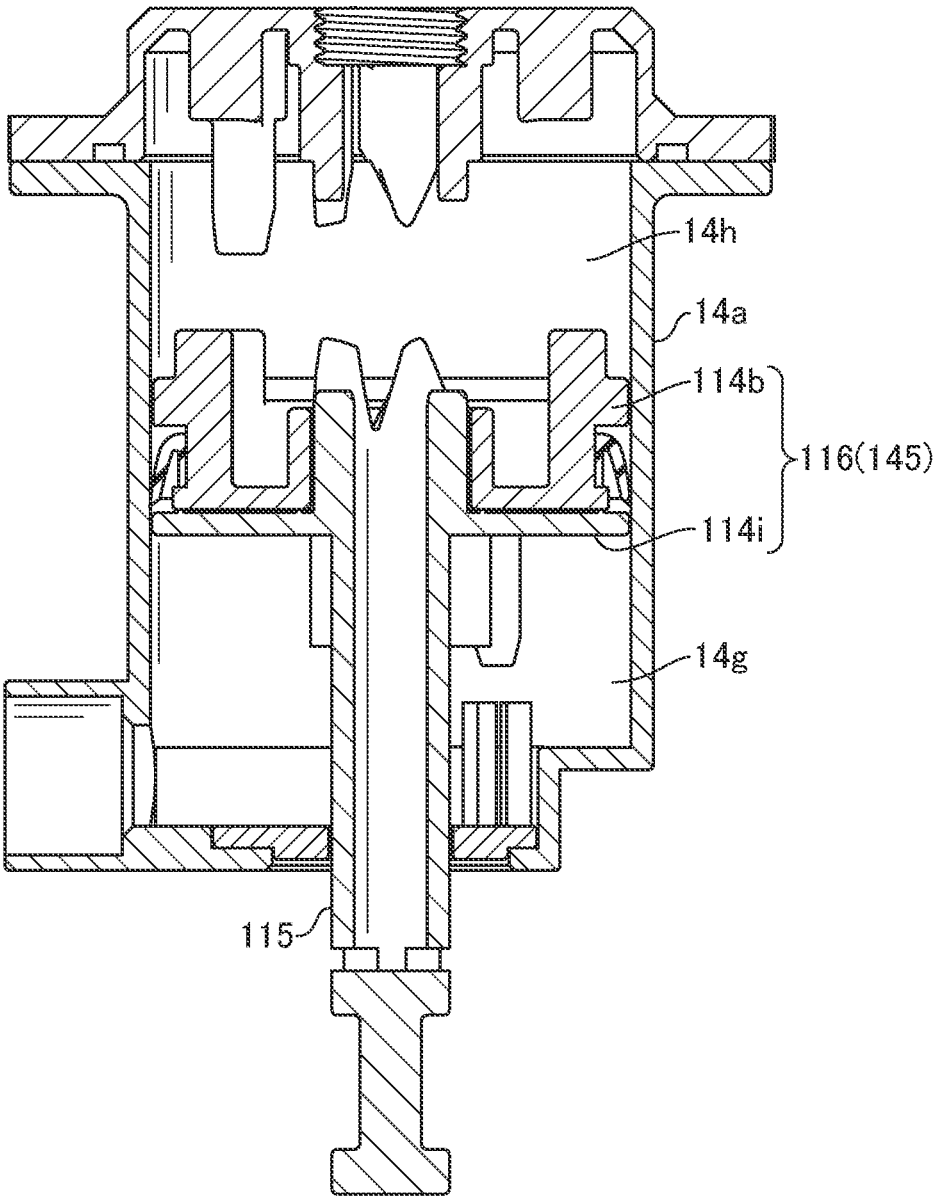
FIG. 32 is a partially enlarged cross sectional view illustrating a state where the piston is rising in the hydraulic drive portion, in the flush water tank apparatus according to the second embodiment of the present invention.
Figure 33:
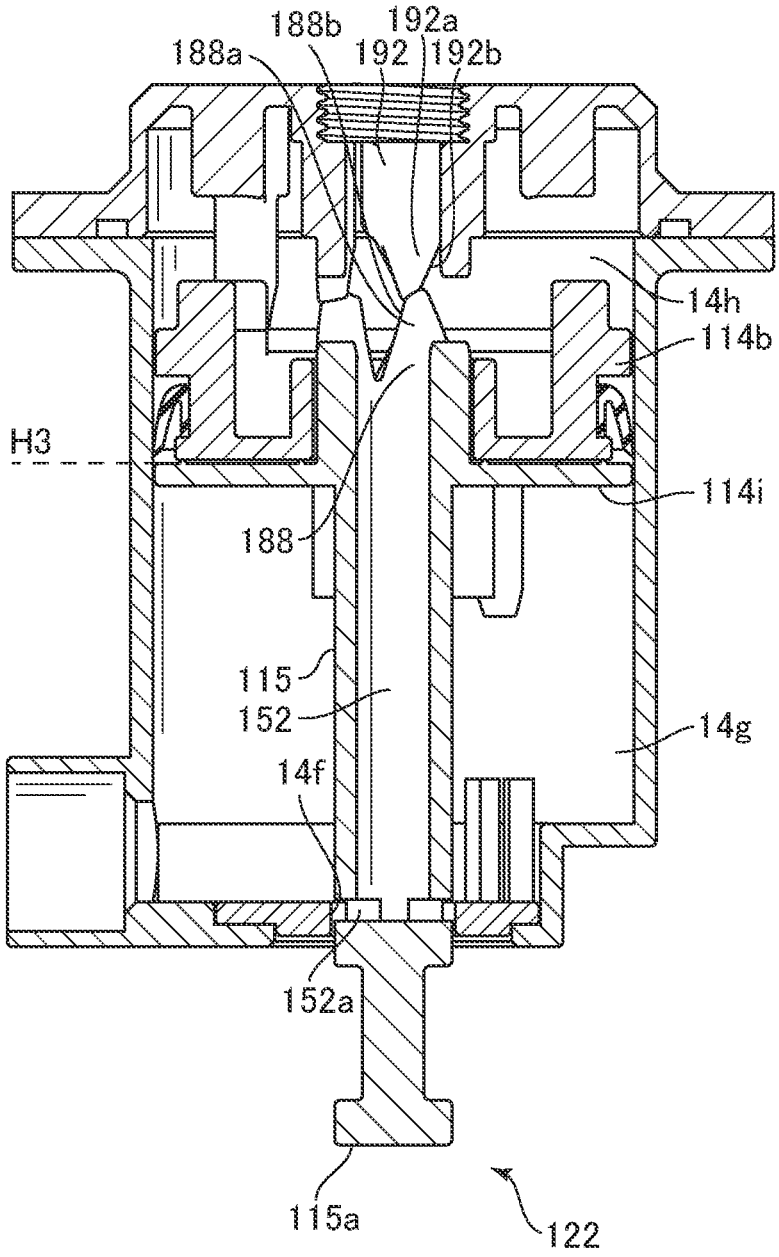
FIG. 33 is a partially enlarged cross sectional view illustrating a state immediately after the contact between a first engaging portion and a second engaging portion is started in the hydraulic drive portion, in the flush water tank apparatus according to the second embodiment of the present invention.

FIG. 30 is a timing chart showing temporal changes in displacement of the piston, a state of cylinder water supply, a state of the clutch mechanism, a state of a first piston inner flow path, and a state of discharge from a discharge/vacuum break valve, in the flush water tank apparatus according to the second embodiment of the present invention. The vertical axis represents changes in the displacement and height position of the piston, the switching between the ON state and the OFF state of the cylinder water supply, the switching between the engaged state and the disengaged state of the clutch mechanism, the switching between the open state and the closed state of the first piston inner flow path, and the switching between the ON state and the OFF state of the discharge from the discharge/vacuum break valve. The horizontal axis represents the lapse of time.

First, in the toilet flush standby state (time T10) illustrated in FIG. 18, the water level in the reservoir tank 10 is a predetermined water level L1 (e.g., full water level). In this state, both of an electromagnetic valve-side pilot valve 50 and a float-side pilot valve 44 of a water supply controller 18 are in the closed state, and the valve seat 40 is closed by a main valve body 38. Accordingly, the water supply from the water supply controller 18 to the hydraulic drive portion 114 is stopped (OFF state). As illustrated in FIG. 19, in the standby state, the piston 114*b* of the hydraulic drive portion 114 is located at the first position H1 in the cylinder 14*a*. The first position H1 is a lower limit position in the movable range of the piston 114*b*. The piston 114*b* is stopped in the cylinder 14*a*. At this time, the piston 114*b* is located above the predetermined water level L1 of the reservoir tank 10. The rod 115 and the discharge valve 12 are stopped at the lowest position, and the clutch mechanism 122 is in the disengaged state (disconnected state).

Figure 25:
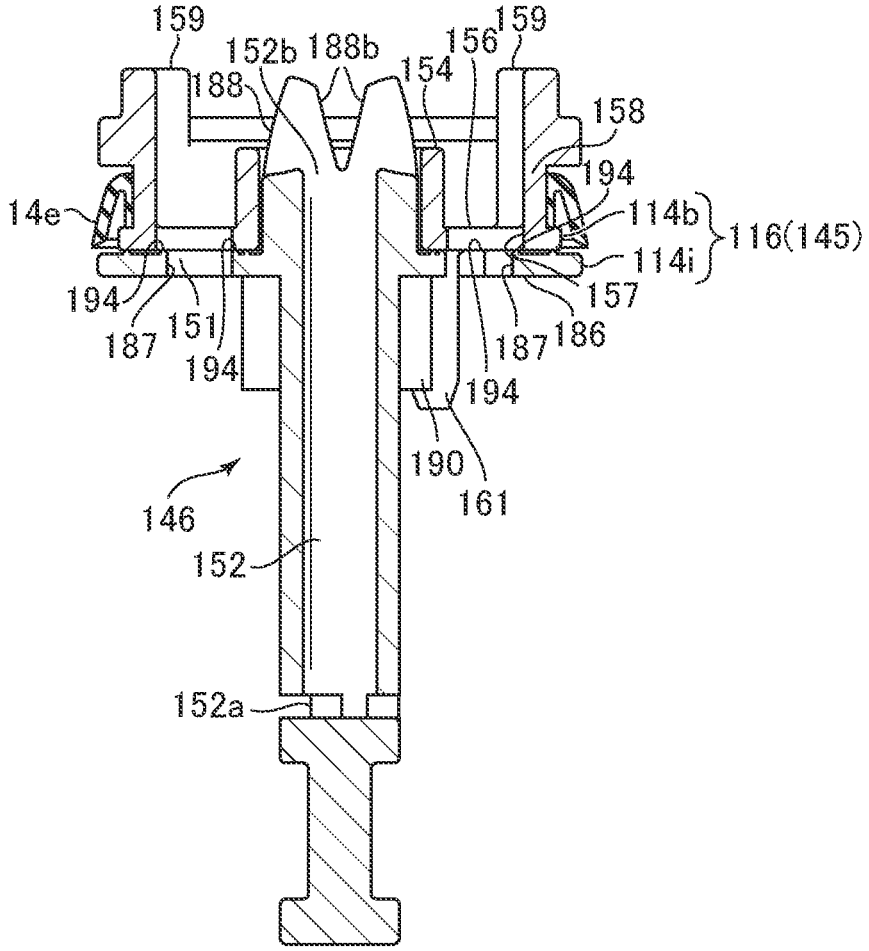
FIG. 25 is a cross sectional view when viewed along line XXV-XXV in FIG. 24.

As illustrated in FIGS. 24 and 25, when the piston 114*b* is located at the first position H1, the valve component-side openings 187 of the valve component 114*i* are located to overlap with the piston openings 157 of the piston 114*b* at substantially the same positions, and the communication valve 116 is in the open state, whereby the first piston inner flow path 151 formed by the first communication mechanism 145 is in the open state. As illustrated in FIG. 19, when the piston 114*b* is located at the first position H1, the inlet portion 152*a* is located outside of the cylinder 14*a* and inside of the reservoir tank 10, whereby the second piston inner flow path 152 formed by the second communication mechanism 146 is in the closed state (the state where the communication between the pressure chamber 14*g* and the back pressure chamber 14*h* is not established). The second piston inner flow path 152 establishes the communication between the back pressure chamber 14*h* and the interior of the reservoir tank 10 outside of the cylinder 14*a*. However, in the standby state, the flush water is not present in the back pressure chamber 14*h* side, and therefore the water is not discharged via the second piston inner flow path 152. In addition, the water that has flowed back from the inflow pipe 24*a* is not discharged from the discharge/vacuum break valve 30 into the reservoir tank 10 (OFF state).

Next, at a time T11, when the user presses a flush button in a remote controller 6, the remote controller 6 transmits a command signal for flushing the toilet to a controller 28. In the flush toilet apparatus 101 of the present embodiment, after an elapse of a predetermined time period after a user's separation from the seat is detected by a human sensor 8, the command signal for flushing the toilet can be transmitted to the controller 28 even without the flush button in the remote controller 6 being pressed.

When receiving the command signal for flushing the toilet, the controller 28 operates an electromagnetic valve 20 (see FIG. 18), and separates the electromagnetic valve-side pilot valve 50 from a pilot valve port. This reduces the pressure inside the pressure chamber 36*a*, the main valve body 38 is separated from the valve seat 40, and the main valve body 38 is opened. When the water supply controller 18 opens the valve, the flush water that has flowed in from the water supply pipe 32 is supplied to the hydraulic drive portion 114 via the water supply controller 18. Hereby, as indicated by an arrow F1 in FIG. 31, the water supply from the inflow pipe 124*a* to the cylinder 14*a* is started, and the cylinder water supply is turned ON. The flush water that has flowed into the cylinder 14*a* from the inflow pipe 124*a* hits on the force receiving portion 190, and the force receiving portion 190 receives the flow of the flush water, thereby rotating the valve component 114*i*. At this time, the valve component 114*i* is turned in the second rotational direction B2 (see FIG. 26) and the rod 115 is turned in the second rotational direction B2, whereby the discharge valve 12 and the rod 115 are connected to each other, resulting in the engaged state. The valve component 114*i* is turned in the second rotational direction B2, for example, within a range from about 15 to 45 degrees, more preferably, by an angle of 30 degrees. Accordingly, the valve component 114*i* is relatively rotated with respect to the piston 114*b*, and the valve component-side openings 187 are located at different positions (positions deviating) from the piston openings 157, respectively. Therefore, the first piston inner flow path 151 is closed, and the communication valve 116 is closed. In this way, in the case where the supply of the flush water to the cylinder 14*a* is started when the piston 114*b* is located at the first position H1, the communication valve 116 is turned from the open state to the closed state.

Accordingly, the piston 114*b* of the hydraulic drive portion 114 is pushed up, the discharge valve 12 is pushed up via the rod 115, and the flush water in the reservoir tank 10 is discharged from the water discharge opening 10*a* to the flush toilet main unit 2. That is, the discharge valve 12 is driven by a drive force of the hydraulic drive portion 114 based on the water supply pressure of tap water supplied via the water supply pipe 32, and is opened. When the discharge valve 12 is opened, the flush water (tap water) stored in the reservoir tank 10 is discharged to a bowl 2*a* of the flush toilet main unit 2 through the water discharge opening 10*a*, whereby the bowl 2*a* is washed. The second piston inner flow path 152 establishes the communication between the back pressure chamber 14*h* and the interior of the reservoir tank 10 outside of the cylinder 14*a*. However, since the flush water is not basically present in the back pressure chamber 14*h* side, the water is not basically discharged via the second piston inner flow path 152. In addition, the water that has flowed back from the inflow pipe 124*a* is not discharged from the discharge/vacuum break valve 30 into the reservoir tank 10 (OFF state).

When the flush water in the reservoir tank 10 is discharged, the water level in the reservoir tank 10 becomes lower than the predetermined water level L1, and therefore a water supply valve float 34 is lowered. Hereby, the arm portion 42 (see FIG. 18) is turned, and the float-side pilot valve 44 is opened. In a state where the float-side pilot valve port (not illustrated) is open, the pressure inside the pressure chamber 36*a* is not increased even when the electromagnetic valve-side pilot valve 50 is closed, and therefore the open state of the main valve body 38 can be maintained. Therefore, when the water level in the reservoir tank 10 is lowered after an elapse of the predetermined time period after the controller 28 energizes the electromagnetic valve 20 to open the main valve body 38, the energization of the electromagnetic valve 20 is stopped. Hereby, the electromagnetic valve-side pilot valve 50 is closed. However, since the float-side pilot valve port is open, the main valve body 38 remains separated from the valve seat 40. That is, the controller 28 can open the main valve body 38 for a long time only by energizing the electromagnetic valve 20 for a short time.

At the time T11, the water supply from the water supply controller 18 to the hydraulic drive portion 114 is started (ON state), and then the flow of the flush water into the pressure chamber 14*g* of the cylinder 14*a* is started. As illustrated in FIG. 30, the flush water that has flowed into the pressure chamber 14*g* of the cylinder 14*a* causes the piston 114*b* to start to rise from the first position H1. When the rise of the piston 114*b* is started, the rod 115 rises together with the piston 114*b*. Since the clutch mechanism 122 is in the engaged state, the rod 115 and the discharge valve 12 are engaged with each other immediately after the pulling-up of the rod 115 is started, and the discharge valve 12 is pulled up.

As illustrated in FIG. 18, between the time T11 and the time T12, in the first communication mechanism 145, the valve component-side openings 187 are located at different positions from the piston openings 157, the first piston inner flow path 151 is in the closed state, and the communication valve 116 is in the closed state. Accordingly, the piston 114*b* is pushed up and moved in the first direction D1 by the flush water that has flowed into the pressure chamber 14*g* of the cylinder 14*a*. In this way, when the piston 114*b* is to be moved (starts to be moved) in the first direction D1, the valve component 114*i* has been moved, and the communication valve 116 is in the closed state.

At a time T12, when the piston 114*b* is pushed up, and accordingly, the rod 115 and the discharge valve 12 are pulled up to the third position H3 which is a predetermined position (see FIG. 33), the first engaging portion 188 starts to contact the second engaging portion 192. The third position H3 is at a height lower than the second position H2. At this time, the sloping surfaces 188*b* of the mountain portions 188*a* of the first engaging portion 188 start to contact the cylinder-side sloping surfaces 192*b* of the cylinder-side mountain portions 192*a* of the second engaging portion 192, whereby the mountain portions 188*a* starts to be turned with respect to the cylinder-side mountain portions 192*a*. That is, the valve component 114*i* is turned in the second rotational direction B2, so that the connection between the rod engaging portion 115*a* and the valve shaft engaging portion 112*k* is released. Hereby, the engagement between the rod engaging portion 115*a* and the valve shaft engaging portion 112*k* is released, and the engagement of the clutch mechanism 122 is released. Accordingly, the discharge valve 12 is disconnected from the rod 115, and the discharge valve 12 starts to fall. Hereby, the rod 115 remains pushed up upward together with the piston 114*b*, while the discharge valve 12 falls by its own weight. An engaging projection 12*l* (see FIG. 19) of the disconnected discharge valve 12 is engaged with an engaging portion 26*b* (see FIG. 18) of a discharge valve float mechanism 26, thereby stopping the fall of the discharge valve 12. Hereby, the water discharge opening 10*a* of the reservoir tank 10 remains open, and the water discharge from the reservoir tank 10 is continued.

Here, when the water level in the reservoir tank 10 is lowered to a second predetermined water level that is lower than the predetermined water level L1, a float portion 26*a* (see FIG. 20) of the discharge valve float mechanism 26 is lowered, which causes the engaging portion 26*b* to move to the disengagement position indicated by an imaginary line in FIG. 20. Hereby, the engagement between the engaging projection 12*l* of the discharge valve 12 and the engaging portion 26*b* is released, and the discharge valve 12 starts to be lowered again. Then, the discharge valve 12 closes the water discharge opening 10*a* of the reservoir tank 10 to stop the discharge of the flush water to the flush toilet main unit 2. Since the valve seat 40 in the water supply controller 18 is in the open state even after the water discharge opening 10*a* is closed, the water supplied from the water supply pipe 32 flows into the hydraulic drive portion 114, and the water that has flowed out from the hydraulic drive portion 114 flows into the reservoir tank 10 through the outflow pipe 124*b*, whereby the water level in the reservoir tank 10 rises.

At a time T13, the valve component 114*i* is turned in the first rotational direction B1, and the valve component-side openings 187 of the valve component 114*i* are located to overlap with the piston openings 157 at substantially the same positions, respectively. Hereby, the communication valve 116 is in the open state. Accordingly, the first piston inner flow path 151 for establishing the communication between the pressure chamber 14*g* and the back pressure chamber 14*h* is formed and is in the open state. Therefore, the flush water flows out from the pressure chamber 14*g* to the back pressure chamber 14*h* via the first piston inner flow path 151, and flows out from the back pressure chamber 14*h* into the outflow pipe 124*b*. When the communication valve 116 is in the open state, the piston 114*b* is located at a fourth position H4 (see FIG. 30).

The inlet portion 152*a* reaches an opening position in the pressure chamber 14*g* substantially at the same time as when the communication valve 116 is opened. Therefore, the second piston inner flow path 152 for establishing the communication between the pressure chamber 14*g* and the back pressure chamber 14*h* is also formed, and is turned to the open state. Accordingly, the flush water flows into the second piston inner flow path 152 from the pressure chamber 14*g* via the inlet portion 152*a*, flows out from the second piston inner flow path 152 to the back pressure chamber 14*h* through the exit portion 152*b*, and then flows out from the back pressure chamber 14*h* into the outflow pipe 124*b*. The fourth position H4 is located at a position higher than the third position H3 and slightly lower than the second position H2. That is, the disengagement of the clutch mechanism 122 and the communication between the pressure chamber 14*g* and the outflow pipe 124*b* established by the first communication mechanism 145 (or the second communication mechanism 146) are performed according to the displacement of the piston 114*b*, and the fourth position H4 is a communication position where the communication between the pressure chamber 14*g* and the outflow pipe 124*b* is established by the first communication mechanism 145 (the second communication mechanism 146), the communication position being located on a side closer to the second position H2 than the disengagement position (the third position H3) where the clutch mechanism 122 is disengaged. When the piston 114*b* is located between the fourth position H4 and the second position H2, the inlet portion 152*a* opens to the pressure chamber 14*g*, and the second piston inner flow path 152 forms a flow path for establishing the communication between the pressure chamber 14*g* and the back pressure chamber 14*h*. Even after the time T13, the water supply of the flush water into the pressure chamber 14*g* is continued, and the piston 114*b* and the rod 115 continuously rise even after the clutch mechanism 122 is disengaged. The clutch mechanism 122 is in the disengaged state. The piston 114*b* and the rod 115 rise while the valve component 114*i* is turned. In addition, the water that has flowed back from the inflow pipe 124*a* is not discharged from the discharge/vacuum break valve 30 into the reservoir tank 10 (OFF state).

At a time T14, as illustrated in FIG. 34, when the piston 114*b* is further pushed up to reach the second position H2, the piston 114*b* is stopped in a state where the back pressure chamber-side projecting portion 159 contacts a projecting portion 114*m* which is a protrusion projecting from an end portion 14*k* on the distal side of the cylinder 14*a*. At this time, the first engaging portion 188 of the piston 114*b* is in an engaged state with the second engaging portion 192 of the cylinder 14*a*. Accordingly, the turning of the valve component 114*i* is stopped at a predetermined position where the communication valve 116 is in the open state, as illustrated in FIG. 24. Even in a state where the piston 114*b* contacts the projecting portion 114*m* and is stopped, a space is still formed in the back pressure chamber 14*h*. The projecting portion 114*m* contacts the piston 114*b* to restrict the vertical sliding of the piston 114*b* to the second position H2. The projecting portion 114*m* is formed radially outside of the water discharge opening and in a region in the cylinder. The projecting portion 114*m* forms a vertical wall. The projecting portion 114*m* also forms a vertical wall surface so that the flush water flowing into the back pressure chamber 14*h* easily flows from the projecting portion 114*m* to the water discharge opening side. In the state where the supply of the flush water into the cylinder 14*a* is maintained even after the piston 114*b* has reached the second position H2, the first communication mechanism 145 (or the second communication mechanism 146) maintains the communication between the pressure chamber 14*g* and the outflow pipe 24*b*.

The second position H2 is a position on the most distal side from the first position H1 in the cylinder 14*a*, e.g., a highest position. At this time, the water supply of the flush water into the pressure chamber 14*g* is continued, and the piston 114*b* continuously receives a pushing pressure. However, the back pressure chamber-side projecting portion 159 contacts the projecting portion 114*m* not to be further pushed up, and is stopped. Since the first piston inner flow path 151 is in the open state, the flush water flows out from the pressure chamber 14*g* into the back pressure chamber 14*h* via the first piston inner flow path 151, and flows out from the back pressure chamber 14*h* into the outflow pipe 124*b*. Additionally, since the second piston inner flow path 152 is in the open state, the flush water flows in the second piston inner flow path 152 from the pressure chamber 14*g* via the inlet portion 152*a*, flows out from the second piston inner flow path 152 into the back pressure chamber 14*h* through the exit portion 152*b*, and flows out from the back pressure chamber 14*h* into the outflow pipe 124*b*. Accordingly, the water pressure on the pressure chamber 14*g* side is substantially equal to the water pressure on the back pressure chamber 14*h* side. Since a part of the flush water that has flowed out into the outflow pipe 24*b* flows into the reservoir tank 10, the water level in the reservoir tank 10 rises. The clutch mechanism 22 is in the disengaged state. Additionally, the water that has flowed back from the inflow pipe 124*a* is not discharged from the discharge/vacuum break valve 30 into the reservoir tank 10 (OFF state).

At a time T15, when the water level of the flush water in the reservoir tank 10 rises to the predetermined water level L1, the water supply valve float 34 (see FIG. 18) rises, and the float-side pilot valve 44 is moved via the arm portion 42, whereby the float-side pilot valve 44 is closed. Hereby, the float-side pilot valve port (not illustrated) and the pilot valve port (not illustrated) of the main valve body 38 are closed, and therefore, the pressure inside the pressure chamber 36*a* is increased, and the main valve body 38 is seated on the valve seat 40. As a result, the water supply from the water supply controller 18 to the cylinder 14*a* of the hydraulic drive portion 114 is stopped, whereby the OFF state is created. Since the supply of the flush water into the pressure chamber 14*g* is stopped and a pushing-up force of the piston 114*b* is reduced, the piston 114*b* of the hydraulic drive portion 114 is gradually pushed down by the gravity. When the piston 114*b* moves in the second direction D2, the valve component 114*i* is relatively moved with respect to the piston 114*b*, whereby the communication valve 116 is opened. The direction in which the valve component 114*i* is relatively moved with respect to the piston 114*b* to turn the communication valve 116 to the open state is a direction different from the second direction D2 which is a moving direction of the piston 114*b*.

At the time T15, the first piston inner flow path 151 and the second piston inner flow path 152 form flow paths for establishing the communication between the pressure chamber 14*g* and the back pressure chamber 14*h*. However, since the inlet portion 152*a* is lowered to a position facing the inner wall of the through hole 14*f* from the interior of the pressure chamber 14*g* immediately after the piston 114*b* starts to be lowered, the second piston inner flow path 152 is closed. However, since the valve component 114*i* moves toward the first position H1 in the cylinder 14*a* with being hardly turned, the first piston inner flow path 151 still remains in the open state. That is, when the piston 114*b* moves toward the first position H1, the communication valve 116 is maintained in the open state. Accordingly, the piston 114*b* can easily move toward the first position H1 in the cylinder 14*a*. Thereafter, the piston 114*b* and the rod 115 are continuously lowered. The clutch mechanism 22 is in the disengaged state.

At the time T15, when the water supply from the water supply controller 18 to the cylinder 14*a* is stopped, the water that has flowed back from the inflow pipe 124*a* starts to be discharged from the discharge/vacuum break valve 30 into the reservoir tank 10, and the discharge state (ON state) is created in which the flush water in the pressure chamber 14*g* is discharged from the discharge/vacuum break valve 30 into the reservoir tank 10 via the inflow pipe 124*a*.

At a time T16, the lower end of the rod 115 is lowered to the vicinity of the upper end of the valve shaft 12*a*. The rod engaging portion 115*a* of the rod 115 passes between the first inclined portion 112*i* and the second inclined portion 112*j*, and is lowered. At this time, the rod engaging portion 115*a* is in a state of being parallel to the first inclined portion 112*i* and the second inclined portion 112*j*, and the connection between the rod engaging portion 115*a* and the valve shaft engaging portion 112*k* is released. Since the second piston inner flow path 152 forms a flow path for connecting the back pressure chamber 14*h* and the interior of the reservoir tank 10 outside of the cylinder 14*a*, the flush water in the back pressure chamber 14*h* is efficiently discharged into the reservoir tank 10, whereby the piston 114*b* can be operated efficiently.

At a time T17, the rod 115 is further lowered, and the rod engaging portion 115*a* contacts the top portion of the valve shaft 12*a*, and is stopped (see FIG. 29). At this time, the rod engaging portion 115*a* is in a state of being parallel to the first inclined portion 112*i* and the second inclined portion 112*j*, and the connection between the rod engaging portion 115*a* and the valve shaft engaging portion 112*k* is released. In this way, the attitude of the clutch mechanism 122 returns to the standby state. At this time, as illustrated in FIG. 19, the lowering operation of the piston 114*b* is terminated, and the piston 114*b* returns to the first position H1 in the cylinder 14*a*. During the times T15 to T17, the water supply from the water supply controller 18 to the cylinder 14*a* is stopped. During the times T15 to T17, the first piston inner flow path 151 is in the open state. Additionally, during the times T15 to T17, the flush water in the pressure chamber 14*g* is discharged from the discharge/vacuum break valve 30 into the reservoir tank 10 via the inflow pipe 124*a*, flows out from a gap 14*d* between the inner wall of the through hole 14*f* in the cylinder 14*a* and the rod 115, and then flows into the reservoir tank 10. Thus, one toilet flush operation is completed, and the flush toilet apparatus 101 returns to the standby state of the toilet flush operation.

The embodiments for carrying out the present invention are not limited to the embodiments described above, and still another modification example can be applied.

For example, in the hydraulic drive portion 114 of the second embodiment of the present invention, the rod 115 may be connected to the piston 114*b*. In connection with this modification example, the same reference symbols will be applied to components the same as those in the second embodiment, and the description thereof is omitted.

Figure 36:
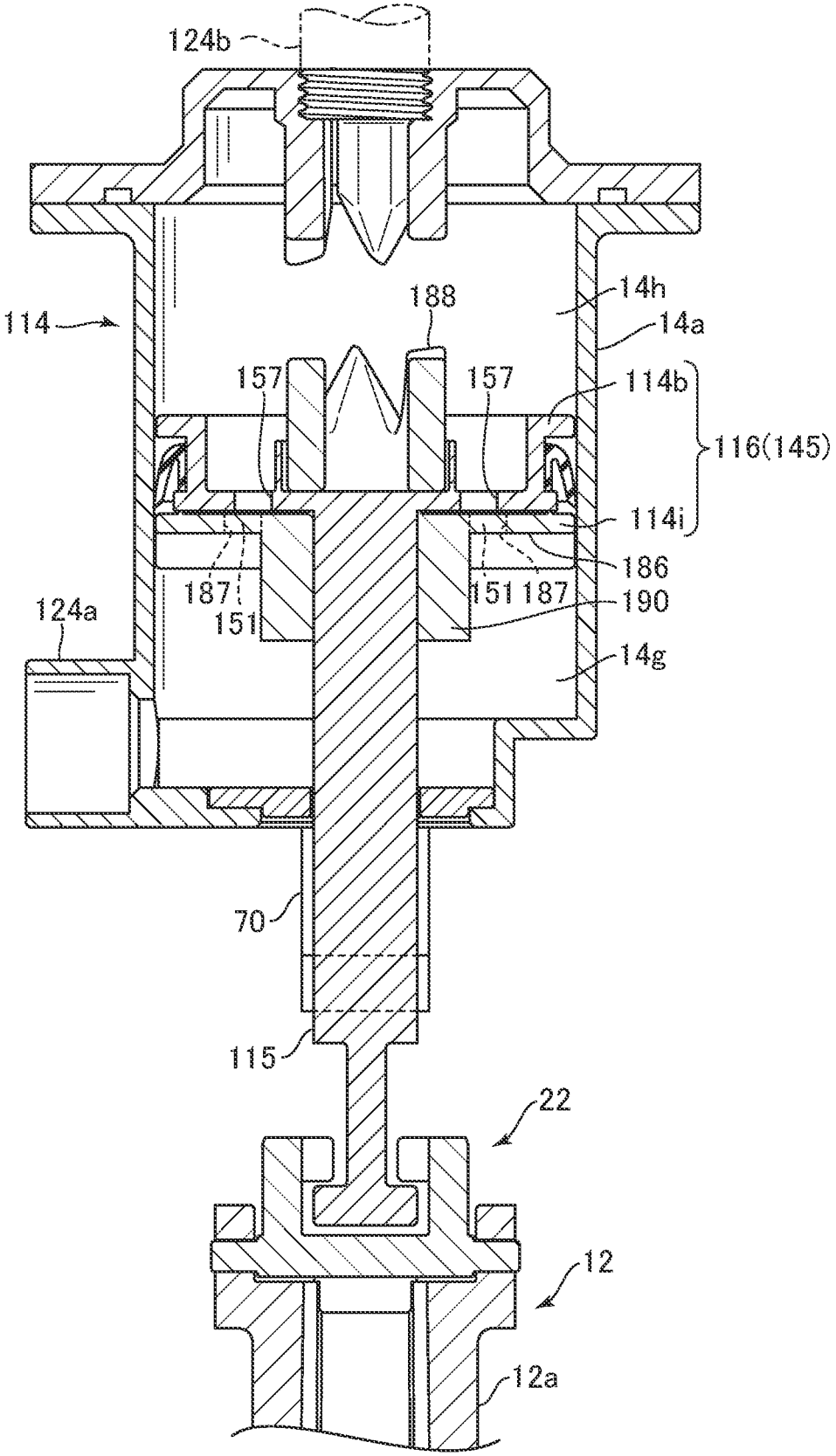
FIG. 36 is a perspective view illustrating a modification example of the hydraulic drive portion in the flush water tank apparatus according to the second embodiment of the present invention.

FIG. 36 is a schematic sectional view illustrating a modification example of the hydraulic drive portion of the second embodiment of the present invention. FIG. 36 illustrates a state where a communication valve 116 is in the closed state and a piston 114*b* is rising.

A rod 115 is connected not to a valve component 114*i* but to a piston 114*b*. Since the rod 115 is connected to the piston 114*b*, the rod 115 is formed not to be turned along with the turning of the valve component 114*i*. Also in this modification example, a hydraulic drive portion 114 further includes a first communication mechanism 145 for establishing the communication between a pressure chamber 14*g* and an outflow pipe 124*b* after a clutch mechanism 22 is disengaged. When valve component-side openings 187 (not illustrated) are located at the same positions as piston openings 157, respectively, the first communication mechanism 145 forms a first piston inner flow path 151 for establishing the communication between the pressure chamber 14*g* and the back pressure chamber 14*h*, to thereby turn the communication valve 116 to the open state and establish the communication between the pressure chamber 14*g* and the outflow pipe 124*b* via the first piston inner flow path 151 and the back pressure chamber 14*h*.

On the other hand, when the valve component-side openings 187 are located at different positions from the piston openings 157, respectively, the first communication mechanism 145 causes the first piston inner flow path 151 for establishing the communication between the pressure chamber 14*g* and the back pressure chamber 14*h* to be turned to the state of not being formed (the closed state), whereby the communication valve 116 is closed.

In this modification example, a second piston inner flow path 152 for establishing the communication between the interior of the rod 115 and the interior of the first engaging portion 188 is not formed. That is, the hydraulic drive portion 114 has a structure that does not include the second communication mechanism 146 for establishing the communication between the pressure chamber 14*g* and the outflow pipe 124*b* after the clutch mechanism 22 is disengaged. In this way, the hydraulic drive portion 114 includes the first communication mechanism 145 and not including the second communication mechanism 146.

In this modification example, the rod 115 is not turned as described above. Accordingly, the clutch mechanism 22 for connecting the discharge valve 12 and the rod 115 consists of a clutch mechanism that is not based on the rotation operation around the central axis of the rod 115 as described in the first embodiment. Such a clutch mechanism 22 is provided in a connection portion between the lower end of the rod 115 and the discharge valve 12, the rod 115 and the discharge valve 12 are connected by the clutch mechanism 22, and the connection between the rod 115 and the discharge valve 12 is released at a predetermined timing. The clutch mechanism 22 is configured to disconnect the valve shaft 12*a* of the discharge valve 12 from the rod 115 by a restricting portion 70 when the discharge valve 12 is lifted up to a predetermined position. In the state where the clutch mechanism 22 is disengaged, the discharge valve 12 ceases to move in association with the movement of the piston 114*b* and the rod 115, and falls by gravity while resisting buoyancy.

In the second embodiment, the valve component 114*i* is configured to be relatively rotated with respect to the piston 114*b*. However, as another modification example, it is only required that the valve component 114*i* is configured to be relatively moved with respect to the piston 114*b*. For example, the valve component 114*i* may be configured to be relatively translated with respect to the piston 114*b*.

Therefore, when the valve component-side openings 187 are located at the same positions as the piston openings 157, respectively, by translating the valve component 114*i* relatively with respect to the piston 114*b*, the first communication mechanism 145 forms the first piston inner flow path 151 for establishing the communication between the pressure chamber 14*g* and the back pressure chamber 14*h*, to thereby turn the communication valve 116 to the open state and establish the communication between the pressure chamber 14*g* and the outflow pipe 124*b* via the first piston inner flow path 151 and the back pressure chamber 14*h*.

On the other hand, when the valve component-side openings 187 are located at different positions from the piston openings 157, respectively, by translating the valve component 114*i* relatively with respect to the piston 114*b*, the first communication mechanism 145 causes the first piston inner flow path 151 for establishing the communication between the pressure chamber 14*g* and the back pressure chamber 14*h* to be turned to the closed state and the state of not being formed, whereby the communication valve 116 is closed.

Additionally, in such another modification example, the valve component 114*i* may be configured to move to separate from the piston 114*b* while relatively translating with respect to the piston 114*b*. When the valve component 114*i* moves to separate from the piston 114*b* while relatively translating with respect to the piston 114*b*, the first communication mechanism 145 forms a switching structure at each position before and after the movement, to turn the communication valve 116 (i.e., the first piston inner flow path 151) to the open state or the closed state. In this way, the valve component 114*i* can cause the communication valve 116 to be turned to the open state or the closed state not only by turning the valve component 114*i* with respect to the piston 114*b* but also by moving the valve component 114*i* with respect to the piston 114*b*.

According to the above-described flush water tank apparatus 104 according to the second embodiment of the present invention, the first communication mechanism 145 and/or the second communication mechanism 146 establishes the communication between the pressure chamber 14*g* and the outflow pipe 124*b* after the disengagement of the clutch mechanism 122. This causes the flush water in the pressure chamber 14*g* to flow out into the outflow pipe 124*b* with a relatively simple configuration in which an additional electromagnetic valve is not required, which enables the pressure of the flush water in the pressure chamber 14*g* to be easily reduced and enables the piston 114*b* to easily return from the second position H2 to the first position H1 side. Additionally, it is possible to restrain the pulling-up of the discharge valve 12 until the disengagement of the clutch mechanism 122 from being obstructed by the communication between the pressure chamber 14*g* and the outflow pipe 124*b*. Moreover, the pulling-up of the discharge valve 12 until the disengagement of the clutch mechanism 122 enables the water to be discharged from the water discharge opening of the reservoir tank 10 in a predefined manner. Furthermore, since the clutch mechanism 122 is disengaged at a predetermined timing in a predefined manner, it is possible to reduce an influence on the operation of the float mechanism 26 that is to be moved according to the water level in the reservoir tank 10, thereby facilitating a predefined operation. Furthermore, since the piston 114*b* easily returns from the second position H2 to the first position H1 side, a time period until the discharge valve 12 is closed can be reduced and a time period until one flush operation is completed can be made relatively short.

Additionally, according to the above-described flush water tank apparatus 104 according to the second embodiment of the present invention, when the piston 114*b* moves toward the first position, the communication valve 116 is maintained in the open state. Accordingly, when the piston 114*b* moves toward the first position, the flush water can flow out from the pressure chamber 14*g* to the back pressure chamber via the piston inner flow path, and the movement speed of the piston 114*b* moving toward the first position can be increased.

Additionally, according to the above-described flush water tank apparatus 104 according to the second embodiment of the present invention, when the piston 114*b* is located at the first position H1, the communication valve 116 is in the open state. Accordingly, when the piston 114*b* is located at the first position H1, the flush water can flow out from the back pressure chamber 14*h* to the pressure chamber 14*g* via the first piston inner flow path 151, and the remaining flush water in the back pressure chamber 14*h* can be discharged more reliably and relatively quickly.

Additionally, according to the above-described flush water tank apparatus 104 according to the second embodiment of the present invention, in the case where the supply of the flush water to the cylinder 14*a* is started when the piston 114*b* is located at the first position H1, the communication valve 116 is turned from the open state to the closed state. Accordingly, it is possible to suppress the impact received by the piston 114*b* when the supply of the flush water to the cylinder 14*a* is started, and further to, after the supply start of the flush water, move the piston 114*b* to the second position H2 by effectively using the pressure of the flush water that has flowed into the pressure chamber 14*g*.

Furthermore, the second embodiment of the present invention provides the flush toilet apparatus 101 that includes a flush toilet main unit 2 and a flush water tank apparatus 104 capable of reducing a pressure of flush water in a pressure chamber 14*g* easily.

Next, referring to FIGS. 37 to 44, a flush toilet apparatus according to a third embodiment of the present invention will be described.

A flush toilet apparatus 201 according to the third embodiment has substantially the same structure as that of the above-described flush toilet apparatus according to the first embodiment. The following describes mainly the points that are different between the third embodiment and the first embodiment of the present invention. Similar portions are denoted by the same reference symbols in the drawings or the specification, and are not described.

Figure 37:
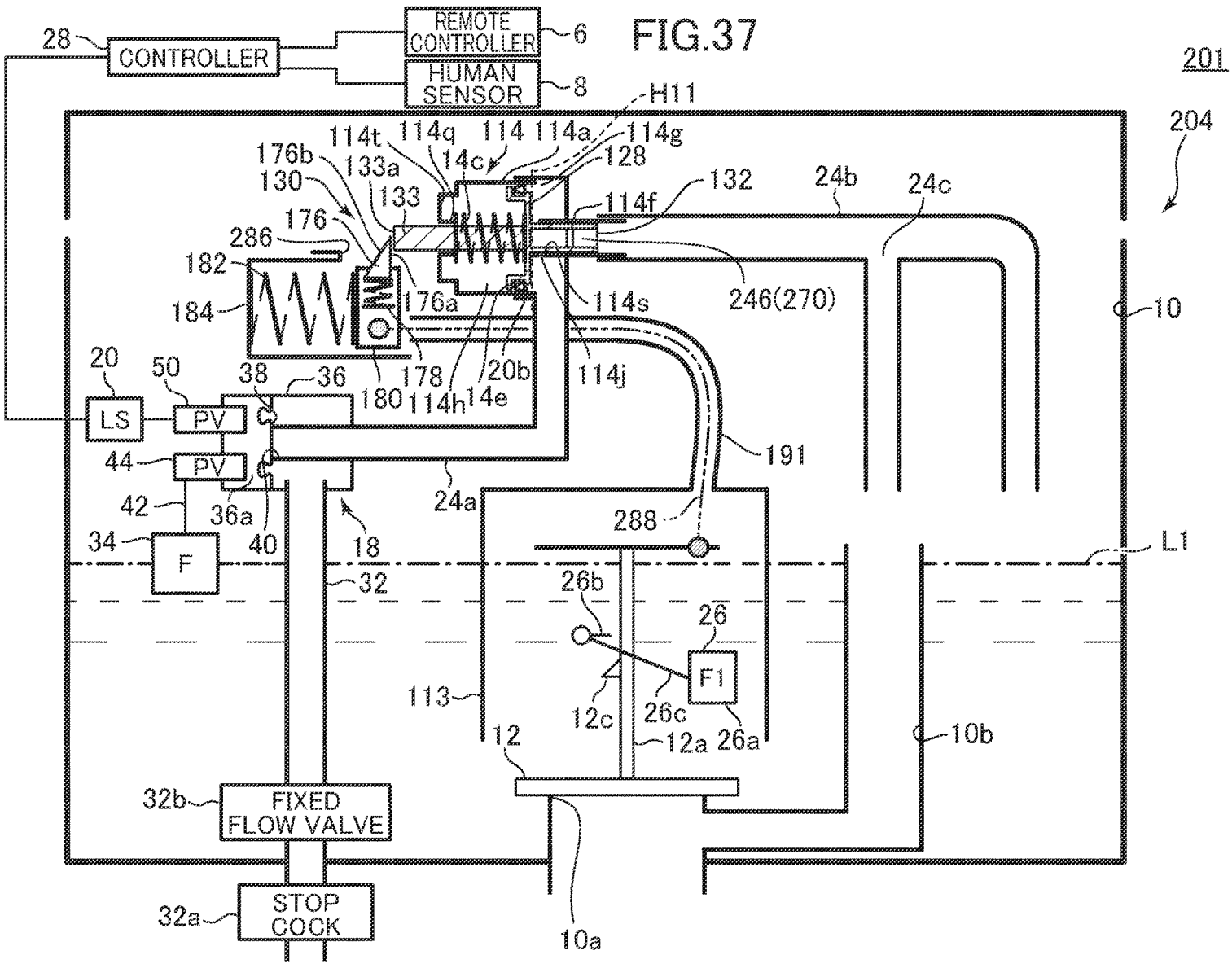
FIG. 37 is a schematic sectional view illustrating a schematic configuration of a flush water tank apparatus according to a third embodiment of the present invention.
Figure 38:
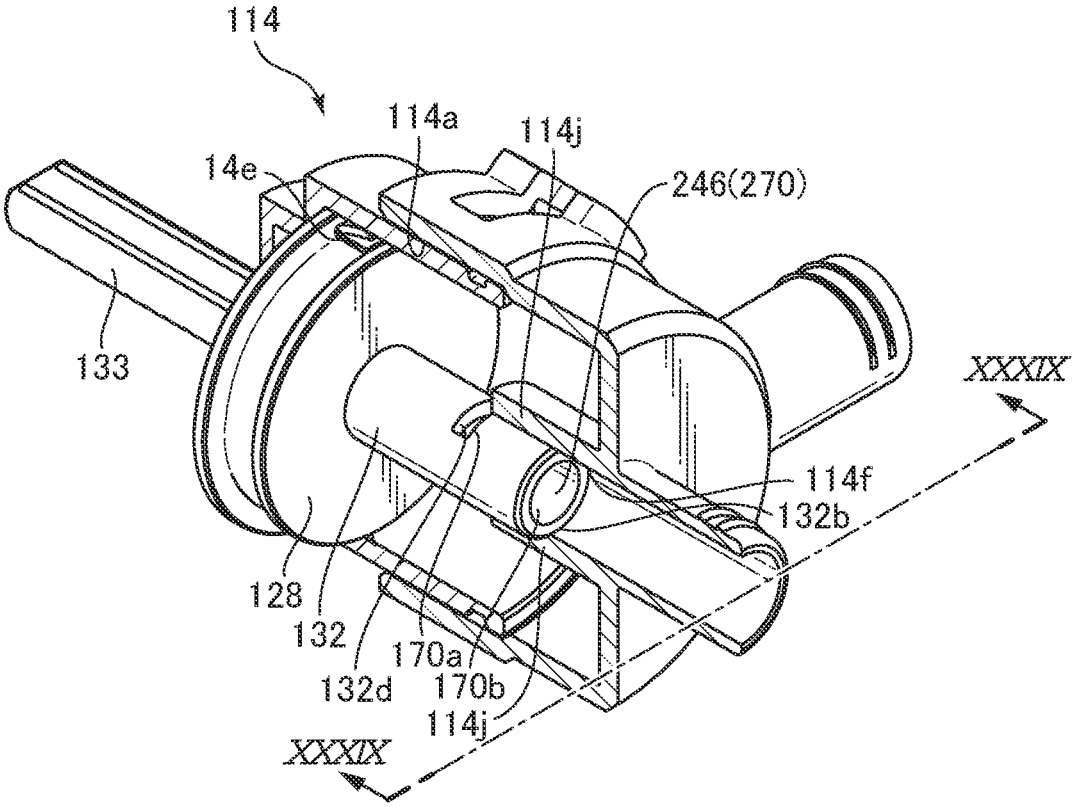
FIG. 38 is a schematic perspective view illustrating an internal structure of a discharge valve hydraulic drive portion provided in the flush water tank apparatus according to the third embodiment of the present invention.

As illustrated in FIG. 37, the flush toilet apparatus 201 according to the third embodiment of the present invention includes a flush water tank apparatus 204 according to the third embodiment of the present invention, which is mounted at a rear portion of a flush toilet main unit 2. The flush water tank apparatus 204 according to the present embodiment is configured to discharge the flush water stored therein to the flush toilet main unit 2 based on a command signal from a remote controller 6 or a human sensor 8, so that a bowl 2*a* is washed with the flush water.

The flush water tank apparatus 204 includes a discharge valve hydraulic drive portion 114 which is a discharge valve pull-up portion configured to pull up a discharge valve 12. The flush water tank apparatus 204 includes therein a water supply controller 18 configured to control water supply from tap water to the discharge valve hydraulic drive portion 114.

The flush water tank apparatus 204 further includes a clutch mechanism 130 configured to connect the discharge valve 12 and the discharge valve hydraulic drive portion 114 to pull up the discharge valve 12 by a drive force of the discharge valve hydraulic drive portion 114, and to be disengaged at a predetermined timing to cause the discharge valve 12 to fall. The clutch mechanism 130 is provided forward in a moving direction of a second rod 133 extending laterally from the discharge valve hydraulic drive portion 114, and is configured to connect and disconnect an operating portion of the second rod 133 to and from a passive portion 176 of the clutch mechanism 130 which is connected to the discharge valve 12. The clutch mechanism 130 is formed separately from a casing 113 of the discharge valve 12, and is disposed away from the outside of the casing 113.

The clutch mechanism 130 includes an operating portion 133*a* that is located at a distal end of the second rod 133, the passive portion 176 that is provided on an extension in the moving direction of the second rod 133 extending laterally from the discharge valve hydraulic drive portion 114, a passive portion elastic member 178 that is connected to the passive portion 176, a first support 180 that supports the passive portion 176 and the passive portion elastic member 178, a support elastic member 182 that is connected to the first support 180, a second support 184 that supports the support elastic member 182, and a restricting portion 286 that restricts the movement of a predetermined distance or longer of the passive portion 176 in the moving direction of the second rod 133 and moves the passive portion 176 to the passive portion elastic member 178 side.

The operating portion 133*a* is formed to contact a first plane 176*a* of the passive portion 176. The first plane 176*a* extends in a direction perpendicular to the moving direction of the second rod 133. Accordingly, the first plane 176*a* is located in front of the operating portion 133*a* when the passive portion elastic member 178 is in a natural length state. Therefore, when the second rod 133 moves toward the passive portion 176, the operating portion 133*a* of the second rod 133 presses the first plane 176*a*, and the second rod 133 and the passive portion 176 move together laterally. When the passive portion 176 and the first support 180 move, the discharge valve 12 is pulled up by a connection member 288 as described later. The support elastic member 182 expands or contracts laterally, for example, in the moving direction of the second rod 133. The first support 180 is connected to the support elastic member 182, and is adapted to move in an expanding and contracting direction of the support elastic member 182.

The passive portion 176 has an inclined surface 176*b* formed on a side opposite to the first plane 176*a*. When the passive portion is moved toward the restricting portion 286, the inclined surface 176*b* contacts the restricting portion 286, whereby the inclined surface 176*b* is pressed against the passive portion elastic member 178 side and is moved. Accordingly, a contact between the second rod 133 and the passive portion 176 is released, and the engagement of the clutch mechanism 130 is released. The passive portion 176 is movable to release the engagement of the clutch mechanism 130. At this time, the passive portion elastic member 178 is in a more contracted state than the natural length. The passive portion elastic member 178 expands or contracts vertically, for example, in a direction perpendicular to the moving direction of the second rod 133. The passive portion elastic member 178 is formed of an elastic member such as a spring.

When the engagement of the clutch mechanism 130 is released, the first support 180 and the passive portion 176 move toward the discharge valve hydraulic drive portion 114 side (the discharge valve 12 side) to return to an original natural length position by the support elastic member 182. Accordingly, the discharge valve 12 freely falls. The support elastic member 182 is formed of an elastic member such as a spring.

The second support 184 is fixed to the reservoir tank 10. The second support 184 is connected to the restricting portion 286. The restricting portion 286 is formed to contact the inclined surface 176*b* of the passive portion 176. The restricting portion 286 is disposed on the moving direction of the passive portion 176. The restricting portion 286 is formed to move the passive portion 176 to deviate from the second rod 133, so that the contact between the first plane 176*a* and the second rod 133 is released.

The first support 180 and an upper end of a valve shaft 12*a* of the discharge valve 12 are connected to each other by the connection member 288. The connection member 288 is a wire, a bead chain, or the like. Accordingly, in the case where the first support 180 is pressed by the second rod 133 to be separated from the discharge valve 12, the discharge valve 12 is physically pulled up by the connection member 288. The connection member 288 has flexibility. The connection member 288 is disposed in a connection member conduit 191 bent between the first support 180 and the discharge valve 12. The connection member conduit 191 forms a tubular passage for passing the connection member 288 therethrough.

The casing 113 for accommodating the discharge valve 12 therein is formed above the discharge valve 12. The casing 113 is opened at a lower side thereof and is formed into a cylindrical shape. The casing 113 is formed separately from the discharge valve hydraulic drive portion 114 and the clutch mechanism 130, and is disposed away from the discharge valve hydraulic drive portion 114. The casing 113 is fixed to the reservoir tank 10. The casing 113 forms an independently-disposed casing that is provided independently of the discharge valve hydraulic drive portion 114.

The discharge valve 12 is pulled up by the drive force of the discharge valve hydraulic drive portion 114, the clutch mechanism 130 is disengaged at a predetermined timing when the discharge valve 12 is pulled up to a predetermined height, and the discharge valve 12 falls by its own weight. When the discharge valve 12 falls, the discharge valve 12 is held by the discharge valve float mechanism 26 for a predetermined time period, so that a time period until the discharge valve 12 is seated on the water discharge opening 10*a* is adjusted.

Next, referring to FIGS. 37 to 44, the discharge valve hydraulic drive portion 114 will be described.

As illustrated in FIG. 37 and the like, the discharge valve hydraulic drive portion 114 is configured to drive the discharge valve 12 using a water supply pressure of the flush water (tap water) supplied from the tap water.

The discharge valve hydraulic drive portion 114 includes a cylinder 114*a* to which the tap water supplied from the water supply controller 18 is supplied as the flush water, a piston 128 that is slidably disposed in a cylinder 114*a*, a first rod 132 that extends from the piston 128 through a first through hole portion 114*f* formed in the cylinder 114*a*, and a second rod 133 that extends from the piston 128 through a second through hole portion 114*q* formed in the cylinder 114*a*. The discharge valve hydraulic drive portion 114 is made of a resin.

Furthermore, a spring 14*c* which is a biasing member is disposed in the cylinder 114*a*, and biases the piston 128 toward a first position H11 side.

The cylinder 114*a* forms a horizontally-disposed cylinder. The piston 128 is laterally and slidably received in the interior of the cylinder 114*a*. The cylinder 114*a* is a substantially cylindrical member, and is disposed so that a central axis thereof is oriented to the horizontal direction, and the piston 128 is slidably received in the interior of the cylinder 114*a*. As illustrated in FIG. 37, an inflow pipe 24*a* which is a drive portion water supply passage is connected to an inlet side portion of the cylinder 114*a* so that the water that has flowed out from the water supply controller 18 flows into the cylinder 114*a*. Therefore, the piston 128 in the cylinder 114*a* is pushed up against the biasing force of the spring 14*c* by the water that has flowed into the cylinder 114*a*.

An outflow pipe branching portion 24*c* is provided at a distal end portion of the outflow pipe 24*b* extending from the cylinder 114*a*. The outflow pipe 24*b* branching at the outflow pipe branching portion 24*c* is configured so that water flows out from one branch into the reservoir tank 10 and the water flows out from the other branch into the overflow pipe 10*b*.

The cylinder 114*a* further includes the first through hole portion 114*f* formed in a side wall on the first position side of the cylinder 114*a*. The first through hole portion 114*f* is connected to the outflow pipe 24*b*. The first through hole portion 114*f* includes a bank portion 114*j* rising from a peripheral portion of the through hole formed in the side wall of the cylinder 114*a* toward the inside of the cylinder. The bank portion 114*j* is formed into an annular shape around the first rod 132 in a front view. In a state where the bank portion 114*j* contacts a bottom surface of the piston 128, a communicating flow path inlet portion 170*a* of the first rod 132 is positioned at a position facing an inner wall of the first through hole portion 114*f*.

In the present embodiment, the piston 128 is configured to move laterally in the cylinder 114*a*. When the flush water flows into the cylinder 114*a*, the piston 128 is moved from the first position H11 (see FIG. 37) to a second position H12 (see FIG. 43). The first position H11 of the piston 128 is located on an inlet portion 114*l* side, and the second position 12 of the piston 128 is located on a side closer to the clutch mechanism 130 than the first position H11. For example, the second position H12 is located at the far side from the inlet portion 114*l* side of the cylinder 114*a*. The piston 128 partitions the inside of the cylinder 114*a* into a pressure chamber 114*g* on the side in front of the piston 128 and a back pressure chamber 114*h* on the side behind the piston 128. In addition, the piston 128 is moved from the first position H11 (see FIG. 37) to the second position H12 (see FIG. 43) by the pressure of the flush water that has flowed into the pressure chamber 114*g*. The present embodiment may adopt not only a configuration in which the piston 128 moves in the cylinder 114*a* in the horizontal direction but also a configuration in which the cylinder is disposed in an oblique direction, a vertical direction, or the like so that the piston 128 moves in the cylinder 114*a* in another direction (for example, an oblique direction, a vertical direction, or the like).

The first rod 132 is a rod-shaped member connected to a surface on the inlet side of the piston 128. The first rod 132 extends from the piston 128 toward the pressure chamber 114*g* on the inlet portion 114*l* side, and extends outward through the first through hole portion 114*f* in the side wall on the inlet portion side. The first rod 132 extends into the outflow pipe 24*b* extending from the first through hole portion 114*f*. A proximal end of the first rod 132 is connected to the piston 128, and a distal end of the first rod 132 is located inside the outflow pipe 24*b*. The first rod 132 is a rod extending in the horizontal direction toward the side opposite to the second rod 133 which is an operating rod for the clutch mechanism extending from the piston 128 toward the clutch mechanism 130. A rod extending from the piston 128 through the through hole portion formed in the cylinder 114*a* need not be identified as the first rod 132 or the second rod 133. The first rod 132 and the second rod 133 may be formed as one rod.

The second rod 133 is a rod-shaped member connected to a surface on the back pressure chamber 114*h* side of the piston 128, and extends from the piston 128 in the horizontal direction to connect the piston 128 and the discharge valve 12. The second rod 133 extends from the piston 128 toward a far side portion 114*t*, and extends to project laterally from the inside of the cylinder 114*a* through the second through hole portion 114*q* formed in the side wall on the far side. The second rod 133 extends toward the side opposite to the first rod 132. A proximal end of the second rod 133 is connected to the piston 128, and a distal end of the second rod 133 is configured to act on the passive portion 176 of the clutch mechanism 130.

Figure 39:
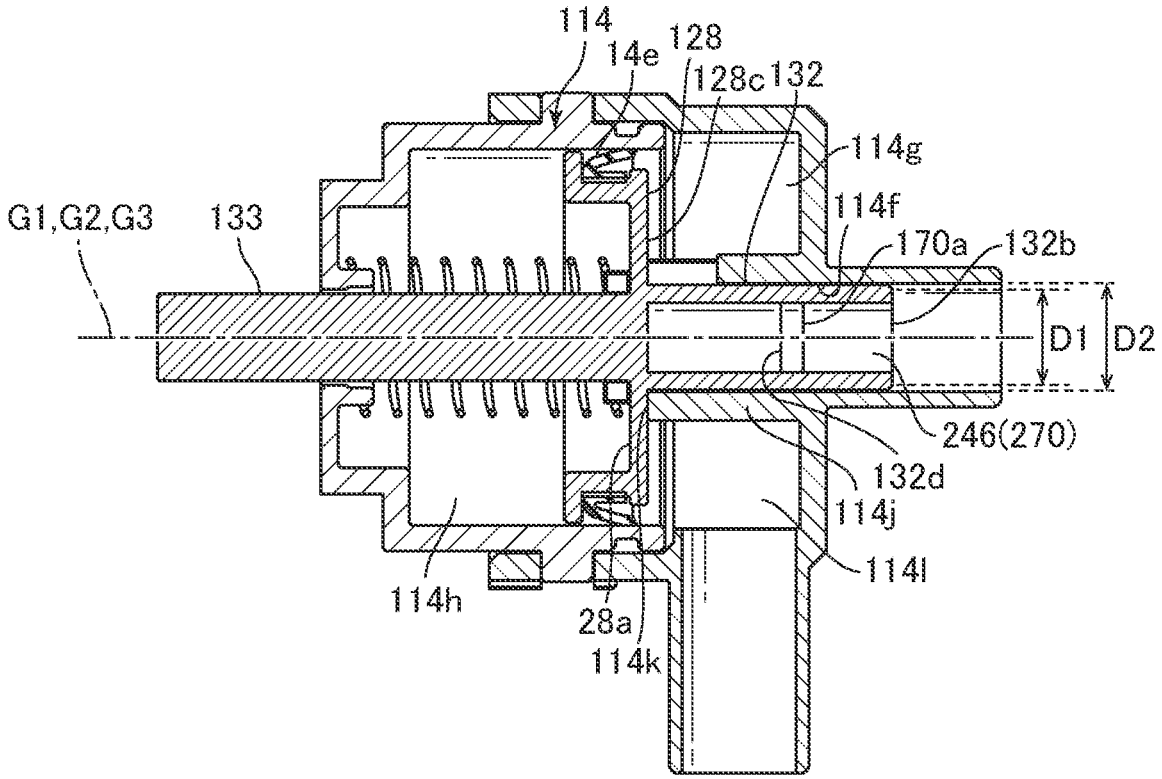
FIG. 39 is a cross sectional view when viewed along line XXXIX-XXXIX in FIG. 38.

As illustrated in FIG. 39, a central axis G1 of the first rod 132 and a central axis G2 of the first through hole portion 114*f* are located on the same axis as a central axis G3 of the cylinder 114*a*. An outer diameter D1 of the first rod 132 is slightly smaller than an inner diameter D2 of the first through hole portion 114*f* so that the first rod 132 can be fitted in the first through hole portion 114*f* and can slide in a left and right direction.

The discharge valve hydraulic drive portion 114 further includes the inlet portion 114*l* that is formed in the cylinder 114*a* and in which the flush water flows, and a communication mechanism 246 for establishing the communication between the pressure chamber 114*g* and the outflow pipe 24*b* after the clutch mechanism 130 is disengaged. The communication mechanism 246 is formed by the first rod 132 and the cylinder 114*a*, for example.

The inlet portion 114*l* is connected to the inflow pipe 24*a*. The inlet portion 114*l* is connected to a portion on the more upstream side than the first position of the cylinder 114*a*. The inlet portion 114*l* forms a flow path that communicates with the upstream side of the piston 128. The flush water that has flowed out from the water supply controller 18 flows from the inlet portion 114*l* into the cylinder 114*a*. The flush water flows into the cylinder 114*a* using the water supply pressure of the tap water. Therefore, the piston 128 in the cylinder 114*a* is pushed up against the biasing force of the spring 14*c* by the flush water that has flowed into the cylinder 114*a*.

The first rod 132 forms at least a part of the communication mechanism 246. The first rod 132 is configured to form a communicating flow path 270 of the communication mechanism 246 for establishing the communication between the pressure chamber 114*g* and the outflow pipe 24*b* according to a position of the piston 128. The communicating flow path 270 forms a discharge path as a main discharge path. The communicating flow path 270 as the main discharge path forms a flow path having such a size that the flush water that has flowed from the inflow pipe 24*a* into the cylinder 114*a* can flow out at a flow rate equal to or higher than a half of an inflow rate. A flow path cross-sectional area of the communicating flow path 270 is larger than a flow path cross-sectional area of an auxiliary discharge flow path as described later. The flow path cross-sectional area of the communicating flow path 270 is, for example, 20% or more of the flow path cross-sectional area of the inlet portion 114*l*, preferably 30% or more, and more preferably 40% or more.

The communication mechanism 246 forms the communicating flow path 270 for establishing the communication between the pressure chamber 114*g* and the outflow pipe 24*b* according to the position of the piston 128 to thereby establish the communication between the pressure chamber 114*g* and the outflow pipe 24*b* via the communicating flow path 270. The communicating flow path 270 of the communication mechanism 246 is provided separately from the inlet portion 114*l*. The communicating flow path 270 is formed by a hollow inner passage extending in the first rod 132. The communicating flow path 270 is formed by a passage extending from a communicating flow path start position 132*d* of the first rod 132 to a distal end 132*b* of the first rod 132, the communicating flow path start position 132*d* appearing in the cylinder 114*a* to correspond to a communication position of the piston 128 (a fourth position H14 of the piston 128 where the communicating flow path is formed). The communicating flow path 270 is formed into a pipe shape on the inner side of an annular structure of the first rod 132, and forms the hollow inner passage. The communicating flow path 270 extends from the communicating flow path inlet portion 170*a* formed on the piston 128 side of the first rod 132 to an exit portion 170*b* formed to open to the outflow pipe 24*b* side. The communicating flow path inlet portion 170*a* is formed in the side wall of the first rod 132 and forms an opening extending from the outside of the first rod 132 to the communicating flow path 270 in the first rod 132. The exit portion 170*b* forms an opening that opens in an axial direction of the first rod 132 at an end portion on the distal side of the first rod 132.

The communicating flow path inlet portion 170*a* is formed on the pressure chamber 114*g* side of the piston 128 and at the communicating flow path start position 132*d* at a predetermined distance from the piston 128. Accordingly, when the piston 128 is located at the first position H11, the communicating flow path inlet portion 170*a* at the predetermined distance from the piston 128 is located at a position facing the inner wall of the first through hole portion 114*f*. Therefore, the communicating flow path 270 for establishing the communication between the pressure chamber 114*g* and the outflow pipe 24*b* is in the closed state. A distance from the connection portion with the piston 128 of the first rod 132 to the communicating flow path start position 132*d*, in other words, a distance from the first position H11 to the fourth position H14 is a distance equal to or more than two thirds of a movable distance of the piston 128 in the cylinder 114*a*, for example.

Figure 41:
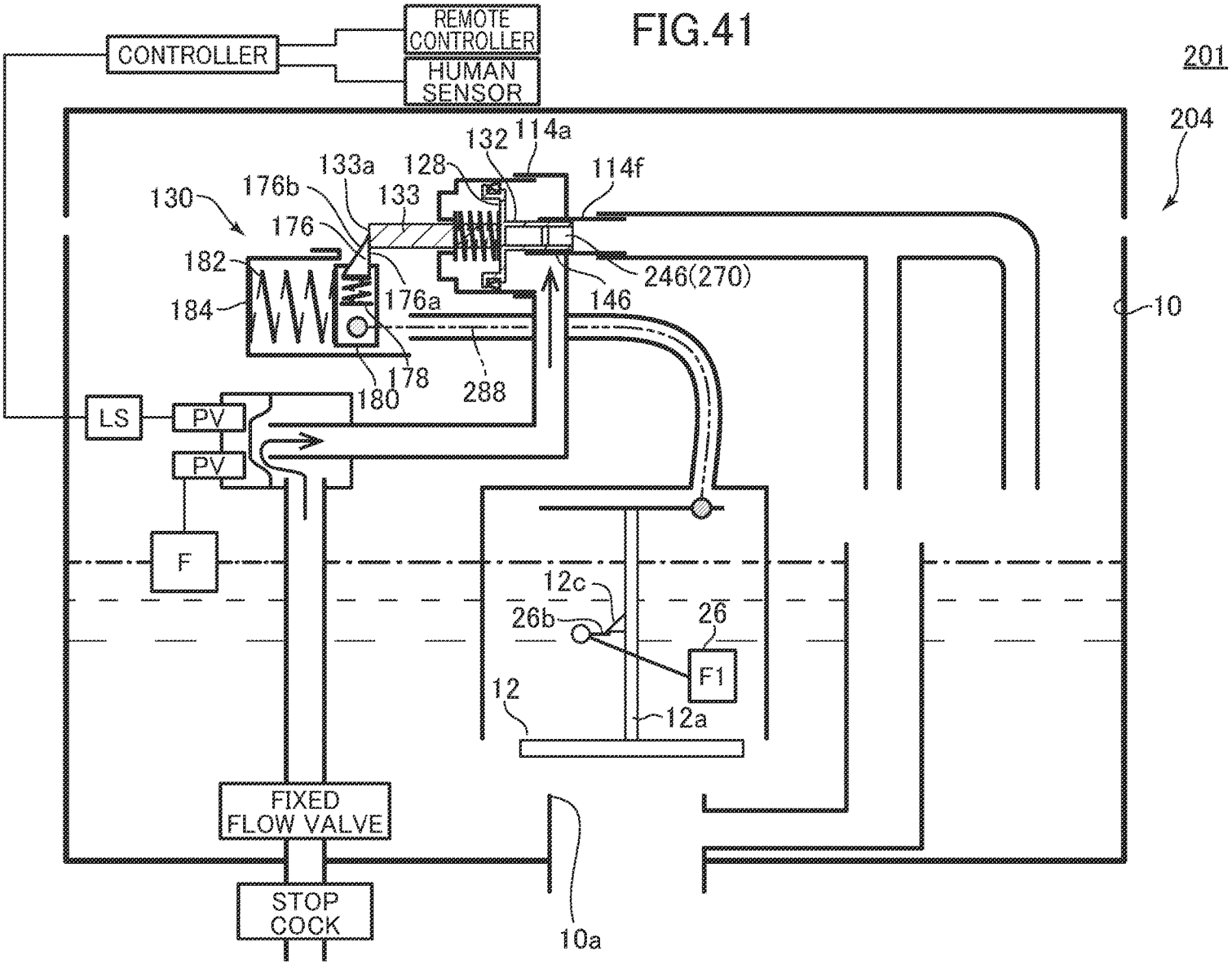
FIG. 41 is a schematic sectional view illustrating a state where the piston is moving toward a second position in the discharge valve hydraulic drive portion, in the flush water tank apparatus according to the third embodiment of the present invention.
Figure 42:
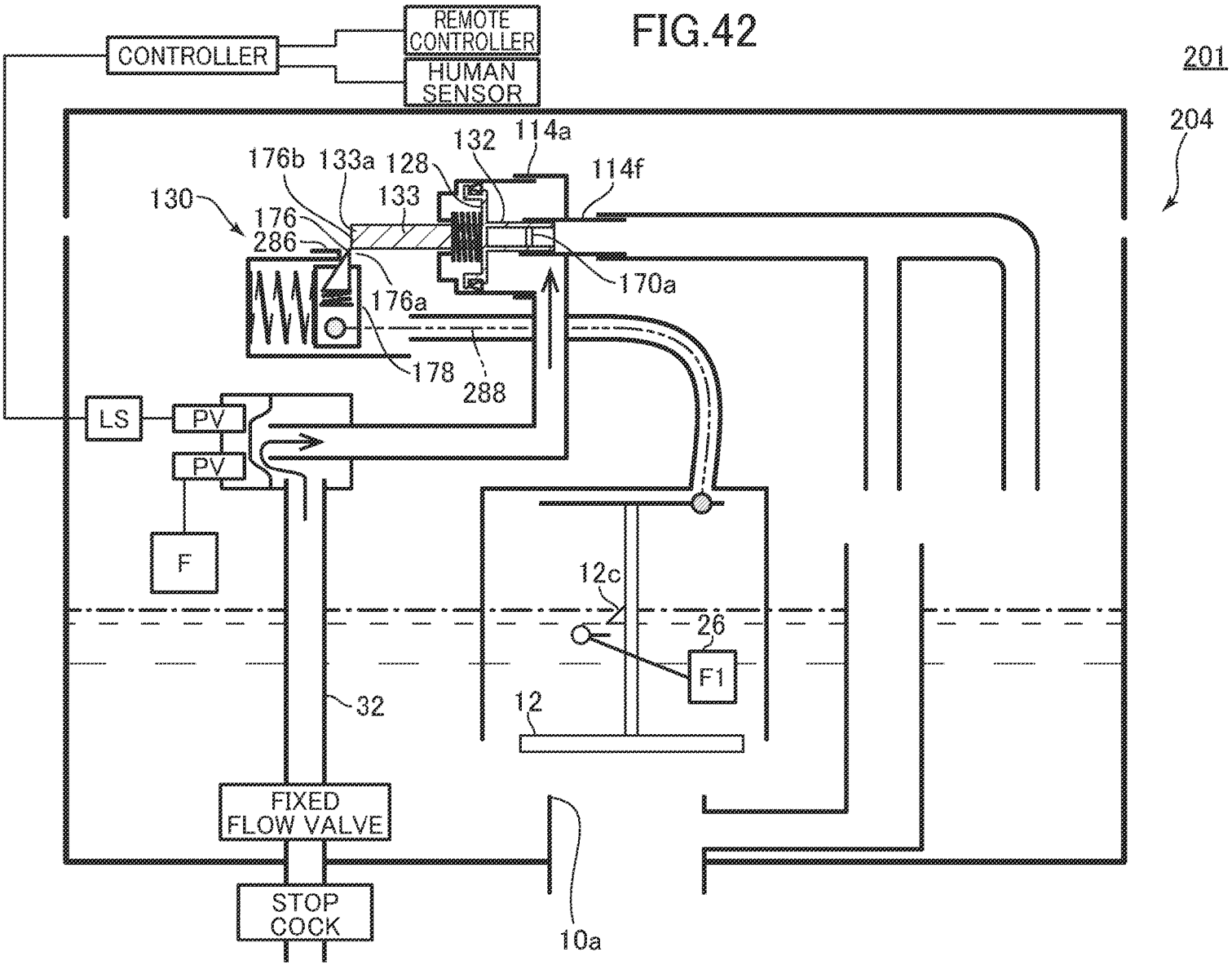
FIG. 42 is a schematic sectional view illustrating a state where the clutch mechanism is disengaged, in the flush water tank apparatus according to the third embodiment of the present invention.
Figure 43:
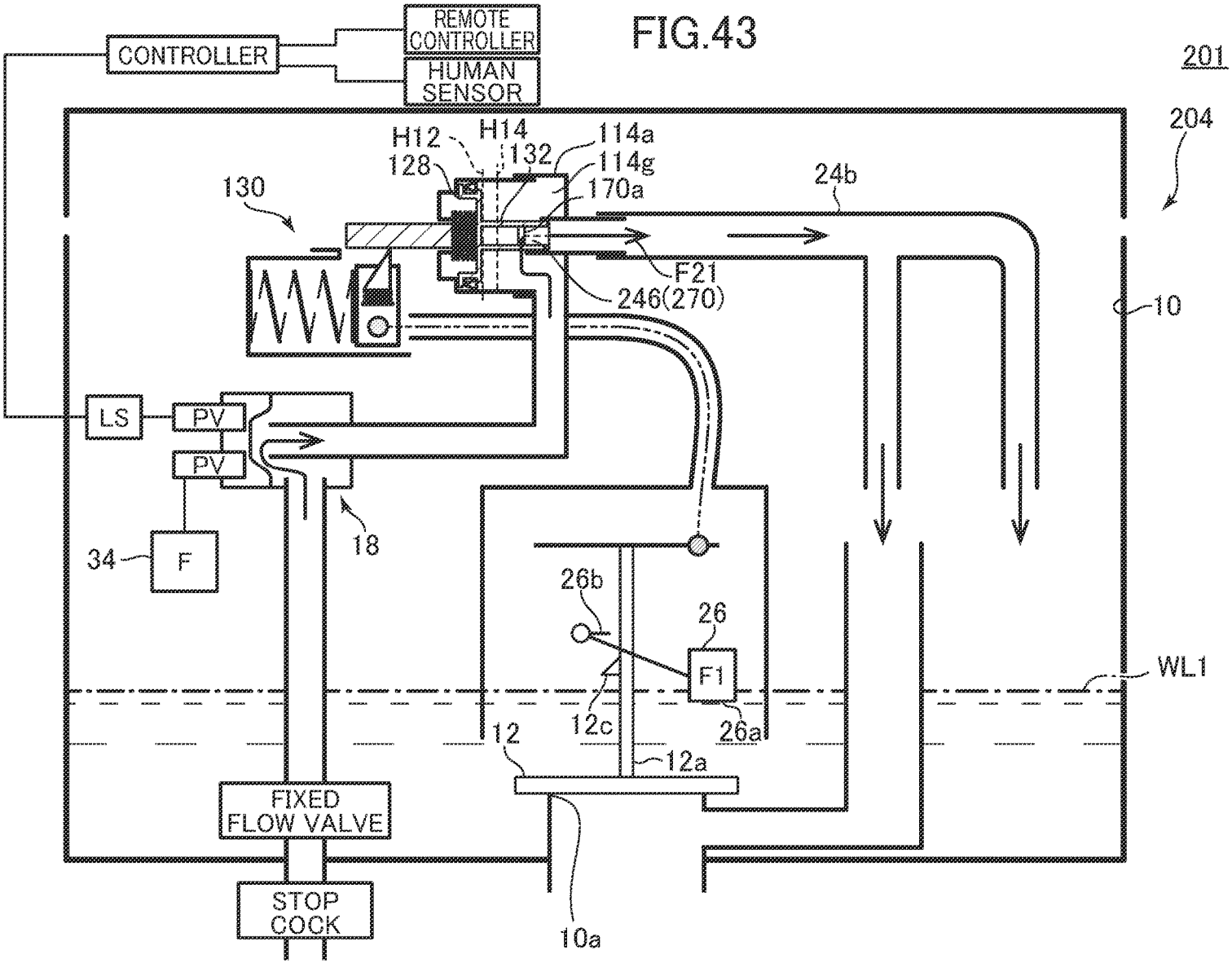
FIG. 43 is a schematic sectional view illustrating a state where the piston has reached the second position in the discharge valve hydraulic drive portion, in the flush water tank apparatus according to the third embodiment of the present invention.

As illustrated in FIGS. 37, 41, and 42, since the communicating flow path inlet portion 170*a* is located at a position facing the inner wall of the first through hole portion 114*f* in the cylinder 14*a* when the piston 128 is moving from the first position H11 to the second position H12, the communicating flow path inlet portion 170*a* is in a nearly closed state even when a small gap is present between the communicating flow path inlet portion 170*a* and the inner wall of the first through hole portion 114*f*, so that the communicating flow path 270 for establishing the communication between the pressure chamber 114*g* and the outflow pipe 24*b* is in the state of not being formed (in the closed state). As illustrated in FIG. 43, when the piston 128 is located at the second position H12, the communicating flow path inlet portion 170*a* away from the piston 128 by the predetermined distance is positioned to open to the pressure chamber 114*g* in the cylinder 114*a*. Therefore, when the piston 128 is located at the second position H12, the communication mechanism 246 forms the communicating flow path 270 for establishing the communication between the pressure chamber 114*g* and the outflow pipe 24*b* to thereby establish the communication between the pressure chamber 114*g* and the outflow pipe 24*b* via the communicating flow path 270. On the other hand, as illustrated in FIG. 37, when the piston 128 is located at the first position H11, the communication mechanism 246 creates the state where the communicating flow path 270 is not formed (is closed). As illustrated in FIG. 41, when the piston 128 is located between the first position H11 and the second position H12, the communication mechanism 246 creates the state where the communicating flow path 270 is not formed (is closed). The communication mechanism 246 has a switching function such as a switching valve for switching between the communicated state and the uncommunicated state. Additionally, the communication mechanism 246 has a function of forming the main discharge path for the flush water from the cylinder 114*a*. Furthermore, the communication mechanism 246 has a function of forming a main water supply path for the flush water to the reservoir tank 10.

The communicating flow path 270 is formed in such a size and a shape as to function as the main discharge path, and is different from the gap-shaped auxiliary discharge flow path that is formed between the first rod 132 and the first through hole portion 114*f*. For example, the auxiliary discharge flow path forms a flow path having such a size that the flush water that has flowed from the inflow pipe 24*a* to the cylinder 114*a* can flow out at a flow rate equal to or lower than one third of an inflow rate, and more preferably at the flow rate equal to or lower than one fourth. For example, a flow path cross-sectional area of the auxiliary discharge flow path is equal to or smaller than one third of the flow path cross-sectional area of the inlet portion 114*l*, more preferably equal to or smaller than one fourth, and further preferably 15% or less.

A controller 28 includes a CPU, a memory, and the like, and controls an apparatus connected to perform a large flush mode, a small flush mode, or the like (described later) based on a predetermined control program stored in the memory or the like. The controller 28 is electrically connected to a remote controller 6, a human sensor 8, an electromagnetic valve 20, and the like.

Next, referring to FIGS. 37 to 44, and the like, a sequence of flush operation of the flush water tank apparatus 204 according to the third embodiment of the present invention and the flush toilet apparatus 201 provided with the same will be described.

Since the flush operation of the flush water tank apparatus 204 and the like in the third embodiment is partially the same as the flush operation of the flush water tank apparatus 4 and the like in the first embodiment, description of the same portions is to be referred to the description in the first embodiment and is omitted here.

First, in the toilet flush standby state (time T20) illustrated in FIG. 37, the water supply from the water supply controller 18 to the hydraulic drive portion 114 is stopped (OFF state). The piston 128 of the discharge valve hydraulic drive portion 114 is located at the first position H11 in the cylinder 114*a*. The first position H11 of the piston 128 is a position closest to the inlet side in the movable range of the piston 128. The piston 128 is stopped in the cylinder 114*a*. The discharge valve 12 is stopped at the lowest position, the second rod 133 is located at a position away from the passive portion 176 of the clutch mechanism 130, and the engagement of the clutch mechanism 130 is released. The piston 128 is located at the first position 1111, and a lower surface portion 128*c* of the piston 128 contacts a top portion 114*k* of the bank portion 114*j* of the cylinder 114*a*. Since the communicating flow path inlet portion 170*a* is located at a position facing the inner wall of the first through hole portion 114*f* of the cylinder 114*a*, the communicating flow path inlet portion 170*a* of the communicating flow path 270 is in the closed state (the state where the communication between the pressure chamber 114*g* and the outflow pipe 24*b* is not established).

Next, at a time T21, when the user presses a flush button in the remote controller 6, the remote controller 6 transmits a command signal for flushing the toilet to the controller 28.

When receiving the command signal for flushing the toilet, the controller 28 operates the electromagnetic valve 20, and opens the main valve body 38. When the water supply controller 18 opens the valve, the flush water that has flowed in from the water supply pipe 32 is supplied to the discharge valve hydraulic drive portion 114 via the water supply controller 18. Hereby, the piston 128 of the discharge valve hydraulic drive portion 114 is pushed up, and the operating portion 133*a* of the second rod 133 moves toward the passive portion 176. Since the communicating flow path inlet portion 170*a* is still located inside of the first through hole portion 114*f*, the communicating flow path 270 is in the closed state. When the piston 128 rises, the flush water that has flowed into the pressure chamber 114*g* of the cylinder 114*a* is mainly accumulated in the pressure chamber 114*g* by the packing 14*e* having a sealing function, thereby generating a force for raising the piston 128.

As illustrated in FIG. 41, when the piston 128 and the second rod 133 move toward the second position H12, the operating portion 133*a* contacts the first plane 176*a* of the passive portion 176, and the passive portion 176 and the first support 180 are pushed laterally while contracting the support elastic member 182. Hereby, the connection member 288 connected to the first support 180 is pulled up, and the discharge valve 12 is pulled up by the connection member 288. Accordingly, when the discharge valve 12 is pulled up, the flush water in the reservoir tank 10 is discharged from the water discharge opening 10*a* to the flush toilet main unit 2. When the discharge valve 12 is pulled up, a holding hook 12*c* provided on the valve shaft 12*a* of the discharge valve 12 pushes up and turn the engaging portion 26*b* of the discharge valve float mechanism 26, and the holding hook 12*c* rises above the engaging portion 26*b*.

Next, as illustrated in FIG. 42, at a time T22, when the passive portion 176 moves toward the restricting portion 286 and is pressed against the restricting portion 286, the inclined surface 176*b* contacts the restricting portion 286, whereby the inclined surface 176*b* is pressed against the passive portion elastic member 178 side, and the passive portion 176 is moved to the passive portion elastic member 178 side. Accordingly, a contact between the second rod 133 and the passive portion 176 is released, and the engagement of the clutch mechanism 130 is released. That is, when the discharge valve 12 is pulled up to a predetermined height, the passive portion 176 of the clutch mechanism 130 contacts the restricting portion 286, and the clutch mechanism 130 is disengaged. Even after the clutch mechanism 130 is disengaged, the communicating flow path 270 is in the closed state until the communicating flow path inlet portion 170*a* is opened. A predetermined position of the piston 128 when the clutch mechanism 130 is disengaged is referred to as a third position H13. The third position H13 is a position on a side closer to the first position than the second position H12.

At the time T22, when the clutch mechanism 130 is disengaged, the discharge valve 12 starts to fall by its own weight toward the water discharge opening 10*a*. The holding hook 12*c* of the discharge valve 12 that has fallen engages with the engaging portion 26*b* of the discharge valve float mechanism 26, and the discharge valve 12 is held at a predetermined height by the engaging portion 26*b*. When the discharge valve 12 is held by the engaging portion 26*b*, the water discharge opening 10*a* is maintained in the open state, and the discharge of the flush water in the reservoir tank 10 to the flush toilet main unit 2 is maintained. At this time, the float-side pilot valve 44 is still in the open state, and the flush water that has flowed in from the water supply pipe 32 is supplied to the discharge valve hydraulic drive portion 114 via the water supply controller 18.

Next, at a time T23, when the piston 128 is further pushed and the first rod 132 moves together with the piston, and the piston 128 reaches the fourth position H14, the communicating flow path inlet portion 170*a* reaches an opening position in the pressure chamber 114*g*. Accordingly, the communicating flow path 270 for establishing the communication between the pressure chamber 114*g* and the outflow pipe 24*b* is formed and is opened. Therefore, the flush water flows from the pressure chamber 114*g* into the communicating flow path 270 via the communicating flow path inlet portion 170*a*, and flows out from the communicating flow path 270 to the outflow pipe 24*b* through the exit portion 170*b*.

The fourth position H14 is located at a position on the farther side of the piston from the third position H13 and at a position on the side slightly closer to the inlet than (or in front of) the second position H12. That is, the disengagement of the clutch mechanism 130 and the communication between the pressure chamber 114*g* and the outflow pipe 24*b* established by the communication mechanism 246 are performed according to the displacement of the piston 128, and the fourth position H14 is a communication position where the communication between the pressure chamber 114*g* and the outflow pipe 24*b* is established by the communication mechanism 246, the communication position being located on a side closer to the second position H12 than the disengagement position (the third position 1113) where the clutch mechanism 130 is disengaged. When the piston 128 is located between the fourth position H14 and the second position H12, the communicating flow path inlet portion 170*a* opens to the pressure chamber 114*g*, and the communicating flow path 270 forms a flow path for establishing the communication between the pressure chamber 114*g* and the outflow pipe 24*b*.

At a time T23, the water supply of the flush water into the pressure chamber 114*g* is continued, and the piston 128 and the first rod 132 continuously rise even after the communicating flow path establishes the communication. The clutch mechanism 130 is in the disengaged state.

As illustrated in FIG. 43, the piston 128 and the first rod 132 are further pushed, and reach the second position H12. At this time, the communicating flow path 270 is in the open state. Hereby, as indicated by an arrow F21, the flush water is discharged from the communicating flow path 270 to the outflow pipe 24*b*, and the flush water is discharged, as main supply water, from an ejecting portion at a downstream end of the outflow pipe 24*b* into the reservoir tank 10.

When the water level in the reservoir tank 10 is lowered to a predetermined water level WL1, the float portion 26*a* of the discharge valve float mechanism 26 is lowered, which causes the engaging portion 26*b* to move. Hereby, the engagement between the valve shaft 12*a* and the engaging portion 26*b* is released, and the valve shaft 12*a* and the discharge valve 12 start to be lowered again. Then, the discharge valve 12 is seated on the water discharge opening 10*a*, and the water discharge opening 10*a* is closed. Since the water supply valve float 34 is still in the OFF state, the open state of the water supply controller 18 is maintained, and the water supply to the reservoir tank 10 is continued.

At a time T24, in the state where the supply of the flush water into the cylinder 114*a* is maintained even after the piston 128 has reached the second position H12, the communication mechanism 246 maintains the communication between the pressure chamber 114*g* and the outflow pipe 24*b*. Since the communicating flow path 270 is in the open state, the flush water flows out from the pressure chamber 114*g* to the outflow pipe 24*b* via the communicating flow path inlet portion 170*a*. Accordingly, the water pressure on the pressure chamber 114*g* side is substantially equal to the water pressure on the outflow pipe 24*b* side. Since a part of the flush water that has flowed out into the outflow pipe 24*b* flows into the reservoir tank 10, the water level in the reservoir tank 10 rises. The clutch mechanism 130 is in the disengaged state.

Figure 44:
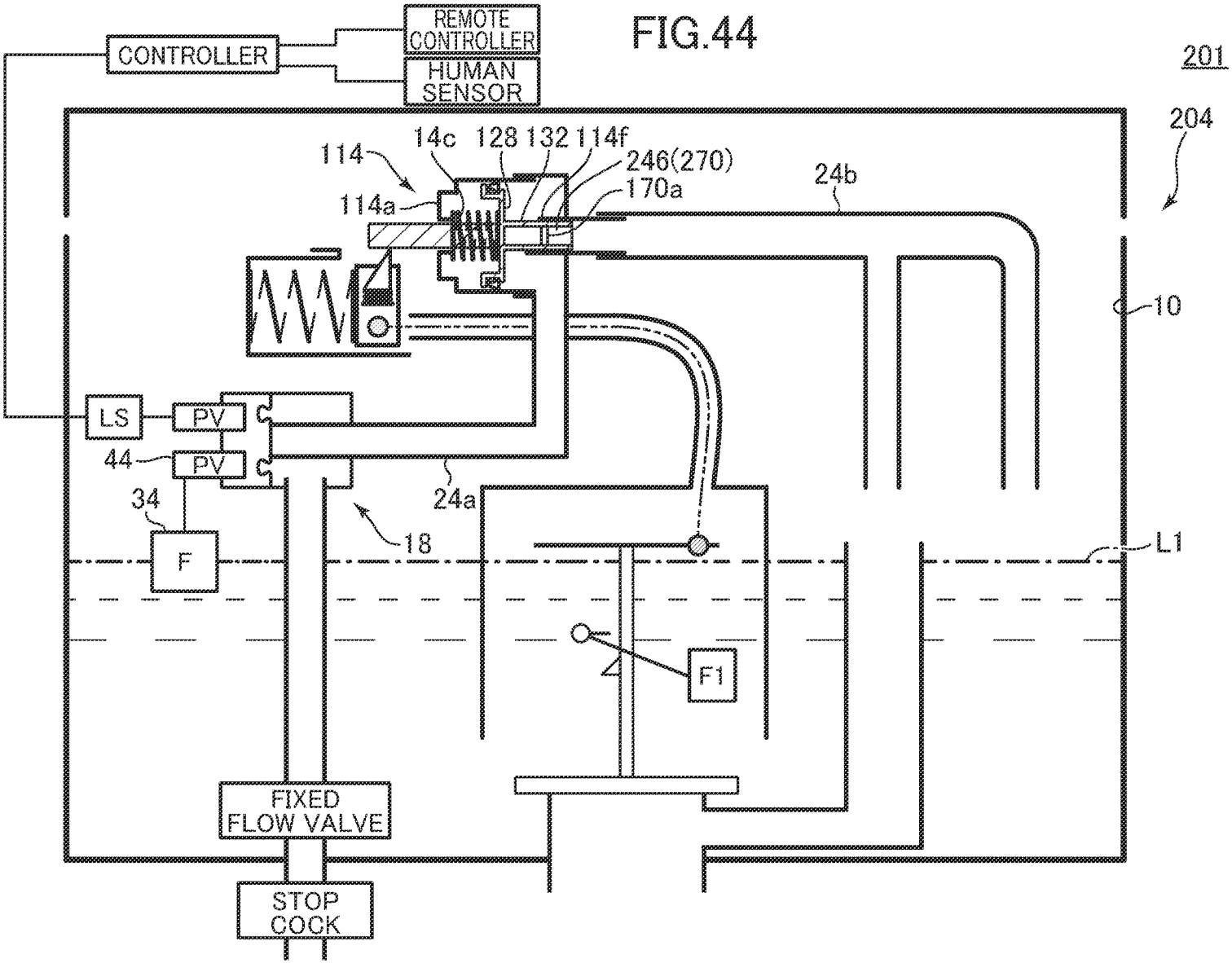
FIG. 44 is a schematic sectional view illustrating a state where the piston returns toward a first position in the discharge valve hydraulic drive portion, in the flush water tank apparatus according to the third embodiment of the present invention.

At a time T25, as illustrated in FIG. 44, when the water level of the flush water in the reservoir tank 10 rises to a predetermined water level L1, the water supply valve float 34 (see FIG. 37) rises, and the float-side pilot valve 44 is closed. Hereby, the water supply from the water supply controller 18 to the discharge valve hydraulic drive portion 114 is stopped, whereby the OFF state is created. The supply of the flush water into the pressure chamber 114*g* is stopped, and the piston 128 is gradually pushed back in the returning direction by the biasing force of the spring 14*c*.

At the time T25, as illustrated in FIG. 43, the communicating flow path 270 forms a flow path for establishing the communication between the pressure chamber 114*g* and the outflow pipe 24*b*. However, as illustrated in FIG. 44, immediately after the piston 128 starts the return movement, the communicating flow path inlet portion 170*a* is lowered from the interior of the pressure chamber 114*g* to the position facing the inner wall of the first through hole portion 114*f*, and therefore the communicating flow path 270 is closed. Thereafter, the piston 128 and the first rod 132 continues the return movement. At the time T25, the water supply from the water supply controller 18 to the cylinder 114*a* is stopped, whereby the flush water is discharged from the auxiliary discharge flow path into the reservoir tank 10, and the flush water in the pressure chamber 114*g* is discharged from the auxiliary discharge flow path into the reservoir tank 10. Therefore, the water pressure on the pressure chamber 114*g* side can be reduced relatively quickly.

At a time T26, as illustrated in FIG. 37, the piston 128 completes the return movement, and returns to the first position H11 in the cylinder 114*a*. The clutch mechanism 130 is in the disengaged state. The communicating flow path 270 is in the closed state. Between the time T25 and the time T26, the flush water in the pressure chamber 114*g* is discharged from the auxiliary discharge flow path into the reservoir tank 10, flows out from a gap between the inner wall of the first through hole portion 114*f* of the cylinder 114*a* and the first rod 132, and then, flows into the reservoir tank 10. Thus, one toilet flush operation is completed, and the flush toilet apparatus 201 returns to the standby state of the toilet flush operation.

According to the third embodiment of the present invention configured as described above, the first rod 132 forms at least a part of the communication mechanism 246, and the first rod 132 is configured to form the communicating flow path 270 for establishing the communication between the pressure chamber 114*g* and the outflow pipe 24*b* according to a position of the piston 128. This causes the flush water in the pressure chamber 114*g* to flow out into the outflow pipe 24*b* via the communicating flow path 270, which enables the pressure of the flush water in the pressure chamber 114*g* to be easily reduced and enables the piston 128 to more easily return from the second position H12 to the first position H11 side. Additionally, it is possible to further restrain the pulling-up of the discharge valve 12 until the disengagement of the clutch mechanism 130 from being obstructed by the communication between the pressure chamber 114*g* and the outflow pipe 24*b*. Moreover, the pulling-up of the discharge valve 12 until the disengagement of the clutch mechanism 130 enables the water to be discharged from the water discharge opening of the reservoir tank in a predefined manner. Furthermore, since the clutch mechanism 130 is disengaged at a predetermined timing in a predefined manner, it is possible to reduce an influence on the operation of the float mechanism 26 that is to be moved according to the water level in the reservoir tank 10, thereby facilitating a predefined operation.

According to the third embodiment of the present invention configured as described above, the communicating flow path 270 is formed by a passage extending, in the first rod 132, from the communicating flow path start position 132*d* of the first rod 132 to the distal end of the first rod 132, the communicating flow path start position 132*d* appearing in the cylinder 114*a* to correspond to a communication position of the piston 128. Therefore, the communicating flow path 270 can be formed from the communicating flow path start position 132*d* of the first rod 132, and variation in the flow rate of the flush water flowing through the communicating flow path 270 in the first rod 132 can be easily suppressed as compared with the case where the communicating flow path 270 is formed on an outer surface portion side of the first rod 132.

According to the third embodiment of the present invention configured as described above, the first rod 132 is a rod extending toward the side opposite to the second rod 133 which is an operating rod for the clutch mechanism extending from the piston 128 toward the clutch mechanism 130. Hereby, the communicating flow path 270 can be formed by the rod extending on the side opposite to the operating rod. When the operating rod for the clutch mechanism forms the communicating flow path 270, the reduction in the strength of the operating rod can be suppressed.

Next, referring to FIGS. 45 to 52, a flush toilet apparatus according to a fourth embodiment of the present invention will be described.

A flush toilet apparatus 401 according to the fourth embodiment has substantially the same structure as that of the above-described flush toilet apparatus according to the third embodiment, except for the first rod 132 of the discharge valve hydraulic drive portion 114 of the third embodiment. The following describes mainly the points that are different between the fourth embodiment and the third embodiment of the present invention. Similar portions are denoted by the same reference symbols in the drawings or the specification, and are not described.

Figure 45:
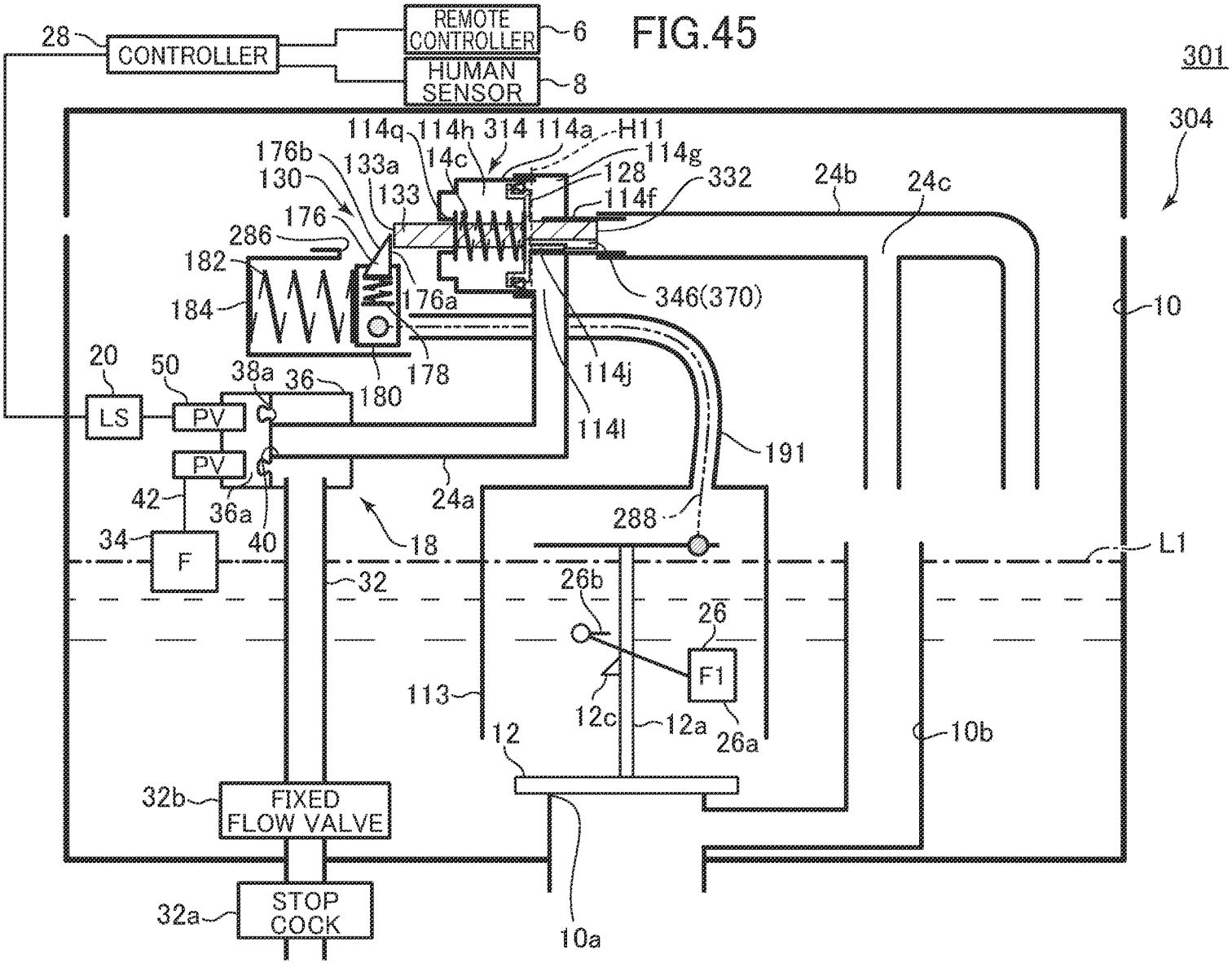
FIG. 45 is a schematic sectional view illustrating a schematic configuration of a flush water tank apparatus according to a fourth embodiment of the present invention.
Figure 46:
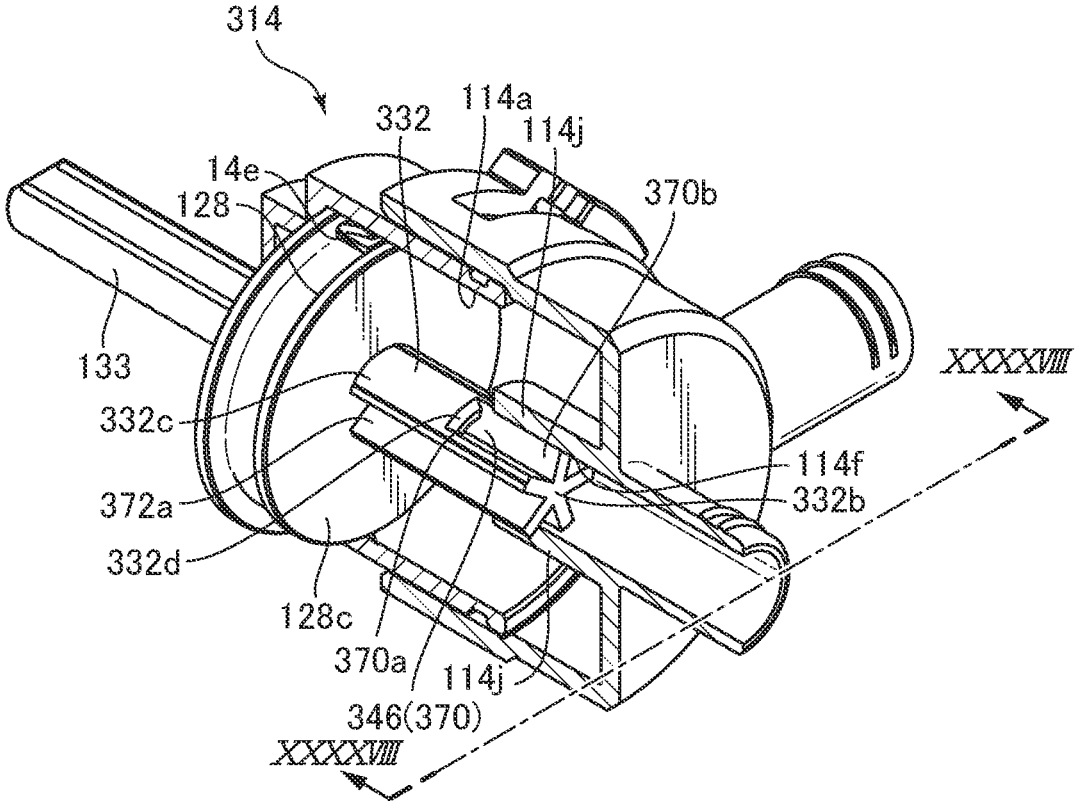
FIG. 46 is a schematic perspective view illustrating an internal structure of a discharge valve hydraulic drive portion provided in the flush water tank apparatus according to the fourth embodiment of the present invention.

As illustrated in FIG. 45, the flush toilet apparatus 301 according to the fourth embodiment of the present invention includes a flush water tank apparatus 304 according to the fourth embodiment of the present invention, which is mounted at a rear portion of a flush toilet main unit 2. The flush water tank apparatus 304 includes a discharge valve hydraulic drive portion 314 which is a discharge valve pull-up portion configured to pull up a discharge valve 12.

Next, referring to FIGS. 45 to 48, the discharge valve hydraulic drive portion 314 will be described.

As illustrated in FIG. 45 and the like, the discharge valve hydraulic drive portion 314 is configured to drive the discharge valve 12 using a water supply pressure of the flush water (tap water) supplied from the tap water. The discharge valve hydraulic drive portion 314 includes a first rod 332 extending from the piston 128 through a first through hole portion 114*f* formed in a cylinder 114*a*.

The first rod 332 is a rod-shaped member connected to a surface on the inlet side of the piston 128. The first rod 332 extends from the piston 128 toward the pressure chamber 114*g* on the inlet portion 114*l* side, and extends outward through the first through hole portion 114*f* in the side wall on the inlet portion side. The first rod 332 extends into the outflow pipe 24*b* extending from the first through hole portion 114*f*. A proximal end of the first rod 332 is connected to the piston 128, and a distal end of the first rod 332 is located inside the outflow pipe 24*b*. The first rod 332 is a rod extending in the horizontal direction toward the side opposite to the second rod 133 which is an operating rod for the clutch mechanism 130 extending from the piston 128 toward the clutch mechanism 130. In a state where the bank portion 114*j* contacts a bottom surface of the piston 128, a communicating flow path inlet portion 170*a* of the first rod 332 is positioned at a position facing the inner wall of the first through hole portion 114*f*. A rod extending from the piston 128 through the through hole portion formed in the cylinder 114*a* need not be identified as the first rod 332 or the second rod 133. The first rod 332 and the second rod 133 may be formed as one rod.

The discharge valve hydraulic drive portion 314 further includes a communication mechanism 346 for establishing the communication between the pressure chamber 114*g* and the outflow pipe 24*b* after the clutch mechanism 130 is disengaged. The communication mechanism 346 is formed by the first rod 332 and the cylinder 114*a*, for example.

The first rod 332 forms at least a part of the communication mechanism 346. The first rod 332 is configured to form a communicating flow path 370 of the communication mechanism 346 for establishing the communication between the pressure chamber 114*g* and the outflow pipe 24*b* according to a position of the piston 128. The communicating flow path 370 forms a discharge path as a main discharge path. The communicating flow path 370 as the main discharge path forms a flow path having such a size that the flush water that has flowed from the inflow pipe 24*a* to the cylinder 114*a* can flow out at a flow rate equal to or higher than a half an inflow rate. A flow path cross-sectional area of the communicating flow path 370 is larger than a flow path cross-sectional area of an auxiliary discharge flow path as described later. The flow path cross-sectional area of the communicating flow path 370 is, for example, 20% or more of the flow path cross-sectional area of the inlet portion 114*l*, preferably 30% or more, and more preferably 40% or more.

The communication mechanism 346 forms the communicating flow path 370 for establishing the communication between the pressure chamber 114*g* and the outflow pipe 24*b* according to the position of the piston 128 to thereby establish the communication between the pressure chamber 114*g* and the outflow pipe 24*b* via the communicating flow path 370. The communicating flow path 370 of the communication mechanism 346 is provided separately from the inlet portion 114*l*.

Figure 47:
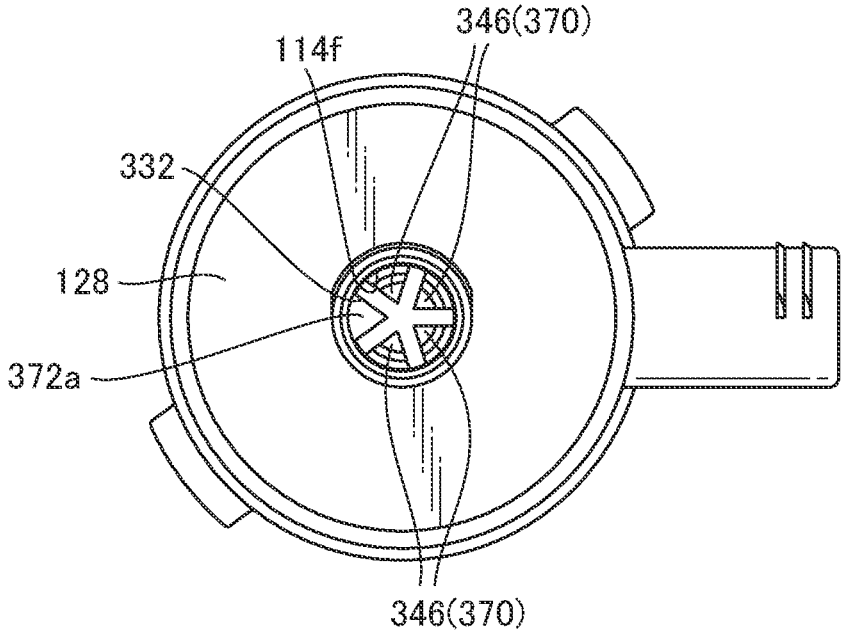
FIG. 47 is a front view when a first rod of the discharge valve hydraulic drive portion is viewed from an outflow pipe side, the discharge valve hydraulic drive portion being provided in the flush water tank apparatus according to the fourth embodiment of the present invention.
Figure 48:
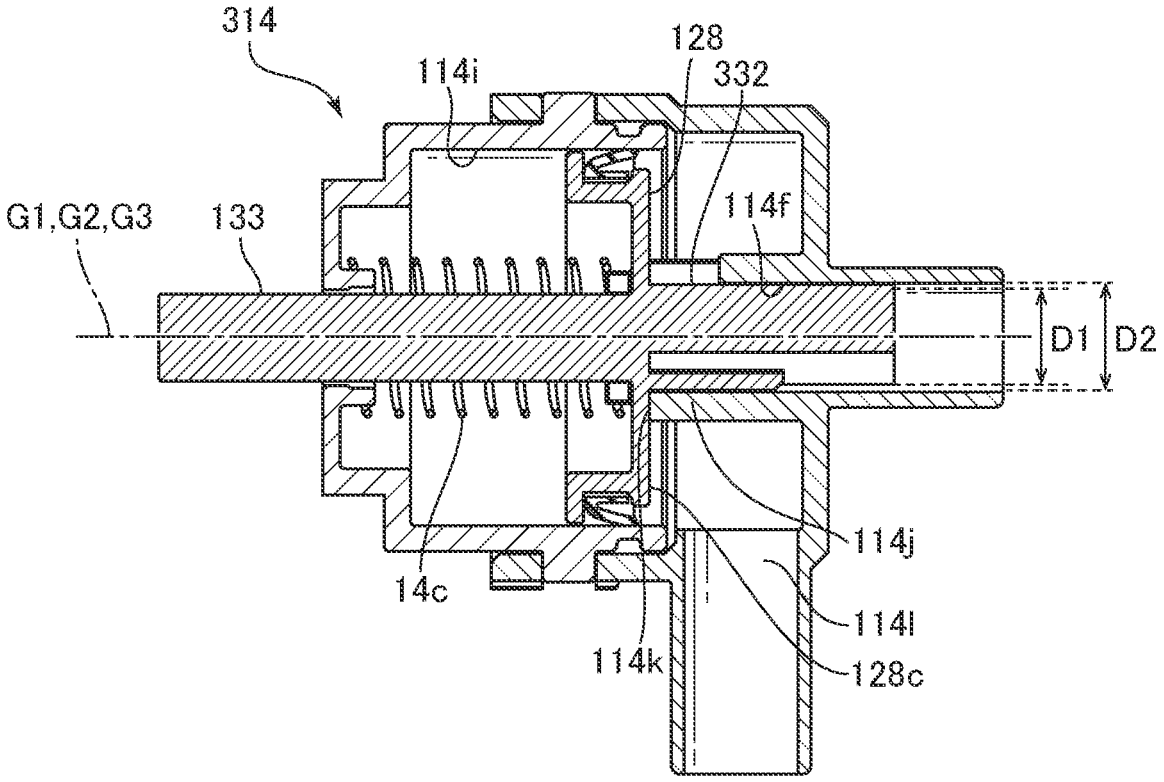
FIG. 48 is a cross sectional view when viewed along line XXXXVIII-XXXXVIII in FIG. 46.

The communicating flow path 370 is formed in which a groove formed to be cut out inward in the outer surface portion of the first rod 332 extends from the communicating flow path start position 332*d* to the distal end 332*b* of the first rod 332 in the side portion of the first rod 332. The communicating flow path start position 332*d* is located at a position away from the proximal end of the piston side. The communicating flow path start position 332*d* is a communicating flow path start position of the first rod 332 appearing in the cylinder 114*a* to correspond to a communication position (the fourth position H14) of the piston. Four communicating flow paths 370 are arranged in an aligned manner along the outer periphery of the first rod 332. Each communicating flow path 370 forms a flow path having a sector shaped cross section. The communicating flow path 370 is formed on the outer surface portion side of the first rod 332, and forms a flow path between the first rod 332 and the first through hole portion 114*f*. When the groove of the communicating flow path 370 is located on an inner side of the cylinder than the first through hole portion 114*f* along with the movement of the first rod 332, the communicating flow path inlet portion 370*a* of the communicating flow path 370 is formed so that the groove of the communicating flow path 370 opens laterally in the inner side of the cylinder than the first through hole portion 114*f*. As illustrated in FIG. 47, the communicating flow paths 370 are formed at four places along the outer periphery of the first rod 332 in a front view as seen from the outflow pipe 24*b* side along the axial direction of the first rod 332. A central angle of the sector-shaped cross section of each communicating flow path 370 is set to about 72 degrees. The communicating flow path 370 extends from the communicating flow path inlet portion 370*a* to an exit portion 370*b* formed to open to the outflow pipe 24*b* side. The exit portion 370*b* forms an opening that opens in an axial direction of the first rod 332 at an end portion on the distal side of the first rod 332. A distance from the proximal end 332*c* of the first rod 332 to the communicating flow path start position 332*d*, in other words, a distance from the first position H11 to the fourth position H14 is a distance equal to or more than two thirds of a movable distance of the piston 128 in the cylinder 114*a*, for example.

When the piston 128 is located at the first position H11, the communicating flow path inlet portion 370*a* away from the piston 128 by the predetermined distance is positioned to face the inner wall of the first through hole portion 114*f*. Therefore, the communicating flow path 370 for establishing the communication between the pressure chamber 114*g* and the outflow pipe 24*b* is in a closed state and in a state of not being formed.

Figure 49:
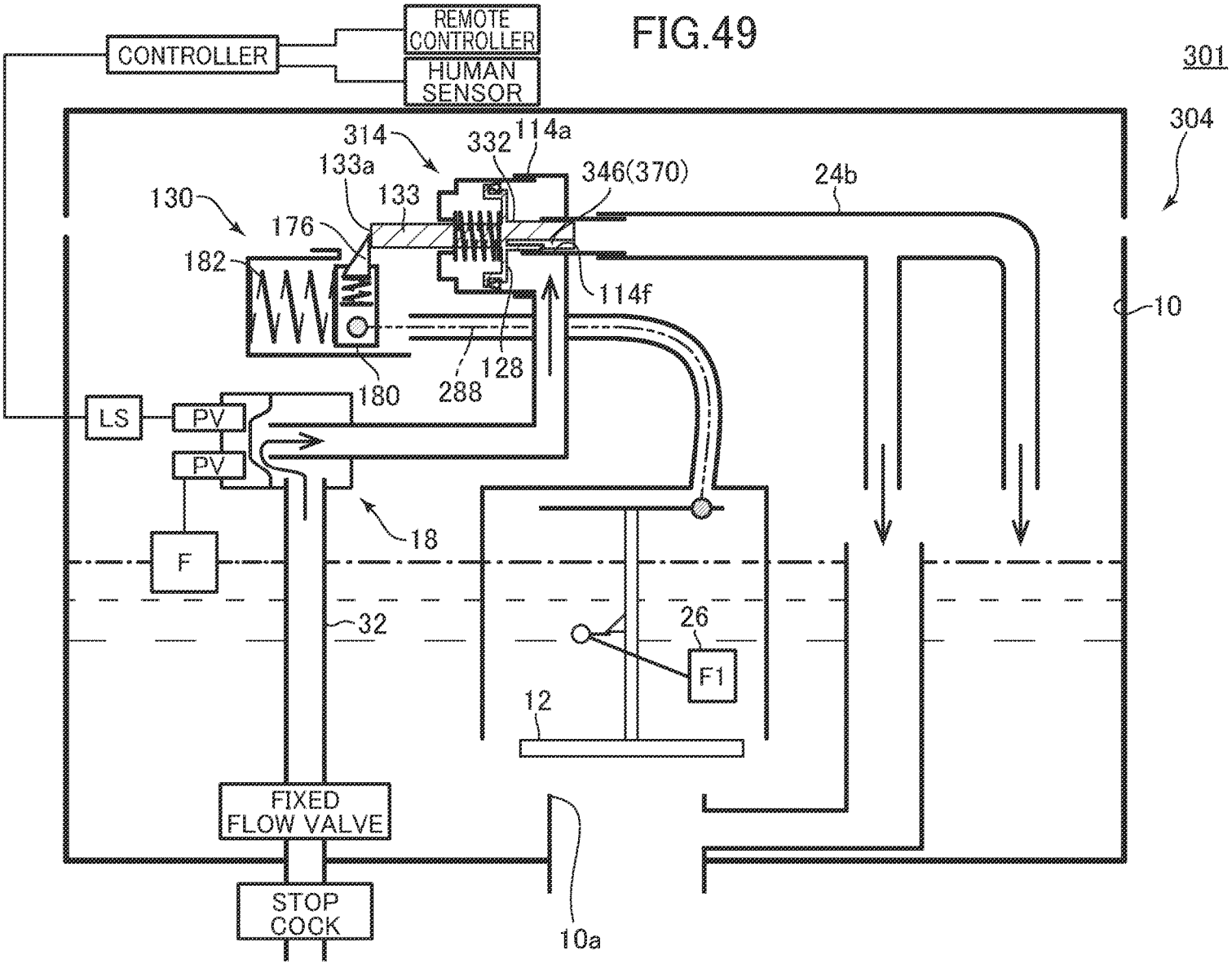
FIG. 49 is a schematic sectional view illustrating a state where a piston is moving toward a second position in the discharge valve hydraulic drive portion, in the flush water tank apparatus according to the fourth embodiment of the present invention.
Figure 50:
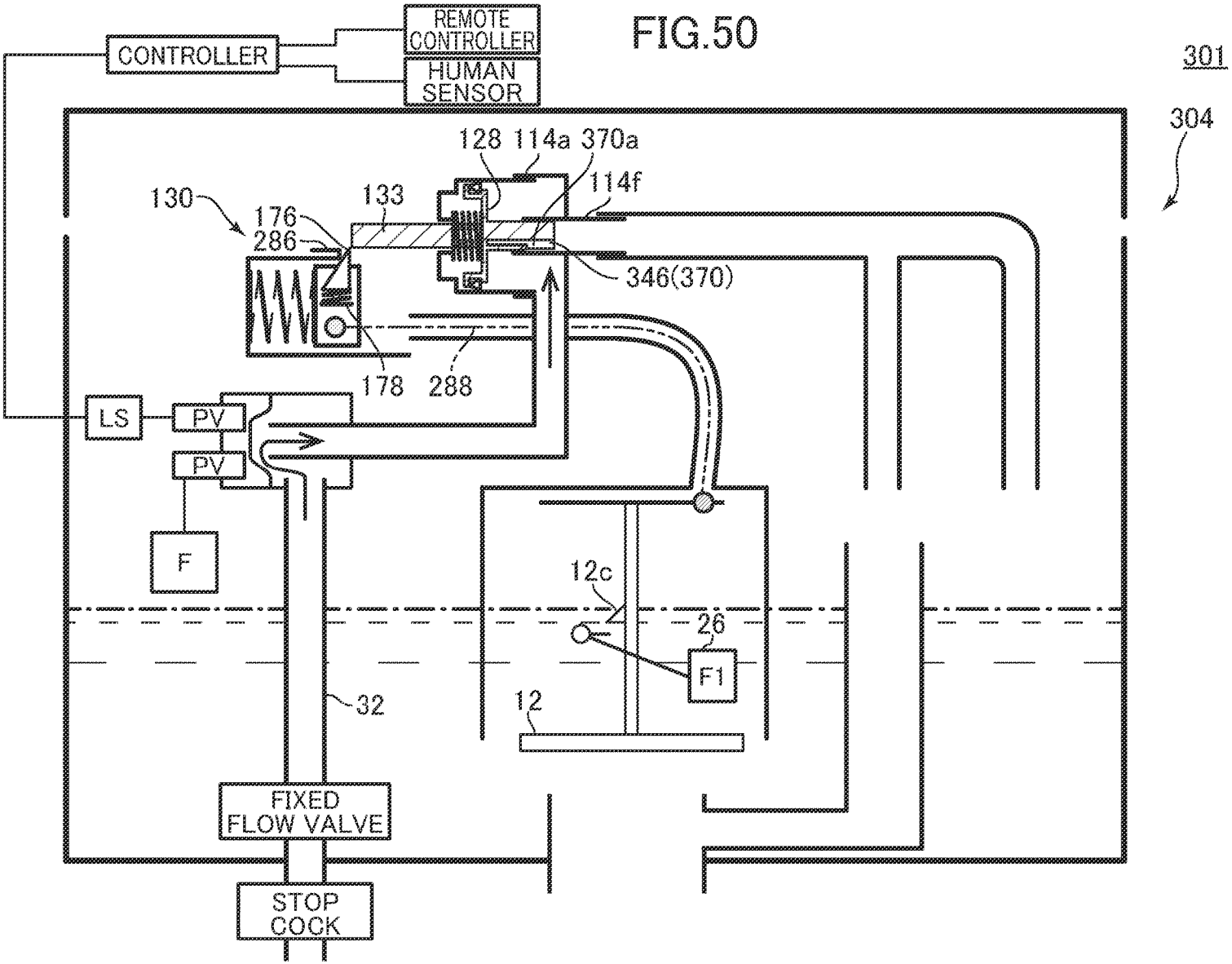
FIG. 50 is a schematic sectional view illustrating a state where a clutch mechanism is disengaged, in the flush water tank apparatus according to the fourth embodiment of the present invention.

As illustrated in FIGS. 45, 49, and 50, since the communicating flow path inlet portion 370*a* is located at a position facing the inner wall of the first through hole portion 114*f* when the piston 128 is moving from the first position H11 to the second position H12, the communicating flow path inlet portion 370*a* is in a closed state, and the communicating flow path 370 is in the state of not being formed (the closed state).

Figure 51:
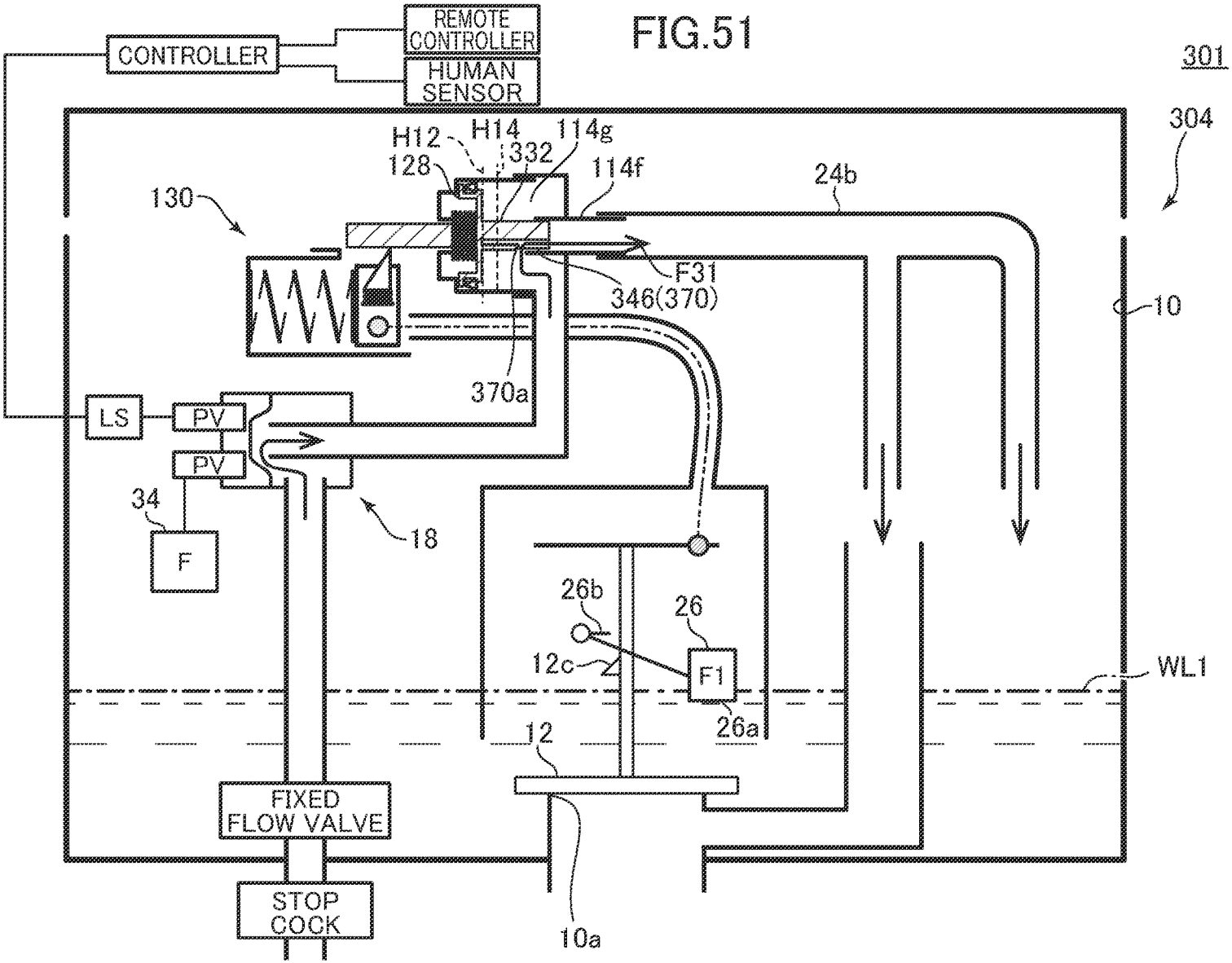
FIG. 51 is a schematic sectional view illustrating a state where the piston has reached the second position in the discharge valve hydraulic drive portion, in the flush water tank apparatus according to the fourth embodiment of the present invention.

As illustrated in FIG. 51, when the piston 128 is located at the second position H12, the communicating flow path inlet portion 370*a* opens to the pressure chamber 114*g* in the cylinder 114*a*. Accordingly, when the piston 128 is located at the second position H12, the communication mechanism 346 forms the communicating flow path 370 to thereby establish the communication between the pressure chamber 114*g* and the outflow pipe 24*b* via the communicating flow path 370. On the other hand, as illustrated in FIG. 45, when the piston 128 is located at the first position H11, the communication mechanism 346 creates the state where the communicating flow path 370 is not formed (is closed). As illustrated in FIG. 50, when the piston 128 is located between the first position H11 and the fourth position H14, the communication mechanism 346 creates the state where the communicating flow path 370 is not formed (is closed). As illustrated in FIG. 51, when the piston 128 is located between the fourth position H14 and the second position H12, the communication mechanism 346 creates the state where the communicating flow path 370 is open. The communication mechanism 346 has a switching function such as a switching valve for switching between the closed state and the open state of the communicating flow path 370.

The communicating flow path 370 is formed in such a size and a shape as to function as the main discharge path, and is different from the gap-shaped auxiliary discharge flow path that is formed between the first rod 332 and the first through hole portion 114*f*. For example, the auxiliary discharge flow path forms a flow path having such a size that the flush water that has flowed from the inflow pipe 24*a* to the cylinder 114*a* can flow out at a flow rate equal to or lower than one third of an inflow rate, and more preferably at the flow rate equal to or lower than one fourth. For example, a flow path cross-sectional area of the auxiliary discharge flow path is equal to or smaller than one third of the flow path cross-sectional area of the inlet portion 114*l*, more preferably equal to or smaller than one fourth, and further preferably 15% or less. Furthermore, for example the auxiliary discharge flow path may include a groove 372*a* formed by cutting out the side portion of the first rod 332 inward from the proximal end 332*c* to the distal end 332*b* of the first rod 332. The groove 372*a* forms a flow path having a sector-shaped cross section. Accordingly, when the piston 128 is located at the first position H11, the groove 372*a* of the auxiliary discharge flow path is in the open state. Regardless of a position of the piston 128, the auxiliary discharge flow path is always in the open state. However, since the cross-sectional area of the auxiliary discharge flow path is small, it takes time to discharge the water, and the auxiliary discharge flow path is used as an auxiliary element of the discharge flow path. The minimum value of the cross-sectional area of the auxiliary discharge flow path, e.g., a gap-shaped flow path between the first rod 332 and the first through hole portion 114*f* and the groove 372*a* is smaller than the minimum value of the cross-sectional area of the communicating flow path 370. The minimum value of the cross-sectional area of the gap-shaped flow path and the groove 372 is equal to or less than 50% of the minimum value of the cross-sectional area of the communicating flow path 370. As illustrated in FIG. 47, the groove 372*a* is formed at one place along the outer periphery of the first rod 332 in a front view as seen from the outflow pipe 24*b* side along the axial direction of the first rod 332. A central angle of the sector-shaped cross section of the groove 372*a* is set to about 72 degrees.

Figure 52:
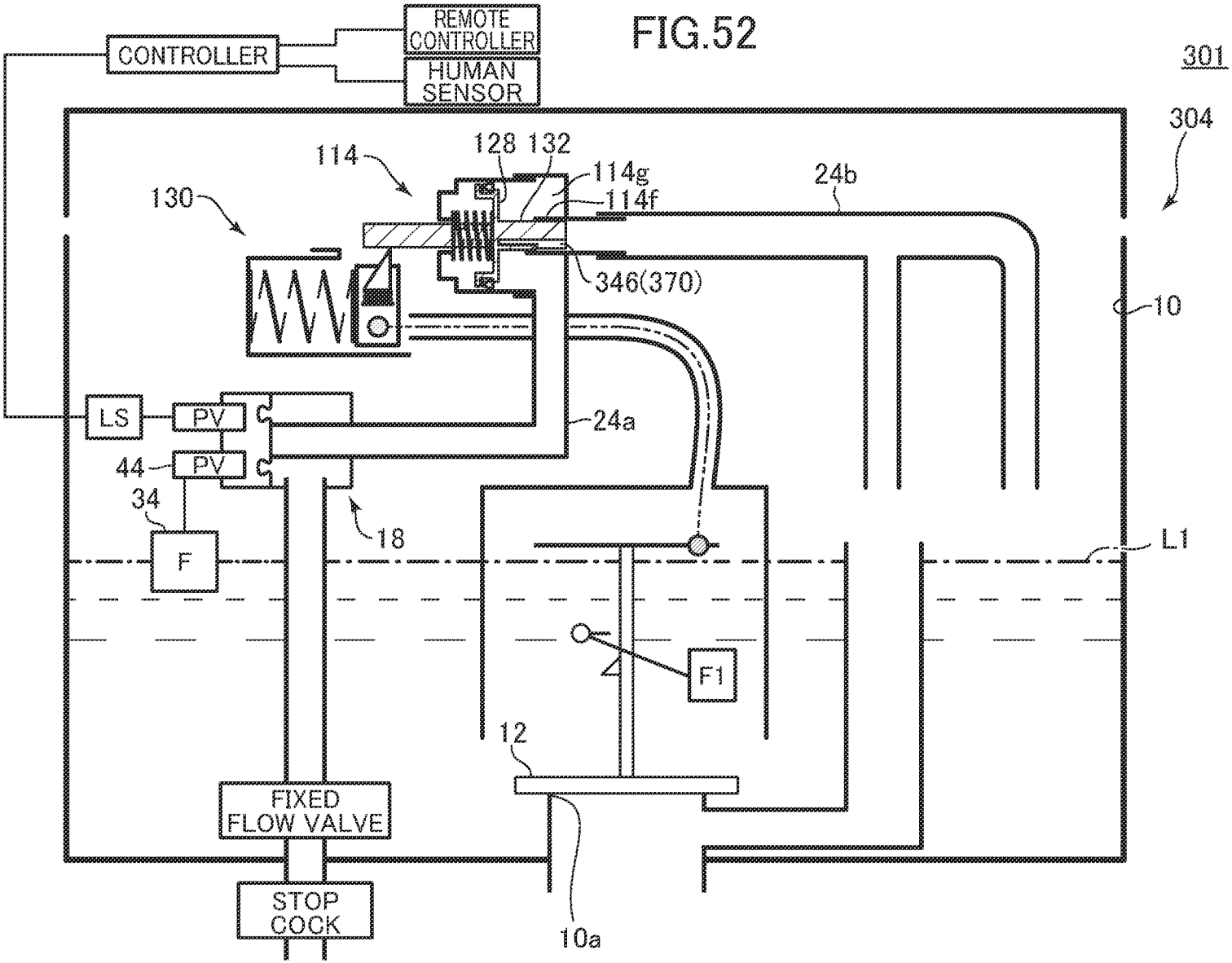
FIG. 52 is a schematic sectional view illustrating a state where the piston returns toward a first position in the discharge valve hydraulic drive portion, in the flush water tank apparatus according to the fourth embodiment of the present invention.

Next, referring to FIGS. 45 to 52 and the like, a sequence of flush operation of the flush water tank apparatus 304 according to the fourth embodiment of the present invention and the flush toilet apparatus 301 provided with the same will be described. Since the flush operation of the flush water tank apparatus 304 and the like in the fourth embodiment is almost the same as the flush operation of the flush water tank apparatus 204 and the like in the third embodiment, description of the same portions is to be referred to the description in the third embodiment and is omitted here. Since a timing chart showing temporal changes in displacement, a position of the piston and like in the flush water tank apparatus according to the fourth embodiment of the present invention is similar to the timing chart showing temporal changes in displacement, a position of the piston and like in the flush water tank apparatus according to the third embodiment shown in FIG. 40, the timing chart is to be referred to FIG. 40 and is omitted here. Since the states at the times T20 to T22, and the times T25 to T26 are the same as the flush operation of the flush water tank apparatus 204 in the third embodiment shown in FIG. 40, the states are illustrated in FIGS. 51 to 52, and description of the same portions is omitted here.

Figure 40:
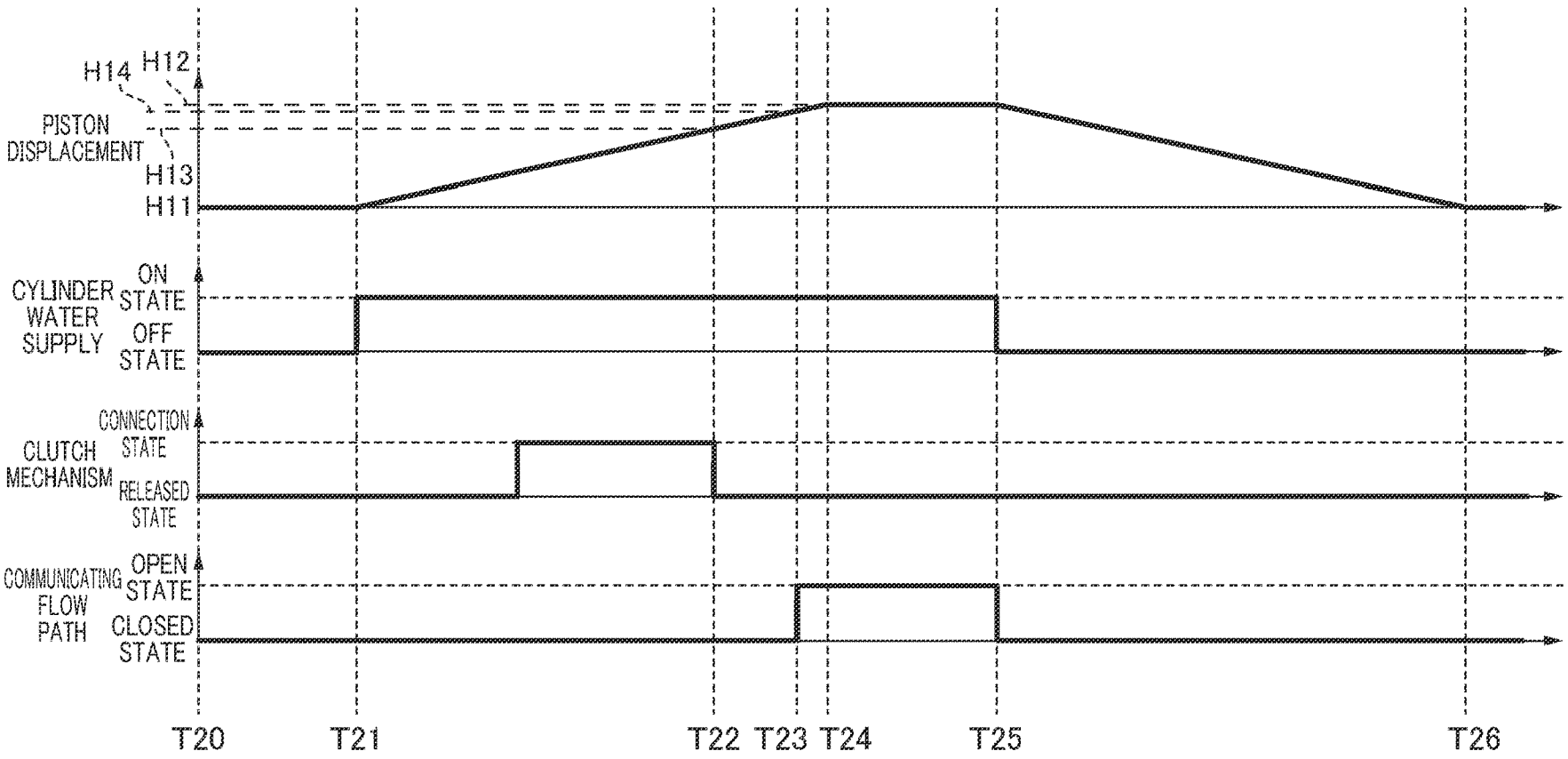
FIG. 40 is a timing chart showing temporal changes in displacement and height position of a piston, a state of cylinder water supply, a state of a clutch mechanism, and a state of a communicating flow path, in the flush water tank apparatus according to the third embodiment of the present invention.

At the time T23 in FIG. 40, when the piston 128 is further pushed and the first rod 332 moves together with the piston, and the piston 128 reaches the fourth position H14, the groove of the communicating flow path 370 appears in the inner side of the cylinder than the first through hole portion 114*f*, and reaches an opening position in the pressure chamber 114*g*, thereby forming the communicating flow path inlet portion 370*a*. Accordingly, the communicating flow path 370 for establishing the communication between the pressure chamber 114*g* and outflow pipe 24*b* is formed and is opened. Therefore, the flush water flows from the pressure chamber 114*g* into the communicating flow path 370 via the communicating flow path inlet portion 370*a*, and flows out from the communicating flow path 370 to the outflow pipe 24*b* through the exit portion 370*b*.

The fourth position H14 is located at a position on the farther side of the piston from the third position H13 and at a position on the side slightly closer to the inlet than (or in front of) the second position H12. That is, the disengagement of the clutch mechanism 130 and the communication between the pressure chamber 114*g* and the outflow pipe 24*b* established by the communication mechanism 346 are performed according to the displacement of the piston 128, and the fourth position H14 is a communication position where the communication between the pressure chamber 114*g* and the outflow pipe 24*b* is established by the communication mechanism 346, the communication position being located on a side closer to the second position H12 than the disengagement position (the third position H13) where the clutch mechanism 130 is disengaged. When the piston 128 is located between the fourth position H14 and the second position H12, the communicating flow path inlet portion 370*a* opens to the pressure chamber 114*g*, and the communicating flow path 370 forms a flow path for establishing the communication between the pressure chamber 114*g* and the outflow pipe 24*b*.

At the time T23, the water supply of the flush water into the pressure chamber 114*g* is continued, and the piston 128 and the first rod 332 continuously moves to the second position H12 even after the communicating flow path 370 establishes the communication. The clutch mechanism 130 is in the disengaged state.

As illustrated in FIG. 51, the piston 128 and the first rod 132 are further pushed, and reach the second position H12. At this time, the communicating flow path 370 is in the open state. Hereby, as indicated by an arrow F31, the flush water is discharged from the communicating flow path 370 to the outflow pipe 24*b*, and the flush water is discharged, as main supply water, from an ejecting portion at a downstream end of the outflow pipe 24*b* into the reservoir tank 10.

At the time T24, in the state where the supply of the flush water into the cylinder 114*a* is maintained even after the piston 128 has reached the second position H12, the communication mechanism 346 maintains the communication between the pressure chamber 114*g* and the outflow pipe 24*b*. Since the communicating flow path 370 is in the open state, the flush water flows out from the pressure chamber 114*g* to the outflow pipe 24*b* via the communicating flow path inlet portion 370*a*. Accordingly, the water pressure on the pressure chamber 114*g* side is substantially equal to the water pressure on the outflow pipe 24*b* side. Since a part of the flush water that has flowed out into the outflow pipe 24*b* flows into the reservoir tank 10, the water level in the reservoir tank 10 rises.

At the time T25, when the water level of the flush water in the reservoir tank 10 rises to a predetermined water level L1, the water supply valve float 34 rises, and the float-side pilot valve 44 is closed. Hereby, the water supply from the water supply controller 18 to the discharge valve hydraulic drive portion 114 is stopped, whereby the OFF state is created.

At the time T25, as illustrated in FIG. 51, the communicating flow path 370 forms a flow path for establishing the communication between the pressure chamber 114*g* and the outflow pipe 24*b*. However, as illustrated in FIG. 52, immediately after the piston 128 starts the return movement, the communicating flow path inlet portion 370*a* moves from the interior of the pressure chamber 114*g* to the position facing the inner wall of the first through hole portion 114*f*, and therefore the communicating flow path 370 is closed. Thereafter, the piston 128 and the first rod 332 continues the return movement. At the time T25, the water supply from the water supply controller 18 to the cylinder 114*a* is stopped, whereby the flush water is discharged from the auxiliary discharge flow path into the reservoir tank 10, and the flush water in the pressure chamber 114*g* is discharged from the auxiliary discharge flow path into the reservoir tank 10. Therefore, the water pressure on the pressure chamber 114*g* side can be reduced relatively quickly, and the piston 128 can return relatively quickly.

Thereafter, at the time T26, a sequence of flush operation is completed, and the flush toilet apparatus 301 returns to the standby state of the toilet flush operation.

According to the fourth embodiment of the present invention configured as described above, the communicating flow path 370 is formed by the groove 372*a* formed from the communicating flow path start position 332*d* of the first rod 332 to the distal end 332*b* of the first rod 332, the communicating flow path start position 332*d* appearing in the cylinder 114*a* to correspond to a communication position of the piston 128 in the outer surface portion of the first rod 332. Therefore, the communicating flow path 370 can be formed from the communicating flow path start position 332*d* of the first rod 332, and can be formed with a relatively simple groove.

What is claimed is:

1. A flush water tank apparatus configured to supply flush water to a flush toilet, the flush water tank apparatus, comprising:

a reservoir tank configured to store the flush water to be supplied to the flush toilet and having a water discharge opening formed to discharge stored the flush water to the flush toilet;

a discharge valve configured to open and close the water discharge opening to supply the flush water to the flush toilet and to stop a supply of the flush water to the flush toilet;

a discharge valve hydraulic drive portion configured to drive the discharge valve using a water supply pressure of supplied tap water;

a clutch mechanism configured to connect the discharge valve and the discharge valve hydraulic drive portion to pull up the discharge valve by a drive force of the discharge valve hydraulic drive portion, and to be disengaged at a predetermined timing to cause the discharge valve to fall; and a float mechanism configured to be operated according to a water level in the reservoir tank, and to be engaged with the discharge valve after the clutch mechanism is disengaged to switch between a holding attitude of restricting the fall of the discharge valve and a non-holding attitude of not restricting the fall of the discharge valve, wherein the discharge valve hydraulic drive portion includes:

a cylinder in which supplied the flush water flows;

a piston that is slidably disposed in the cylinder, the piston partitions inside of the cylinder into a pressure chamber and a back pressure chamber, and further the piston is moved from a first position to a second position by a pressure of the flush water that has flowed into the pressure chamber;

an outflow portion from which the flush water in the cylinder flows out; and a communication mechanism that establishes communication between the pressure chamber and the outflow portion after the clutch mechanism is disengaged.

2. The flush water tank apparatus according to claim 1, wherein a disengagement of the clutch mechanism and a communication between the pressure chamber and the outflow portion established by the communication mechanism are performed according to displacement of the piston, and a communication position is located where the communication between the pressure chamber and the outflow portion is established by the communication mechanism, the communication position being on a side closer to the second position than a disengagement position where the clutch mechanism is disengaged.

3. The flush water tank apparatus according to claim 2, wherein in a state where a supply of the flush water into the cylinder is maintained even after the piston has reached the second position, a state where the communication mechanism establishes the communication between the pressure chamber and the outflow portion is maintained.

4. The flush water tank apparatus according to claim 2, wherein the communication mechanism forms a piston inner flow path for establishing communication between the pressure chamber and a back pressure chamber to thereby establish the communication between the pressure chamber and the outflow portion via the piston inner flow path and the back pressure chamber.

5. The flush water tank apparatus according to claim 2, wherein the discharge valve hydraulic drive portion further includes a rod extending from the piston through a through hole portion formed in the cylinder, the rod forms at least a part of the communication mechanism, and the rod is configured to form a communicating flow path for establishing the communication between the pressure chamber and the outflow portion according to a position of the piston.

6. The flush water tank apparatus according to claim 5, wherein the communicating flow path is formed by a passage extending in the rod, the passage extending from a communicating flow path start position of the rod to a distal end of the rod, the communicating flow path start position appearing in the cylinder to correspond to the communication position of the piston.

7. The flush water tank apparatus according to claim 5, wherein the communicating flow path is formed by a groove formed from the communicating flow path start position of the rod to a distal end of the rod, the communicating flow path start position appearing in the cylinder to correspond to the communication position of the piston in the outer surface portion of the rod.

8. The flush water tank apparatus according to claim 6, wherein the rod is a rod extending toward a side opposite to an operating rod for the clutch mechanism extending from the piston toward the clutch mechanism.

9. The flush water tank apparatus according to claim 7, wherein the rod is a rod extending toward a side opposite to an operating rod for the clutch mechanism extending from the piston toward the clutch mechanism.

10. The flush water tank apparatus according to any one of claim 2, wherein the outflow portion is provided at a position further closer to an end portion side of the cylinder than the second position of the piston in the cylinder.

11. The flush water tank apparatus according to claim 4, wherein the communication mechanism is formed as a communication valve for forming the piston inner flow path in an open state, and for closing the piston inner flow path in a closed state, and the communication valve is maintained in the open state when the piston moves toward the first position.

12. The flush water tank apparatus according to claim 11, wherein the communication valve is in the open state when the piston is located at the first position.

13. The flush water tank apparatus according to claim 11, wherein in a case where supply of the flush water to the cylinder is started when the piston is located at the first position, the communication valve is turned from the open state to the closed state.

14. A flush toilet apparatus, comprising:

the flush water tank apparatus according to claim 1; and the flush toilet that is washed with flush water supplied from the flush water tank apparatus.

* * * * *